US010845095B2

(12) United States Patent
Ikeda et al.

(10) Patent No.: US 10,845,095 B2
(45) Date of Patent: Nov. 24, 2020

(54) AIR-CONDITIONING APPARATUS

(71) Applicant: Mitsubishi Electric Corporation, Chiyoda-ku (JP)

(72) Inventors: Soshi Ikeda, Chiyoda-ku (JP); Shinichi Wakamoto, Chiyoda-ku (JP); Naofumi Takenaka, Chiyoda-ku (JP); Takeshi Hatomura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 74 days.

(21) Appl. No.: 15/759,712

(22) PCT Filed: Sep. 23, 2016

(86) PCT No.: PCT/JP2016/078102
§ 371 (c)(1),
(2) Date: Mar. 13, 2018

(87) PCT Pub. No.: WO2017/068909
PCT Pub. Date: Apr. 27, 2017

(65) Prior Publication Data

US 2019/0049154 A1 Feb. 14, 2019

(30) Foreign Application Priority Data

Oct. 21, 2015 (JP) ..... 2015-207453

(51) Int. Cl.
*F25B 13/00* (2006.01)
*F25B 1/00* (2006.01)
(Continued)

(52) U.S. Cl.
CPC ..... *F25B 1/005* (2013.01); *F25B 1/00* (2013.01); *F25B 13/00* (2013.01); *F25B 31/004* (2013.01);
(Continued)

(58) Field of Classification Search
CPC ..... F25B 31/004; F25B 2313/006
See application file for complete search history.

(56) References Cited

U.S. PATENT DOCUMENTS 5,590,539 A * 1/1997 Marohl ..... F04C 23/00 123/196 AB
2010/0186604 A1* 7/2010 Otake ..... F25B 29/003 99/455
(Continued)

FOREIGN PATENT DOCUMENTS

JP 2010-236795 A 10/2010
JP 2011-47525 A 3/2011
(Continued)

OTHER PUBLICATIONS

International Search Report dated Nov. 22, 2016, in PCT/JP2016/078102 filed Sep. 23, 2016.

*Primary Examiner* — Elizabeth J Martin
*Assistant Examiner* — Nael N Babaa
(74) *Attorney, Agent, or Firm* — Xsensus LLP

(57) ABSTRACT

An air-conditioning apparatus includes a refrigerant circuit in which pipes sequentially connect a compressor, a flow switching device, a heat source side heat exchanger, an expansion device, a load side heat exchanger, and the flow switching device, and configured to perform a cooling operation and a heating operation switched by the flow switching device, an oil separator configured to separate refrigerating machine oil from refrigerant discharged from the compressor, a first bypass passage in which fluid flowing out of the oil separator flows, an auxiliary heat exchanger configured to cool the fluid, a first flow control device configured to control passing of the fluid, a second bypass passage in which liquid refrigerant or two-phase gas-liquid refrigerant flowing through one of the pipes connecting the heat source side heat exchanger and the expansion device
(Continued)

flows, and a second flow control device configured to control passing of refrigerant.

11 Claims, 23 Drawing Sheets

(51) Int. Cl.
*F25B 39/04* (2006.01)
*F25B 43/02* (2006.01)
*F25B 31/00* (2006.01)

(52) U.S. Cl.
CPC ..... *F25B 39/04* (2013.01); *F25B 43/02* (2013.01); *F25B 2313/006* (2013.01); *F25B 2313/021* (2013.01); *F25B 2313/0213* (2013.01); *F25B 2313/0233* (2013.01); *F25B 2341/0662* (2013.01); *F25B 2400/0409* (2013.01); *F25B 2400/0411* (2013.01); *F25B 2600/21* (2013.01); *F25B 2600/2501* (2013.01); *F25B 2700/2106* (2013.01); *F25B 2700/21152* (2013.01); *F25B 2700/21161* (2013.01)

(56) References Cited

U.S. PATENT DOCUMENTS

2011/0302949 A1* 12/2011 Honda ..... F24D 3/08 62/324.6
2012/0103003 A1 5/2012 Hokazono et al.
2015/0316275 A1* 11/2015 Yamashita ..... F25B 13/00 62/228.1
2015/0354787 A1* 12/2015 Chang ..... H04N 9/00 362/84

FOREIGN PATENT DOCUMENTS

JP 2011-89736 A 5/2011
JP 2014-115062 A 6/2014
WO 2010/086954 A1 8/2010
WO 2014/129473 A1 8/2014

* cited by examiner

AIR-CONDITIONING APPARATUS

TECHNICAL FIELD

The present invention relates to an air-conditioning apparatus that can reduce increase of the discharge temperature of a compressor.

BACKGROUND ART

In a conventionally known air-conditioning apparatus, refrigerating machine oil discharged from a compressor is cooled and returned to a suction side of the compressor (refer to Patent Literature 1, for example). The conventional air-conditioning apparatus disclosed in Patent Literature 1 controls a flow control device while the influence of heating by the returned oil on a refrigerant circuit is measured by sensing a temperature difference when the temperature of suction gas is increased by the heating.

CITATION LIST

Patent Literature

Patent Literature 1: Japanese Unexamined Patent Application Publication No. 2011-89736

SUMMARY OF INVENTION

Technical Problem

However, the conventional air-conditioning apparatus as disclosed in Patent Literature 1 potentially cannot reduce increase of the discharge temperature of the compressor, for example, when refrigerant that easily increases the discharge temperature is used.

The present invention is intended to solve the above-described problem and provide an air-conditioning apparatus that can reduce increase of the discharge temperature of a compressor.

Solution to Problem

An air-conditioning apparatus according to an embodiment of the present invention includes a refrigerant circuit in which pipes sequentially connect a compressor, a flow switching device, a heat source side heat exchanger, an expansion device, a load side heat exchanger, and the flow switching device, and configured to perform a cooling operation and a heating operation switched by the flow switching device, the cooling operation being an operation in which a discharge side of the compressor is connected to the heat source side heat exchanger and a suction side of the compressor is connected to the load side heat exchanger, the heating operation being an operation in which the discharge side of the compressor is connected to the load side heat exchanger and the suction side of the compressor is connected to the heat source side heat exchanger, an oil separator disposed in one of the pipes connecting a discharge unit of the compressor and the flow switching device, and configured to separate refrigerating machine oil from refrigerant discharged from the compressor, a first bypass passage connected to an oil outflow side of the oil separator and a suction unit of the compressor, and in which fluid flowing out of the oil separator flows, an auxiliary heat exchanger disposed in the first bypass passage, and configured to cool the fluid, a first flow control device disposed in the first bypass passage, and configured to control passing of the fluid, a second bypass passage connected to one of the pipes connecting the heat source side heat exchanger and the expansion device and to one of the pipes connecting the suction unit of the compressor and the flow switching device, and in which liquid refrigerant or two-phase gas-liquid refrigerant flowing through the one of the pipes connecting the heat source side heat exchanger and the expansion device flows, and a second flow control device disposed in the second bypass passage, and configured to control passing of refrigerant.

Advantageous Effects of Invention

In the air-conditioning apparatus according to an embodiment of the present invention, increase of the discharge temperature of the compressor is reduced by adjusting the opening degree of the first flow control device on the basis of a temperature measured by a discharge temperature sensor.

DESCRIPTION OF EMBODIMENTS

Figure 1:
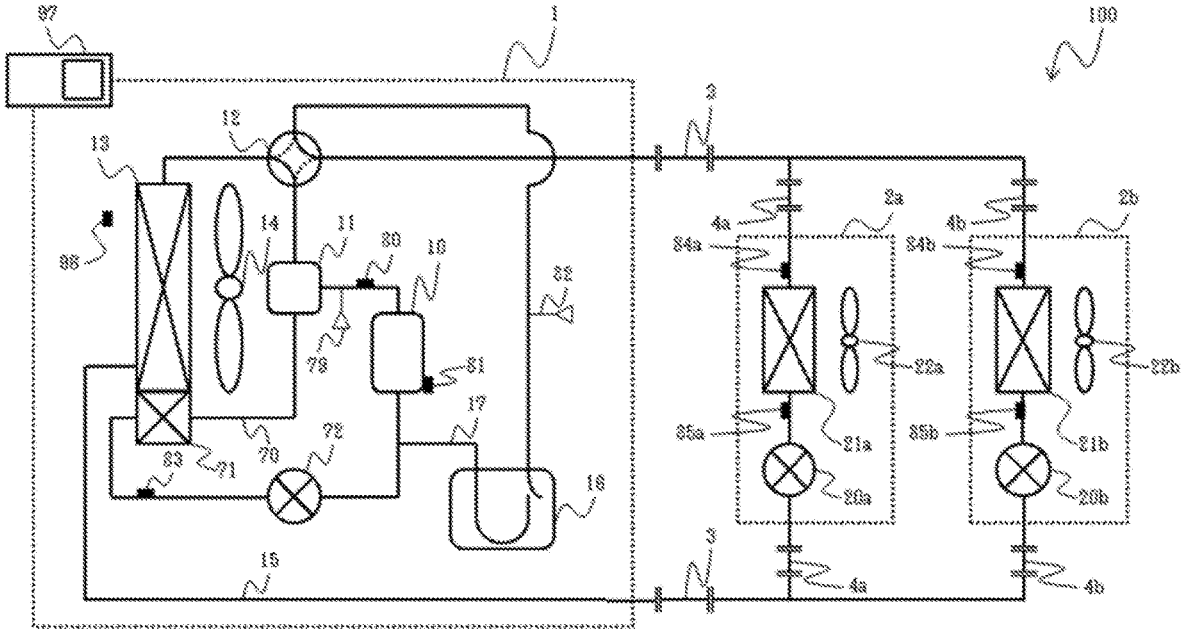
FIG. 1 is a diagram schematically illustrating an exemplary circuit configuration of an air-conditioning apparatus according to Embodiment 1 of the present invention.

Embodiments of the present invention will be described below with reference to the accompanying drawings. Any identical or equivalent part in the drawings is denoted by an identical reference sign, and duplicate description of the part will be omitted or simplified as appropriate. For example, the shape, size, and disposition of each component illustrated in the drawings may be changed as appropriate within the scope of the present invention.

Embodiment 1

[Air-Conditioning Apparatus]

FIG. 1 is a diagram schematically illustrating an exemplary circuit configuration of an air-conditioning apparatus according to Embodiment 1 of the present invention. An air-conditioning apparatus 100 according to the present embodiment includes a refrigerant circuit 15 in which an outdoor unit 1 and indoor units 2*a* and 2*b* are connected to each other through main pipes 3 and branch pipes 4*a* and 4*b*. Although FIG. 1 illustrates an example in which the two indoor units 2*a* and 2*b* are connected to the outdoor unit 1 in parallel through the main pipes 3 and the two branch pipes 4*a* and 4*b*, the number of indoor units may be one or three or larger.

[Outdoor Unit]

The outdoor unit 1 is installed, for example, at an outdoor place outside of a room and acts as a heat source apparatus configured to radiate or supply air conditioning heat. The outdoor unit 1 includes, for example, a compressor 10, an oil separator 11, a refrigerant flow switching device 12, a heat source side heat exchanger 13, an accumulator 16, a first bypass passage 70, an auxiliary heat exchanger 71, and a first flow control device 72 that are connected to each other through pipes. The outdoor unit 1 also includes a fan 14 as an air-sending device configured to send air to the heat source side heat exchanger 13 and the auxiliary heat exchanger 71.

The compressor 10 is configured to suck refrigerant and compress the refrigerant into a high-temperature and high-pressure state and is, for example, a capacity-controllable inverter compressor. The compressor 10 preferably has, for example, a low-pressure shell structure including a compression chamber in a sealed container and configured to suck and compress low-pressure refrigerant inside the sealed container under a low refrigerant pressure atmosphere in the sealed container.

The oil separator 11 is configured to separate refrigerating machine oil and refrigerant discharged from the compressor 10 and is, for example, a cyclone oil separator. The refrigerant flow switching device 12 is, for example, a four-way valve and configured to switch between a refrigerant passage in a heating operation mode and a refrigerant passage in a cooling operation mode.

In the cooling operation mode, the heat source side heat exchanger 13 acts as a condenser or a gas cooler. In the heating operation mode, the heat source side heat exchanger 13 acts as an evaporator. The heating operation mode is a heating operation mode in which the room is heated, and the cooling operation mode is a cooling operation mode in which the room is cooled.

The heat source side heat exchanger 13 is configured to act as an evaporator in the heating operation mode and act as a condenser in the cooling operation mode, and configured to exchange heat between refrigerant and air supplied from, for example, the fan 14. The accumulator 16 is provided to a suction unit that is a suction side of the compressor 10 and configured to store surplus refrigerant generated due to difference between the heating operation mode and the cooling operation mode, or surplus refrigerant generated due to transitional operation change.

The auxiliary heat exchanger 71 is configured to act as a cooler or a condenser in both of the heating operation mode and the cooling operation mode and configured to exchange heat between refrigerant and air supplied from, for example, the fan 14. The auxiliary heat exchanger 71 cools refrigerating machine oil when only the refrigerating machine oil passes through, and cools and condenses refrigerating machine oil and refrigerant when the refrigerating machine oil and the refrigerant pass through. For example, the heat source side heat exchanger 13 and the auxiliary heat exchanger 71 each have a structure in which heat transfer pipes having refrigerant passages different from each other are attached to common heat transfer fins. Specifically, a plurality of heat transfer fins are arranged in parallel, facing to an identical direction, and a plurality of heat transfer pipes are inserted into the heat transfer fins. A heat transfer pipe of the heat source side heat exchanger 13 and a heat transfer pipe of the auxiliary heat exchanger 71 that are provided on an identical heat transfer fin are independent from each other. For example, the heat source side heat exchanger 13 is disposed on an upper side, the auxiliary heat exchanger 71 is disposed on a lower side, and the plurality of heat transfer fins are shared. With this configuration, air surrounding the heat source side heat exchanger 13 and the auxiliary heat exchanger 71 circulates through both of the heat source side heat exchanger 13 and the auxiliary heat exchanger 71. For example, the auxiliary heat exchanger 71 is formed to have a heat-transfer area smaller than that of the heat source side heat exchanger 13 so that the auxiliary heat exchanger 71 has a heat exchange amount smaller than that of the heat source side heat exchanger 13.

The first bypass passage 70 is a pipe through which high-temperature refrigerating machine oil and high-temperature and high-pressure refrigerant flow into the auxiliary heat exchanger 71, and the refrigerating machine oil and refrigerant cooled by the auxiliary heat exchanger 71 flow into the suction unit of the compressor 10. The refrigerant is cooled and condensed at the auxiliary heat exchanger 71. The first bypass passage 70 has one end connected to an oil outflow side of the oil separator 11 and the other end connected to a suction pipe 17 between the compressor 10 and the accumulator 16.

The first flow control device 72 is disposed in the first bypass passage 70. The first flow control device 72 is, for example, an electronic expansion valve having a variably controllable opening degree, and provided on an outlet side of the auxiliary heat exchanger 71. The first flow control device 72 is provided to adjust the flow rate of refrigerating machine oil and liquid refrigerant that have been cooled and condensed at the auxiliary heat exchanger 71 and are flow into the suction unit of the compressor 10.

The outdoor unit 1 also includes a high-pressure sensor 79, a discharge temperature sensor 80, a refrigerating machine oil temperature sensor 81, a low pressure sensor 82, an auxiliary heat exchanger outlet temperature sensor 83, and an outside air temperature sensor 96. The high-pressure sensor 79 is configured to measure high pressure on a discharge side of the compressor 10. The discharge temperature sensor 80 is configured to measure the temperature of high-temperature and high-pressure refrigerant discharged from the compressor 10. The refrigerating machine oil temperature sensor 81 is configured to measure the temperature of refrigerating machine oil in a shell of the compressor 10. The refrigerating machine oil temperature sensor 81 may be configured to measure the temperature of an outer surface of the shell of the compressor 10, and in this case, a pseudo temperature of refrigerating machine oil in the shell of the compressor 10 is measured. The low pressure sensor 82 is configured to measure low pressure of refrigerant on the suction side of the compressor 10. The auxiliary heat exchanger outlet temperature sensor 83 is configured to measure the temperature of fluid subjected to heat exchange at the auxiliary heat exchanger 71. The outside air temperature sensor 96 is provided to an air suction unit of the heat source side heat exchanger 13 and configured to measure the ambient temperature of the outdoor unit 1.

[Indoor Unit]

The indoor units 2*a* and 2*b* are installed, for example, at an indoor place in a room and configured to supply conditioned air into the room. The indoor units 2*a* and 2*b* include load side expansion devices 20*a* and 20*b* and load side heat exchangers 21*a* and 21*b*, respectively. The load side expansion devices 20*a* and 20*b* are each configured to act as a pressure reducing valve or an expansion valve configured to depressurize and expand refrigerant. The load side expansion devices 20*a* and 20*b* are each preferably, for example, an electronic expansion valve having a variably controllable opening degree. The load side expansion devices 20*a* and 20*b* are provided upstream of the load side heat exchangers 21*a* and 21*b*, respectively, in a cooling only operation mode. The load side heat exchangers 21*a* and 21*b* are connected to the outdoor unit 1 through the main pipes 3 and the branch pipes 4*a* and 4*b*. The load side heat exchangers 21*a* and 21*b* are configured to generate, through heat exchange between air and refrigerant, heating air or cooling air to be supplied to an indoor space. Indoor air is sent to the load side heat exchangers 21*a* and 21*b* by fans 22.

The indoor units 2*a* and 2*b* each include an inlet side temperature sensor 85 and an outlet side temperature sensor 84. The inlet side temperature sensors 85 are each, for example, a thermistor and configured to measure the temperature of refrigerant flowing into the load side heat exchanger 21*a* or 21*b*. The inlet side temperature sensors 85 are provided to pipes on refrigerant inlet sides of the load side heat exchangers 21*a* and 21*b*. The outlet side temperature sensors 84 are each, for example, a thermistor and configured to measure the temperature of refrigerant flowing out of the load side heat exchanger 21*a* or 21*b*. The outlet side temperature sensors 84 are provided on refrigerant outlet sides of the load side heat exchangers 21*a* and 21*b*.

A controller 97 performs, for example, entire control of the air-conditioning apparatus 100 and includes, for example, an analog circuit, a digital circuit, a CPU, or a combination of two or more of these devices. The controller 97 is configured to execute each operation mode to be described later by controlling, for example, the driving frequency of the compressor 10, the rotation frequency of the fan 14 (activation and deactivation of the fan 14 is also included), switching of the refrigerant flow switching device 12, the opening degree of the first flow control device 72, and the opening degrees of the load side expansion devices 20*a* and 20*b* on the basis of measurement information obtained by the above-described various sensors and an instruction from an input device such as a remote controller. Although FIG. 1 exemplarily illustrates the configuration in which the controller 97 is provided to the outdoor unit 1, the controller 97 may be provided to each of the outdoor unit 1 and the indoor units 2*a* and 2*b* or may be provided to at least one of the indoor units 2*a* and 2*b*.

[Operation Mode of Air-Conditioning Apparatus]

The following describes each operation mode executed by the air-conditioning apparatus 100. The air-conditioning apparatus 100 is configured to execute cooling and heating operations of the indoor units 2*a* and 2*b* in accordance with instructions from the indoor units 2*a* and 2*b*. Operation modes executed by the air-conditioning apparatus 100 in FIG. 1 include the cooling operation mode in which all of the indoor units 2*a* and 2*b* that are driven execute the cooling operation, and the heating operation mode in which all of the indoor units 2*a* and 2*b* that are driven execute the heating operation. Each operation mode will be described below together with refrigerant flow.

[Cooling Operation Mode]

Figure 2:
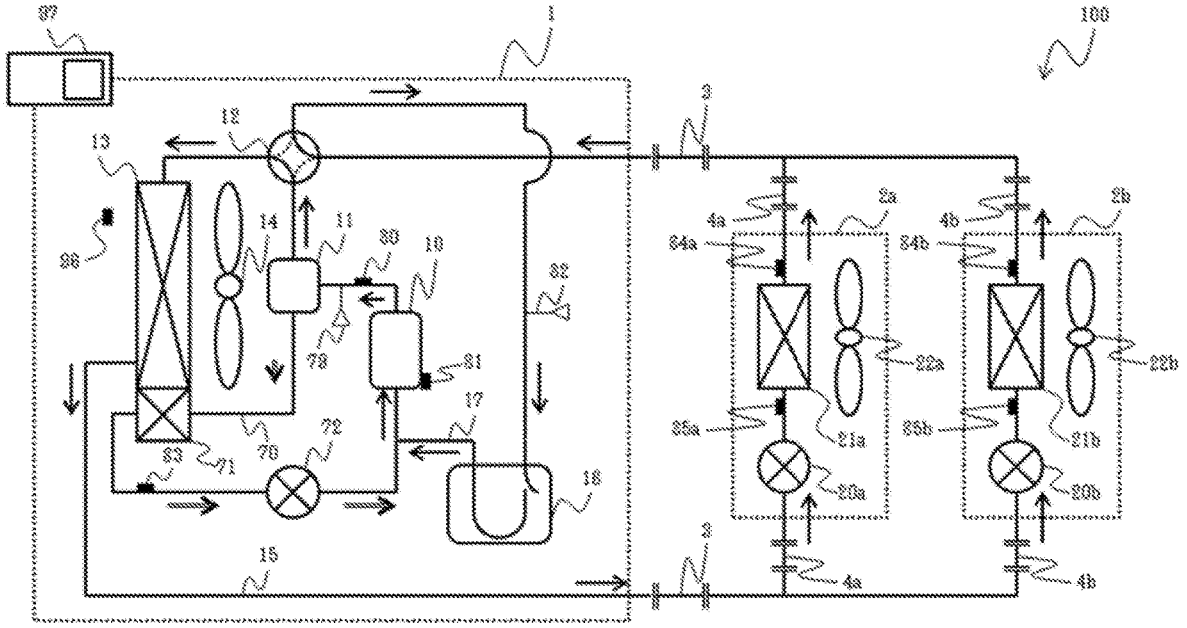
FIG. 2 is a diagram for description of exemplary refrigerant flow in the air-conditioning apparatus illustrated in FIG. 1 in a cooling operation mode.

FIG. 2 is a diagram for description of exemplary refrigerant flow in the air-conditioning apparatus illustrated in FIG. 1 in the cooling operation mode. With reference to the example illustrated in FIG. 2, the following describes the cooling only operation mode in which cooling loads are generated at the load side heat exchangers 21*a* and 21*b*. In FIG. 2, to facilitate understanding of the present embodiment, the flow direction of refrigerant flowing through the refrigerant circuit 15 is indicated with a solid-line arrow, and the flow direction of refrigerating machine oil and refrigerant flowing through the first bypass passage 70 is indicated with a double-line arrow.

The following first describes refrigerant flow in the refrigerant circuit 15. The compressor 10 sucks and compresses low-temperature and low-pressure refrigerant and discharges high-temperature and high-pressure refrigerant. The high-temperature and high-pressure refrigerant discharged from the compressor 10 flows into the heat source side heat exchanger 13 through the oil separator 11 and the refrigerant flow switching device 12. Then, the refrigerant flowing into the heat source side heat exchanger 13 condenses through heat exchange with outdoor air supplied from the fan 14. The refrigerant condensed at the heat source side heat exchanger 13 flows out of the outdoor unit 1 and flows into the indoor units 2*a* and 2*b* through the main pipe 3 and the branch pipes 4*a* and 4*b*.

The refrigerant flowing into the indoor units 2*a* and 2*b* is expanded at the load side expansion devices 20*a* and 20*b*. The refrigerant expanded at the load side expansion devices 20*a* and 20*b* flows into the load side heat exchangers 21*a* and 21*b* acting as evaporators and evaporates by receiving heat from indoor air. The indoor air is cooled through the heat reception from the indoor air by the refrigerant at the load side heat exchangers 21*a* and 21*b*. In this case, the opening degrees of the load side expansion devices 20*a* and 20*b* are controlled by the controller 97 so that superheat (the degree of superheat) is constant. The superheat can be obtained by using the difference between a temperature measured by the inlet side temperature sensor 85 and a temperature measured by the outlet side temperature sensor 84. The refrigerant flowing out of the load side heat exchangers 21*a* and 21*b* flows into the outdoor unit 1 again through the branch pipes 4*a* and 4*b* and the main pipe 3. The refrigerant flowing into the outdoor unit 1 is sucked into the compressor 10 again through the refrigerant flow switching device 12 and the accumulator 16 and compressed in the compressor 10 again.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil and part of the gas refrigerant discharged from the compressor 10 are separated by the oil separator 11 and flow into the auxiliary heat exchanger 71 through the first bypass passage 70. Then, the refrigerating machine oil and the gas refrigerant flowing through the auxiliary heat exchanger 71 are each cooled and condensed to a temperature equivalent to that of outdoor air supplied from the fan 14 while transferring heat to the outdoor air. The refrigerating machine oil and the liquid refrigerant flowing out of the auxiliary heat exchanger 71 are sucked into the compressor 10 again through the first flow control device 72.

[Effects in Cooling Operation Mode]

As described above, in the outdoor unit 1 according to the present embodiment in the cooling operation mode, refrigerating machine oil and part of gas refrigerant that are separated by the oil separator 11 flow into the auxiliary heat exchanger 71 through the first bypass passage 70. The refrigerating machine oil and the refrigerant flowing through the auxiliary heat exchanger 71 are cooled through heat exchange with outdoor air supplied from the fan 14. The refrigerating machine oil and the refrigerant cooled through the auxiliary heat exchanger 71 flow into the suction unit of the compressor 10 through the first flow control device 72. In this manner, in the outdoor unit 1 according to the present embodiment, the refrigerating machine oil and the refrigerant cooled through the auxiliary heat exchanger 71 is allowed to flow into the suction side of the compressor 10 when a discharge temperature on the discharge side of the compressor 10 has increased. As a result, in the outdoor unit 1 according to the present embodiment, the refrigerant having a decreased suction enthalpy of the compressor 10 flows into the suction unit of the compressor 10, thereby reducing increase of the discharge temperature of the compressor 10. In the outdoor unit 1 according to the present embodiment, as increase of the discharge temperature of the compressor 10 is reduced, degradation of refrigerating machine oil can be reduced, and degradation, damage, and other defects of the compressor 10 can be reduced. In addition, in the outdoor unit 1 according to the present embodiment, as increase of the discharge temperature of the compressor 10 is reduced, the rotational speed of the compressor 10 can be increased to achieve an increased cooling capacity. As a result, the comfort of a user of the air-conditioning apparatus 100 is improved. In particular, the effect of reducing the risk of degradation of refrigerating machine oil and the risk of degradation, damage, and other defects of the compressor 10 is significant when a refrigerant used in the air-conditioning apparatus 100 is, for example, a refrigerant such as an R32 refrigerant (hereinafter referred to as R32) with which the discharge temperature of the compressor 10 is higher than that when, for example, an R410A refrigerant (hereinafter referred to as R410A) is used. In addition, in the outdoor unit 1 according to the present embodiment, when the discharge temperature of the compressor 10 is low, loss due to suction heating is reduced as cooled refrigerating machine oil flows into the suction unit of the compressor 10.

[Heating Operation Mode]

Figure 3:
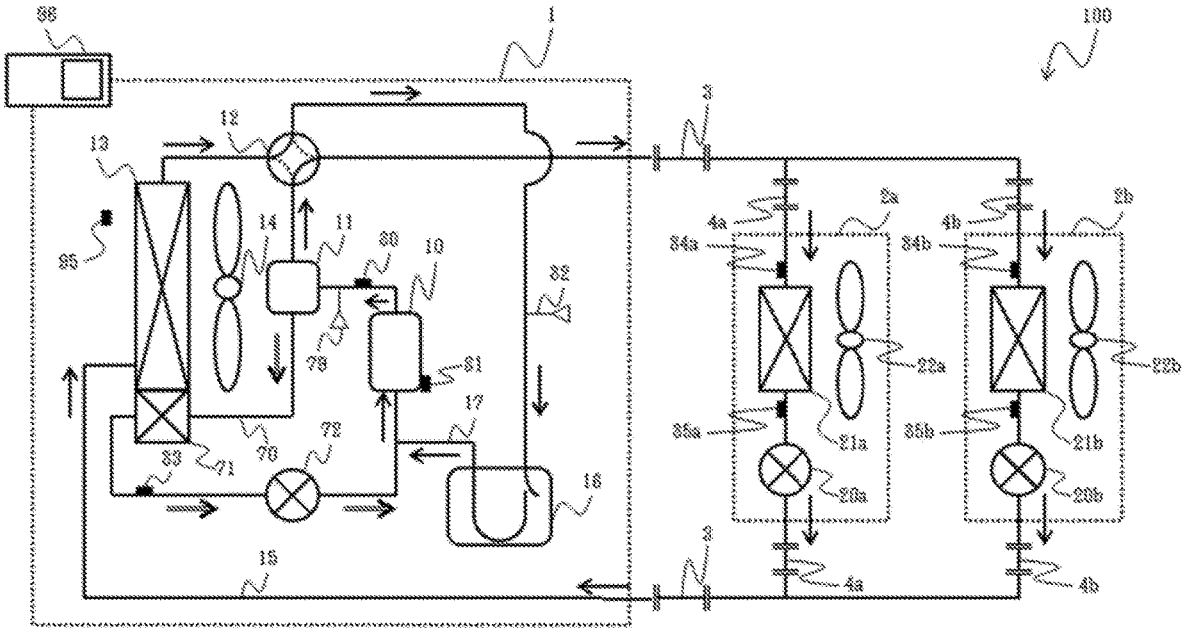
FIG. 3 is a diagram for description of exemplary refrigerant flow in the air-conditioning apparatus illustrated in FIG. 1 in a heating operation mode.

FIG. 3 is a diagram for description of exemplary refrigerant flow in the air-conditioning apparatus illustrated in FIG. 1 in the heating operation mode. FIG. 3 illustrates a heating only operation mode in an example in which heating loads are generated on the load side heat exchangers 21*a* and 21*b*. In FIG. 3, to facilitate understanding of the present embodiment, the flow direction of refrigerant flowing through the refrigerant circuit 15 is indicated with a solid-line arrow, and the flow direction of refrigerating machine oil and refrigerant flowing through the first bypass passage 70 is indicated with a double-line arrow.

The following first describes refrigerant flow in the refrigerant circuit 15. The compressor 10 sucks and compresses low-temperature and low-pressure refrigerant and discharges high-temperature and high-pressure refrigerant. The high-temperature and high-pressure refrigerant discharged from the compressor 10 flows out of the outdoor unit 1 through the oil separator 11 and the refrigerant flow switching device 12. The high-temperature and high-pressure refrigerant flowing out of the outdoor unit 1 passes through the main pipe 3 and the branch pipes 4*a* and 4*b* and condenses while heating an indoor space by transferring heat to indoor air at the load side heat exchangers 21*a* and 21*b*. The refrigerant condensed at the load side heat exchangers 21*a* and 21*b* is expanded at the load side expansion devices 20*a* and 20*b* and flows into the outdoor unit 1 again through the branch pipes 4*a* and 4*b* and the main pipe 3. The refrigerant flowing into the outdoor unit 1 flows into the heat source side heat exchanger 13 and evaporates while receiving heat from outdoor air at the heat source side heat exchanger 13, and is sucked into the compressor 10 again through the refrigerant flow switching device 12 and the accumulator 16.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil and part of the gas refrigerant discharged from the compressor 10 are separated by the oil separator 11 and flow into the auxiliary heat exchanger 71 through the first bypass passage 70. Then, the refrigerating machine oil and the gas refrigerant flowing through the auxiliary heat exchanger 71 are each cooled and condensed to a temperature equivalent to that of outdoor air supplied from the fan 14 while transferring heat to the outdoor air. The refrigerating machine oil and the liquid refrigerant flowing out of the auxiliary heat exchanger 71 are sucked into the compressor 10 again through the first flow control device 72.

[Effects of Heating Operation]

Similarly to the cooling operation mode described above, in the heating operation mode, the refrigerating machine oil and part of the gas refrigerant separated at the oil separator 11 flow into the auxiliary heat exchanger 71 through the first bypass passage 70. Then, the refrigerating machine oil and the refrigerant flowing through the auxiliary heat exchanger 71 are cooled through heat exchange with outdoor air supplied from the fan 14. The refrigerating machine oil and the refrigerant cooled through the auxiliary heat exchanger 71 flow into the suction unit of the compressor 10 through the first flow control device 72. In this manner, in the outdoor unit 1 according to the present embodiment, the refrigerating machine oil and the refrigerant cooled through the auxiliary heat exchanger 71 is allowed to flow into the suction side of the compressor 10 when the discharge temperature on the discharge side of the compressor 10 has increased. As a result, in the outdoor unit 1 according to the present embodiment, the refrigerant having a decreased suction enthalpy of the compressor 10 flows into the suction unit of the compressor 10, thereby reducing increase of the discharge temperature of the compressor 10. In the outdoor unit 1 according to the present embodiment, as increase of the discharge temperature of the compressor 10 is reduced, degradation of refrigerating machine oil can be reduced, and degradation, damage, and other defects of the compressor 10 can be reduced. In addition, in the outdoor unit 1 according to the present embodiment, as increase of the discharge temperature of the compressor 10 is reduced, the rotational speed of the compressor 10 can be increased to achieve an increased cooling capacity. As a result, the comfort of a user of the air-conditioning apparatus 100 is improved. In particular, the effect of reducing the risk of degradation of refrigerating machine oil and the risk of degradation, damage, and other defects of the compressor 10 is significant when a refrigerant used in the air-conditioning apparatus 100 is a refrigerant such as an R32 refrigerant (hereinafter referred to as R32) with which the discharge temperature of the compressor 10 is higher than that when, for example, an R410A refrigerant (hereinafter referred to as R410A) is used. In addition, in the outdoor unit 1 according to the present embodiment, when the discharge temperature of the compressor 10 is low, loss due to suction heating is reduced as cooled refrigerating machine oil flows into the suction unit of the compressor 10.

[Operation of First Flow Control Device 72]

The following describes the operation of the first flow control device 72. The first flow control device 72 is controlled by, for example, the controller 97. The first flow control device 72 is controlled on the basis of, for example, the discharge temperature of the compressor 10 measured by the discharge temperature sensor 80.

The following description will be first made on an exemplary relation between the opening degree of the first flow control device 72 and the discharge temperature of refrigerant discharged from the compressor 10. The flow rate of refrigerating machine oil and liquid refrigerant flowing into the suction unit of the compressor 10 through the auxiliary heat exchanger 71 in the first bypass passage 70 increases as the opening degree (opening area) of the first flow control device 72 increases. As a result, the temperature or quality of refrigerant at the suction unit of the compressor 10 decreases, and thus the discharge temperature of the compressor 10 tends to decrease. The flow rate of refrigerating machine oil and liquid refrigerant flowing into the suction unit of the compressor 10 through the auxiliary heat exchanger 71 in the first bypass passage 70 decreases as the opening degree (opening area) of the first flow control device 72 decreases. As a result, the temperature or quality of refrigerant at the suction unit of the compressor 10 increases, and thus the discharge temperature of the compressor 10 increases.

The following describes an exemplary relation between the opening degree of the first flow control device 72 and the state of fluid flowing into the first bypass passage 70. The state of fluid flowing into the first bypass passage 70 changes with increase of the flow rate of fluid flowing into the first bypass passage 70. For example, when the opening degree of the first flow control device 72 is small, only refrigerating machine oil accumulating at a lower part of the oil separator 11 flows into the first bypass passage 70. When only refrigerating machine oil flows into the first bypass passage 70, the flow rate of fluid flowing into the first bypass passage 70 is smaller than the flow rate of refrigerating machine oil flowing into the oil separator 11. As the opening degree of the first flow control device 72 is gradually opened, refrigerating machine oil and gas refrigerant start flowing into the first bypass passage 70. When refrigerating machine oil and gas refrigerant flow into the first bypass passage 70, the flow rate of fluid flowing into the first bypass passage 70 is larger than the flow rate of refrigerating machine oil flowing into the oil separator 11.

Figure 4:
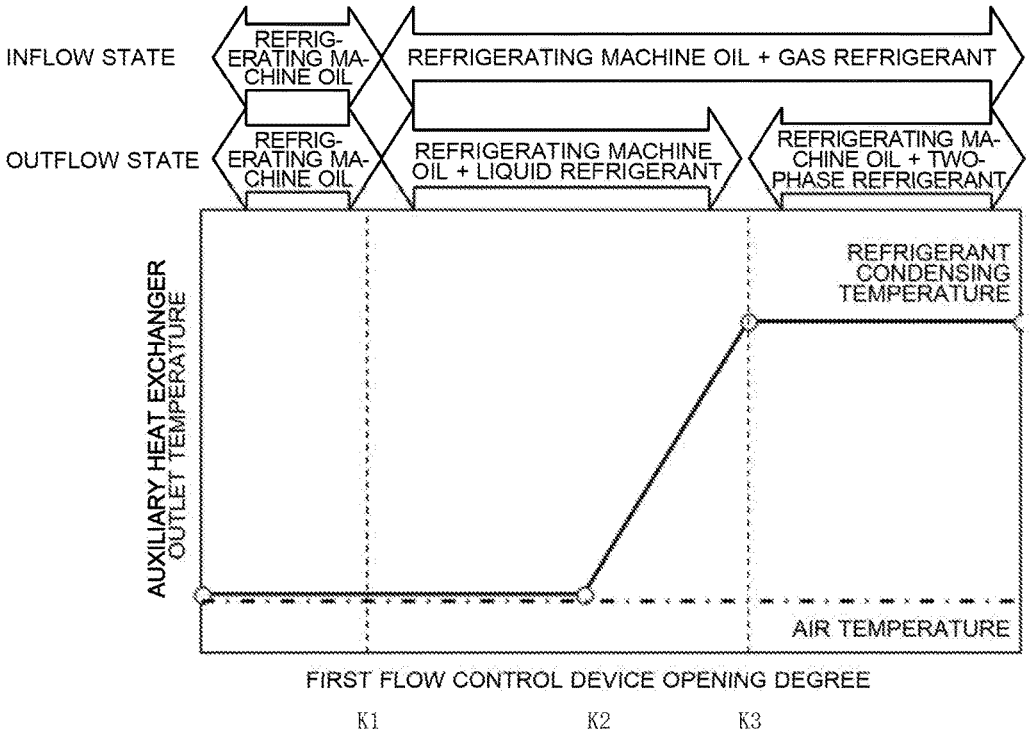
FIG. 4 is a diagram for description of an exemplary relation among the opening degree of a first flow control device illustrated in FIG. 1, the temperature of fluid having passed through an auxiliary heat exchanger, and the state of fluid flowing into a first bypass passage.
Figure 5:
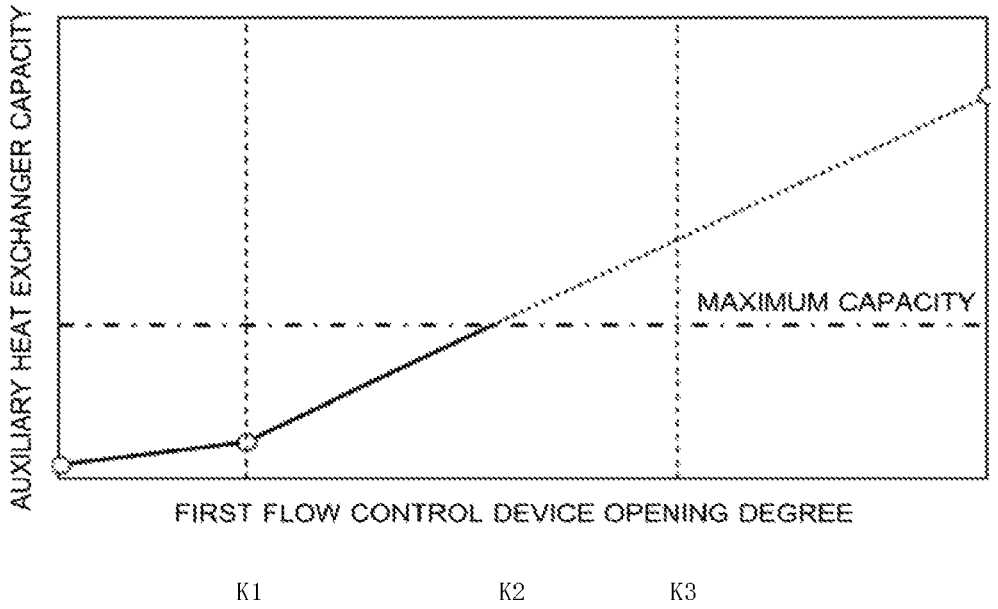
FIG. 5 is a diagram for description of an exemplary relation between the opening degree of the first flow control device illustrated in FIG. 1 and the capacity of the auxiliary heat exchanger.

FIG. 4 is a diagram for description of an exemplary relation among the opening degree of the first flow control device illustrated in FIG. 1, the temperature of fluid having passed through the auxiliary heat exchanger, and the state of fluid flowing into the first bypass passage. FIG. 5 is a diagram for description of an exemplary relation between the opening degree of the first flow control device illustrated in FIG. 1 and the capacity of the auxiliary heat exchanger. The following describes a relation between the opening degree of the first flow control device 72 and the heat exchange amount of the auxiliary heat exchanger 71 with reference to FIGS. 4 and 5.

As illustrated in FIG. 4, when the opening degree of the first flow control device 72 is equal to or smaller than K1, refrigerating machine oil flows into the first bypass passage 70. The refrigerating machine oil flowing into the first bypass passage 70 is cooled to a temperature close to air temperature through heat exchange at the auxiliary heat exchanger 71 and flows out of the auxiliary heat exchanger 71.

When the opening degree of the first flow control device 72 is larger than K1, refrigerating machine oil and gas refrigerant flow into the first bypass passage 70.

When the opening degree of the first flow control device 72 is larger than K1 and equal to or smaller than K3, the refrigerating machine oil and the gas refrigerant flowing into the first bypass passage 70 are each cooled to a temperature lower than the condensing temperature of refrigerant through heat exchange at the auxiliary heat exchanger 71. When the opening degree of the first flow control device 72 is larger than K1 and equal to or smaller than K3, the refrigerant subjected to heat exchange at the auxiliary heat exchanger 71 becomes liquid refrigerant.

When the opening degree of the first flow control device 72 is larger than K1 and equal to or smaller than K2, the refrigerating machine oil and the refrigerant subjected to heat exchange at the auxiliary heat exchanger 71 are cooled to a temperature close to air temperature.

When the opening degree of the first flow control device 72 is larger than K2 and equal to or smaller than K3, the temperatures of the refrigerating machine oil and the refrigerant subjected to heat exchange at the auxiliary heat exchanger 71 increase as the opening degree of the first flow control device 72 increases.

When the opening degree of the first flow control device 72 is larger than K3, the temperatures of the refrigerating machine oil and the refrigerant subjected to heat exchange at the auxiliary heat exchanger 71 become equal to the condensing temperature of the refrigerant. When the opening degree of the first flow control device 72 is larger than K3, the refrigerant subjected to heat exchange at the auxiliary heat exchanger 71 becomes two-phase refrigerant.

As described above, the heat exchange amount of the auxiliary heat exchanger 71 increases as the flow rate of fluid flowing into the first bypass passage 70 is increased by increasing the opening degree of the first flow control device 72.

However, when the flow rate of fluid flowing into the first bypass passage 70 becomes too large, refrigerating machine oil and refrigerant cannot be sufficiently cooled because the amount of heat exchange that can be achieved by the auxiliary heat exchanger 71 is limited, and accordingly, the temperature at an outlet of the auxiliary heat exchanger 71 increases. When the temperatures of refrigerating machine oil and liquid refrigerant flowing out of the auxiliary heat exchanger 71 have increased, further increase of the flow rate of fluid flowing into the first bypass passage 70 does not change the capacity of cooling the suction side of the compressor 10, and thus the discharge temperature of the compressor 10 does not decrease. Moreover, an unnecessary amount of gas refrigerant that should otherwise flow into the indoor units 2*a* and 2*b* is bypassed, thereby degrading the performance and capacity of the air-conditioning apparatus 100.

In the present embodiment, the first flow control device 72 is controlled while the maximum processing capacity of the auxiliary heat exchanger 71 is monitored. Specifically, the operation of the first flow control device 72 is controlled on the basis of the outlet temperature of the auxiliary heat exchanger 71 measured by the auxiliary heat exchanger outlet temperature sensor 83 installed at the outlet of the auxiliary heat exchanger 71.

Figure 6:
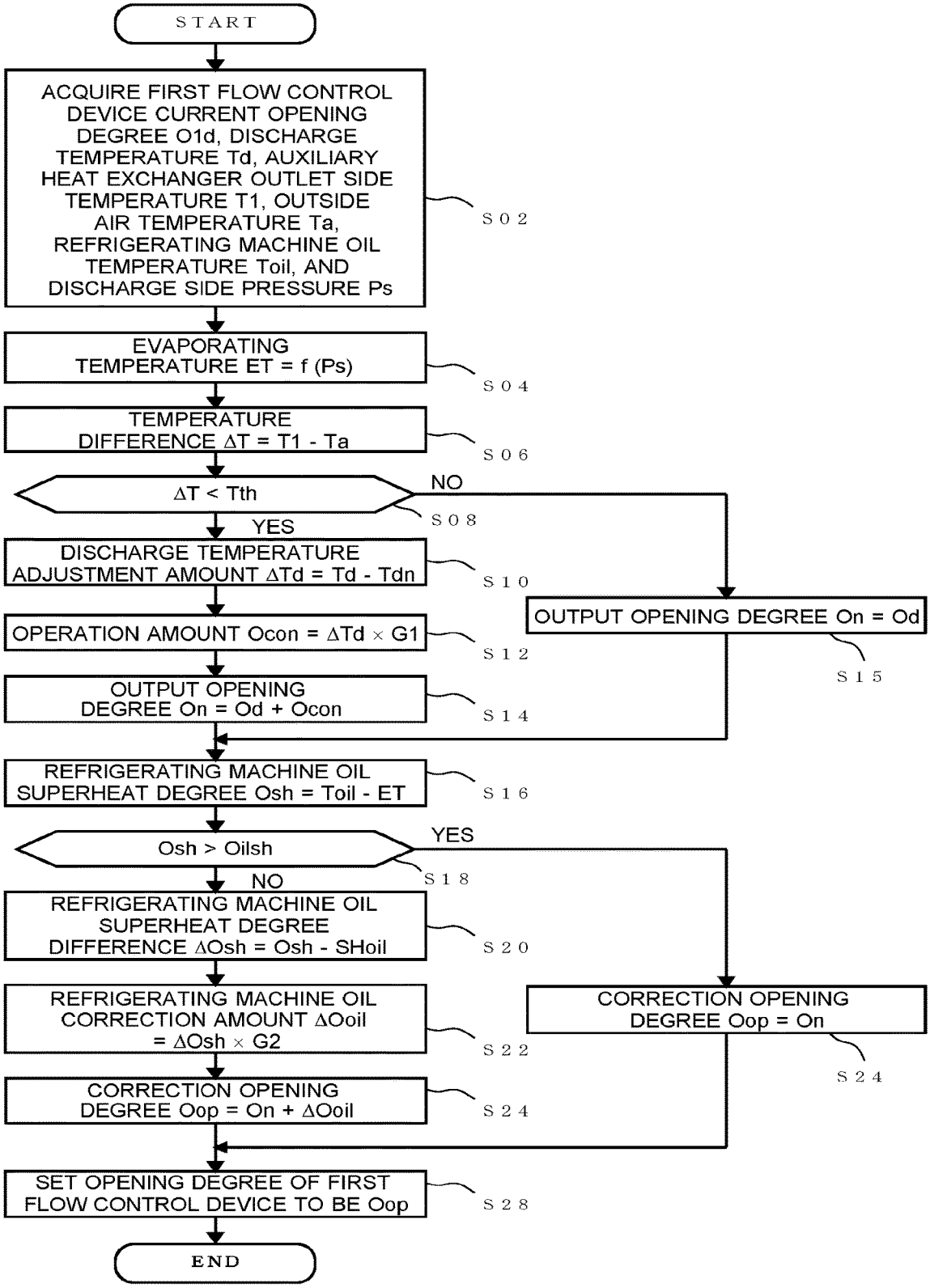
FIG. 6 is a diagram for description of an exemplary operation of the air-conditioning apparatus illustrated in FIG. 1.

FIG. 6 is a diagram for description of an exemplary operation of the air-conditioning apparatus illustrated in FIG. 1. The controller 97 performs control described below, for example, in each set constant period (for example, 30 seconds). First, at step S02, the controller 97 acquires a first flow control device current opening degree O1*d* that is the current opening degree of the first flow control device 72, a discharge temperature Td that is the temperature on the discharge side of the compressor 10, an auxiliary heat exchanger outlet side temperature T1 that is the temperature on the outlet side of the auxiliary heat exchanger 71, an outside air temperature Ta that is the temperature of outside air, a refrigerating machine oil temperature Toil that is the temperature of refrigerating machine oil in the shell of the compressor 10, and a discharge side pressure Ps that is the pressure on the discharge side of the compressor 10. For example, an acquisition unit (not illustrated) of the controller 97 acquires the first flow control device current opening degree O1*d* from the first flow control device 72, acquires the discharge temperature Td from the discharge temperature sensor 80, acquires the auxiliary heat exchanger outlet side temperature T1 from the auxiliary heat exchanger outlet temperature sensor 83, acquires the outside air temperature Ta from the outside air temperature sensor 96, acquires the refrigerating machine oil temperature Toil from the refrigerating machine oil temperature sensor 81, and acquires the discharge side pressure Ps from the high-pressure sensor 79.

At step S04, the controller 97 acquires a condensing temperature CT that is the condensing temperature of refrigerant. Specifically, the controller 97 converts a discharge side pressure Pd into the condensing temperature CT of refrigerant.

At step S06, the controller 97 calculates a temperature difference ΔT by subtracting the outside air temperature Ta from the auxiliary heat exchanger outlet side temperature T1. At step S08, the controller 97 compares the temperature difference ΔT with a temperature difference threshold Tth. The temperature difference threshold Tth is a value set in advance and stored in a storage unit (not illustrated). The temperature difference threshold Tth is, for example, 5 degrees C.

At step S08, when the temperature difference ΔT is smaller than the temperature difference threshold Tth, the controller 97 proceeds to step S10 and calculates a discharge temperature adjustment amount ΔTd by subtracting a target discharge temperature Tdn from the discharge temperature Td. The target discharge temperature Tdn is a value set in advance and related to the specifications of the compressor 10. The target discharge temperature Tdn is stored in the storage unit (not illustrated). At step S12, the controller 97 calculates an operation amount Ocon by multiplying the discharge temperature adjustment amount ΔTd by a control constant G1. The control constant G1 is a positive value related to the amount of control of the first flow control device 72. The control constant G1 is set in advance and stored in the storage unit (not illustrated). Thus, when the discharge temperature adjustment amount ΔTd is positive, in other words, when the discharge temperature is higher than the discharge temperature target value, the operation amount Ocon of the first flow control device 72 is calculated such that the opening degree is increased. When the discharge temperature adjustment amount ΔTd is negative, in other words, when the discharge temperature is lower than the discharge temperature target value, the operation amount Ocon of the first flow control device 72 is calculated such that the opening degree is decreased. At step S14, the controller 97 calculates an output opening degree On by adding the operation amount Ocon to the current opening degree Od, and then proceeds to step S16.

When, at step S08, the temperature difference ΔT is equal to or larger than the temperature difference threshold Tth, the controller 97 calculates an output opening degree Onex by defining the current opening degree Od as the output opening degree Onex at step S15 to maintain the current opening degree O1*d*, and then proceeds to step S16.

At step S16, the controller 97 calculates a refrigerating machine oil superheat degree Osh by subtracting the condensing temperature ET from the refrigerating machine oil temperature Toil. At step S18, the controller 97 compares the refrigerating machine oil superheat degree Osh with a refrigerating machine oil superheat degree threshold OILsh. The refrigerating machine oil superheat degree threshold OILsh is a value set in advance and stored in the storage unit (not illustrated). The refrigerating machine oil superheat degree threshold OILsh is, for example, 30 K.

At step S18, when the refrigerating machine oil superheat degree Osh is equal to or smaller than the refrigerating machine oil superheat degree threshold OILsh, the controller 97 proceeds to step S20 and calculates a refrigerating machine oil superheat degree difference ΔOsh by subtracting a refrigerating machine oil superheat degree target value SHoil from the refrigerating machine oil superheat degree Osh. The refrigerating machine oil superheat degree target value SHoil is a value set in advance and stored in the storage unit (not illustrated). The refrigerating machine oil superheat degree target value SHoil is, for example, 10 K.

At step S22, the controller 97 calculates a refrigerating machine oil correction amount ΔOoil by multiplying the refrigerating machine oil superheat degree difference ΔOsh by a control constant G2. The control constant G2 is set so that the correction amount of the first flow control device 72 is always calculated such that the opening degree is decreased when the refrigerating machine oil superheat degree difference ΔOsh of the refrigerating machine oil superheat degree Osh is positive and the correction amount of the first flow control device 72 increases as the refrigerating machine oil superheat degree difference ΔOsh decreases, in other words, as the refrigerating machine oil superheat degree Osh approaches the target value of the refrigerating machine oil superheat degree Osh. The control constant G2 is also set so that the correction amount of the first flow control device 72 is a fixed value when the refrigerating machine oil superheat degree difference ΔOsh of the refrigerating machine oil superheat degree Osh is negative, in other words, when the refrigerating machine oil superheat degree Osh is smaller than the target value of the refrigerating machine oil superheat degree Osh.

At step S24, the controller 97 calculates a correction opening degree Oop by adding the refrigerating machine oil correction amount ΔOoil to the output opening degree Onex, and then proceeds to step S28.

At step S18, when the refrigerating machine oil superheat degree Osh is smaller than the refrigerating machine oil superheat degree threshold OILsh, the controller 97 proceeds to step S24 and calculates the correction opening degree Oop by defining the output opening degree Onex as the correction opening degree Oop, and then proceeds to step S28.

At step S28, the controller 97 sets the opening degree of the first flow control device 72 to be the correction opening degree Oop.

Although the above description is made on the example in which the temperature difference threshold Tth is 5 degrees C., the temperature difference threshold Tth is not limited to 5 degrees C. Specifically, when the maximum processing capacity of the auxiliary heat exchanger 71 is reached and refrigerant in the two-phase state flows out of the outlet of the auxiliary heat exchanger 71, the temperature at the outlet of the auxiliary heat exchanger 71 becomes equal to a saturated temperature corresponding to a high pressure of refrigerant flowing into the auxiliary heat exchanger 71. In other words, the temperature difference threshold Tth that is the difference between the auxiliary heat exchanger outlet side temperature T1 and the outside air temperature Ta when the maximum processing capacity of the auxiliary heat exchanger 71 is reached is, at maximum, a difference obtained by subtracting the outside air temperature from the condensing temperature, and thus the threshold may be set to be equal to or smaller than the difference.

As described above, upper limits can be set to the flow rates of refrigerating machine oil and gas refrigerant bypassed from the oil separator 11 by adjusting the opening degree of the first flow control device 72 depending on the outlet temperature of the auxiliary heat exchanger 71. This configuration prevents refrigerating machine oil and gas refrigerant from being excessively bypassed, thereby reducing degradation of the capacity and performance of the air-conditioning apparatus 100.

Embodiment 2

Figure 7:
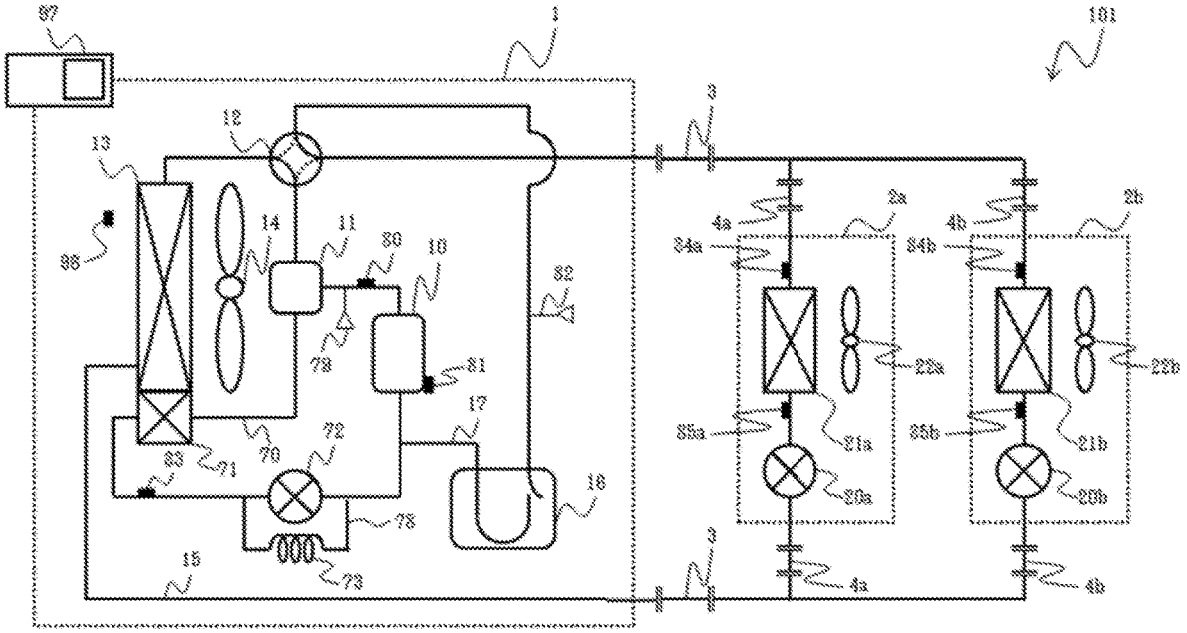
FIG. 7 is a diagram schematically illustrating an exemplary circuit configuration of an air-conditioning apparatus according to Embodiment 2 of the present invention.

FIG. 7 is a diagram schematically illustrating an exemplary circuit configuration of an air-conditioning apparatus according to Embodiment 2 of the present invention. In this air-conditioning apparatus 101 illustrated in FIG. 7, any component having a configuration identical to that of the air-conditioning apparatus 100 illustrated in FIG. 1 is denoted by an identical reference sign, and description of the component will be omitted. The air-conditioning apparatus 101 illustrated in FIG. 7 is different from the air-conditioning apparatus 100 illustrated in FIG. 1 in the configuration of the outdoor unit 1. Specifically, the outdoor unit 1 according to the present embodiment further includes a flow controller 73 disposed in parallel to the first flow control device 72. The flow controller 73 is, for example, a capillary tube that has a fixed passage resistance value. The flow controller 73 has a smaller passage resistance than, for example, the passage resistance of the first flow control device 72 when the first flow control device 72 is fully opened. A pipe on which the flow controller 73 is disposed corresponds to a "bypass path 78" according to the present invention. In other words, the outdoor unit 1 according to the present embodiment may include the bypass path 78 that is disposed in parallel to the first flow control device 72 and to which the flow controller 73 is not provided.

In the air-conditioning apparatus 101, the controller 97 controls the first flow control device 72 so that the first flow control device 72 is fully closed when the discharge temperature of the compressor 10 measured by, for example, the discharge temperature sensor 80 is equal to or lower than a discharge temperature threshold. The discharge temperature threshold is lower than, for example, a temperature at which the compressor 10 is potentially damaged or a temperature at which refrigerating machine oil potentially degrades, and is set to be, for example, equal to or lower than 115 degrees C. The discharge temperature threshold is set in advance depending on, for example, a limit value of the discharge temperature of the compressor 10, and stored in, for example, the storage unit (not illustrated).

As the outdoor unit 1 according to the present embodiment includes the flow controller 73 disposed in parallel to the first flow control device 72 as described above, refrigerating machine oil, or refrigerating machine oil and refrigerant sequentially circulate the compressor 10, the oil separator 11, the auxiliary heat exchanger 71, the flow controller 73, and the compressor 10 even when the first flow control device 72 suffers anomaly and is closed. With this configuration, even when the first flow control device 72 suffers anomaly and is closed, refrigerating machine oil in an amount enough to prevent refrigerating machine oil in the compressor 10 from running short flows into the suction unit of the compressor 10 through the auxiliary heat exchanger 71 and the flow controller 73. Thus, in the outdoor unit 1 according to the present embodiment, when the first flow control device 72 suffers anomaly and is closed, refrigerating machine oil is maintained in an amount necessary for reduction of increase of the discharge temperature of the compressor 10 and for lubrication and sealing of the compressor 10. As a result, in the outdoor unit 1 according to the present embodiment, the risk of damage on the compressor 10 is reliably reduced.

Embodiment 3

Figure 8:
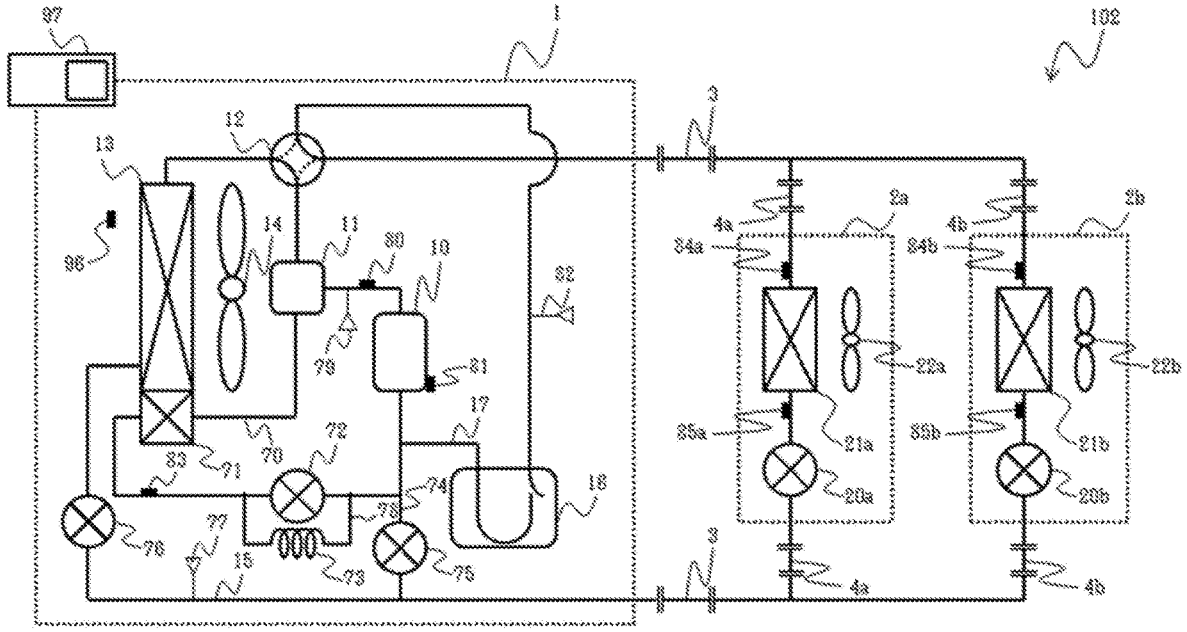
FIG. 8 is a diagram schematically illustrating an exemplary circuit configuration of an air-conditioning apparatus according to Embodiment 3 of the present invention.

FIG. 8 is a diagram schematically illustrating an exemplary circuit configuration of an air-conditioning apparatus according to Embodiment 3 of the present invention. In this air-conditioning apparatus 102 illustrated in FIG. 8, any component having a configuration identical to that of the air-conditioning apparatus 101 illustrated in FIG. 7 is denoted by an identical reference sign, and description of the component will be omitted. The air-conditioning apparatus 102 illustrated in FIG. 8 is different from the air-conditioning apparatus 101 illustrated in FIG. 7 in the configuration of the outdoor unit 1. Specifically, the outdoor unit 1 according to the present embodiment further includes a second bypass passage 74 on which a second flow control device 75 is disposed. The second bypass passage 74 has one end connected to a pipe between the heat source side heat exchanger 13 and the main pipe 3 through which liquid refrigerant or two-phase refrigerant including liquid refrigerant circulates in both of the cooling operation and the heating operation, and has the other end connected to an outflow side of the first flow control device 72. In other words, the second bypass passage 74 serves as a bypass between the suction side of the compressor 10 and the pipe connecting the heat source side heat exchanger 13 and the load side expansion devices 20*a* and 20*b*. The second bypass passage 74 is a pipe through which low-temperature and high-pressure liquid refrigerant flows into the suction unit of the compressor 10 in the cooling operation, or middle-temperature and middle-pressure liquid refrigerant or two-phase refrigerant flows into the suction unit of the compressor 10 in the heating operation. The second flow control device 75 is, for example, an electronic expansion valve having a variably controllable opening degree, and is configured to adjust the flow rate of liquid refrigerant flowing into the suction unit of the compressor 10 or two-phase refrigerant.

A pressure adjustment device 76 is disposed between the heat source side heat exchanger 13 and an upstream connection part with the second bypass passage 74. In other words, the pressure adjustment device 76 is disposed between the heat source side heat exchanger 13 and the connection part connected to the second bypass passage 74 on the pipe connecting the heat source side heat exchanger 13 and the load side expansion devices 20*a* and 20*b*. The pressure adjustment device 76 is, for example, an electronic expansion valve having a variably controllable opening degree, and adjusts the pressure at an upstream part of the second bypass passage 74 to be middle pressure, for example, in the heating operation. In other words, the pressure adjustment device 76 is configured to adjust the pressure of liquid refrigerant or two-phase refrigerant flowing into the second bypass passage 74. The outdoor unit 1 is also provided with a middle-pressure sensor 77 configured to measure the pressure between outlets of the load side expansion devices 20 and the pressure adjustment device 76.

The following describes refrigerant flow through the second bypass passage 74 in each operation mode executed by the air-conditioning apparatus 102.

[Cooling Operation Mode]

In the cooling operation mode, for example, the pressure adjustment device 76 is fully opened. Most of refrigerant flowing out of the heat source side heat exchanger 13 flows out of the outdoor unit 1 through the pressure adjustment device 76 and flows into the indoor units 2 through the main pipe 3 and the branch pipes 4*a* and 4*b*. The refrigerant flowing into the indoor units 2 is expanded at the load side expansion devices 20*a* and 20*b* and subjected to heat exchange at the load side heat exchangers 21*a* and 21*b*. The refrigerant subjected to heat exchange at the load side heat exchangers 21*a* and 21*b* flows into the outdoor unit 1 again through the branch pipes 4*a* and 4*b* and the main pipe 3. The refrigerant flowing into the outdoor unit 1 is sucked into the compressor 10 again through the refrigerant flow switching device 12 and the accumulator 16 and compressed in the compressor 10 again.

Part of the refrigerant flowing out of the heat source side heat exchanger 13 flows into the second bypass passage 74 and is expanded at the second flow control device 75. The refrigerant expanded at the second flow control device 75 joins to fluid flowing out the first flow control device 72, joins to refrigerant flowing out of the accumulator 16, and then is sucked into the compressor 19 again.

[Effects of Cooling Operation Mode]

In this manner, in the air-conditioning apparatus 102 according to the present embodiment in the cooling operation mode, the suction enthalpy of the compressor 10 can be decreased by fluid cooled through the auxiliary heat exchanger 71 and also by part of refrigerant cooled through the heat source side heat exchanger 13. Thus, in the air-conditioning apparatus 102 according to the present embodiment, when the discharge temperature of the compressor 10 has increased, the increase of the discharge temperature of the compressor 10 can be reduced. Specifically, for example, when heat exchange capacity that is the processing capacity of the auxiliary heat exchanger 71 has reached an upper limit of the heat exchange capacity, the increase of the discharge temperature of the compressor 10 can be reduced by opening the second flow control device 75. In the air-conditioning apparatus 102 according to the present embodiment, as the increase of the discharge temperature of the compressor 10 can be reduced, degradation of refrigerating machine oil and damage on the compressor 10 can be reduced. In addition, as refrigerating machine oil at the suction unit of the compressor 10 is reliably cooled, loss due to suction heating of the compressor 10 can be reduced. Furthermore, as increase of the discharge temperature of the compressor 10 is reduced, the rotation frequency of the compressor 10 can be increased to improve cooling intensity.

[Heating Operation Mode]

In the heating operation, the pressure adjustment device 76 has, for example, an opening degree that increases, to middle pressure, the pressure between outlets of the load side expansion devices 20*a* and 20*b* of the indoor units 2 and an inlet of the pressure adjustment device 76. Specifically, the pressure adjustment device 76 is controlled so that a value measured by the middle-pressure sensor 77 becomes equal to a pressure value set in advance. The controller 97 has a function to control, in the heating operation, the opening degree of the pressure adjustment device 76 on the basis of a middle pressure Pm measured by the middle-pressure sensor 77.

Specifically, the controller 97 measures the middle pressure Pm from the middle-pressure sensor 77, and performs such control that the middle pressure Pm satisfies Expression (1) below.

$$Ps<Pm<Pd \quad (1)$$

In the expression, Ps represents a suction pressure measured by the low pressure sensor 82, and Pd represents a discharge pressure measured by the high-pressure sensor 79.

The refrigerant transfers heat to indoor air at the load side heat exchangers 21 and is expanded at the load side expansion devices 20*a* and 20*b*, and the middle-temperature and middle-pressure refrigerant in the two-phase gas-liquid state flows into the outdoor unit 1 again through the branch pipes 4*a* and 4*b* and the main pipe 3. The middle-temperature and middle-pressure refrigerant in the two-phase gas-liquid state flowing into the outdoor unit 1 flows into the second bypass passage 74, is expanded to low-temperature and low-pressure refrigerant in the two-phase gas-liquid state at the second flow control device 75, joins to refrigerating machine oil and liquid refrigerant flowing out of the first flow control device 72, joins to refrigerant flowing out of the accumulator 16, and then is sucked into the compressor 19 again.

[Effects of Heating Operation Mode]

In the air-conditioning apparatus 102 according to the present embodiment in the heating operation mode, the suction enthalpy of the compressor 10 can be decreased by fluid cooled through the auxiliary heat exchanger 71 and also by part of refrigerant cooled through the heat source side heat exchanger 13. Thus, in the air-conditioning apparatus 102 according to the present embodiment, when the discharge temperature of the compressor 10 has increased, the increase of the discharge temperature of the compressor 10 can be reduced. Specifically, for example, when the heat exchange capacity, which is the processing capacity of the auxiliary heat exchanger 71, has reached an upper limit of the heat exchange capacity, the increase of the discharge temperature of the compressor 10 can be reduced by opening the second flow control device 75. In the air-conditioning apparatus 102 according to the present embodiment, as the increase of the discharge temperature of the compressor 10 can be reduced, degradation of refrigerating machine oil and damage on the compressor 10 can be reduced. In addition, as refrigerating machine oil at the suction unit of the compressor 10 is reliably cooled, loss due to suction heating of the compressor 10 can be reduced. Furthermore, as increase of the discharge temperature of the compressor 10 is reduced, the rotation frequency of the compressor 10 can be increased to improve cooling intensity.

[Operations of First Flow Control Device 72 and Second Flow Control Device 75]

Figure 9:
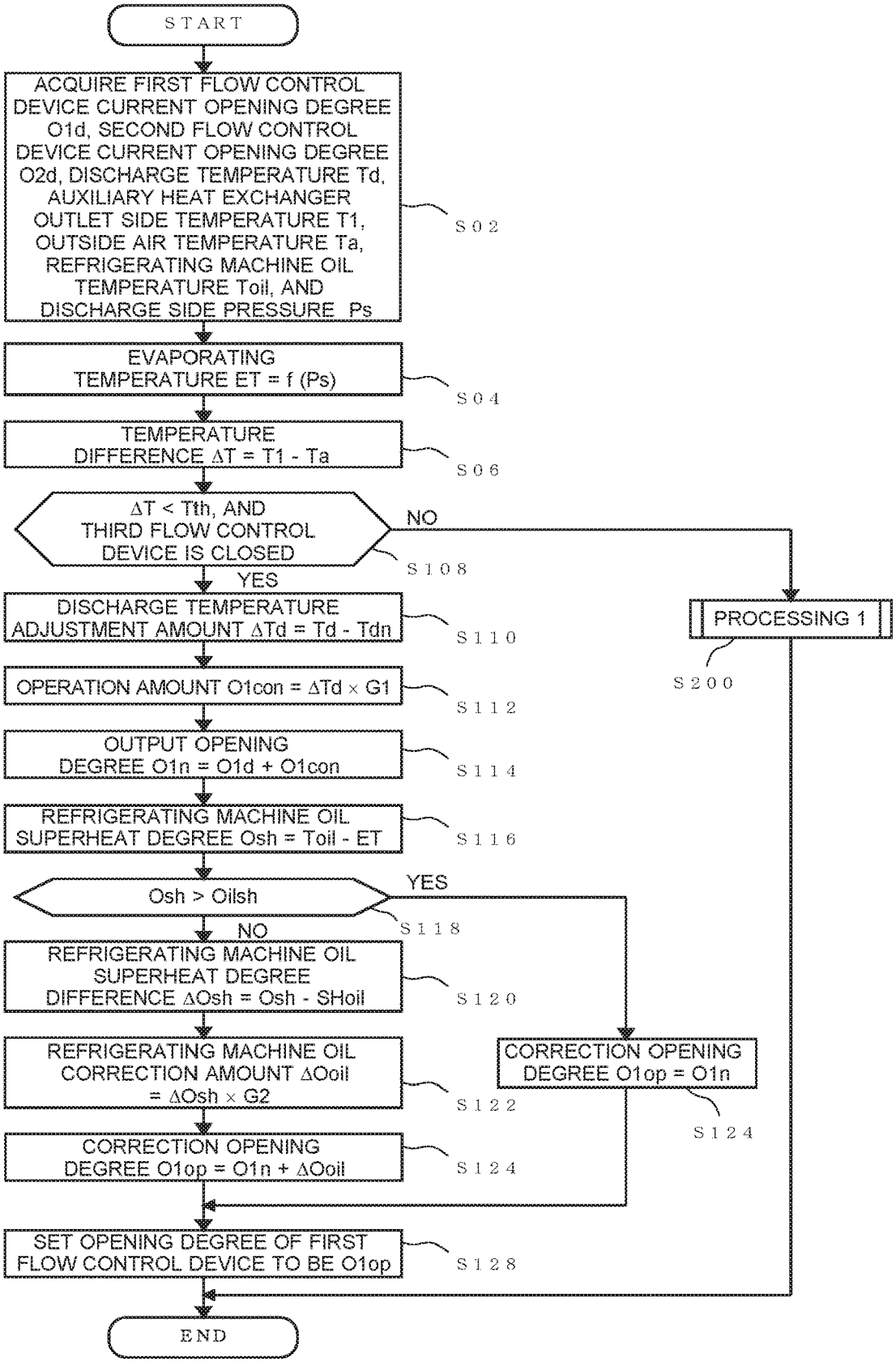
FIG. 9 is a diagram for description of an exemplary operation of the air-conditioning apparatus illustrated in FIG. 8.
Figure 10:
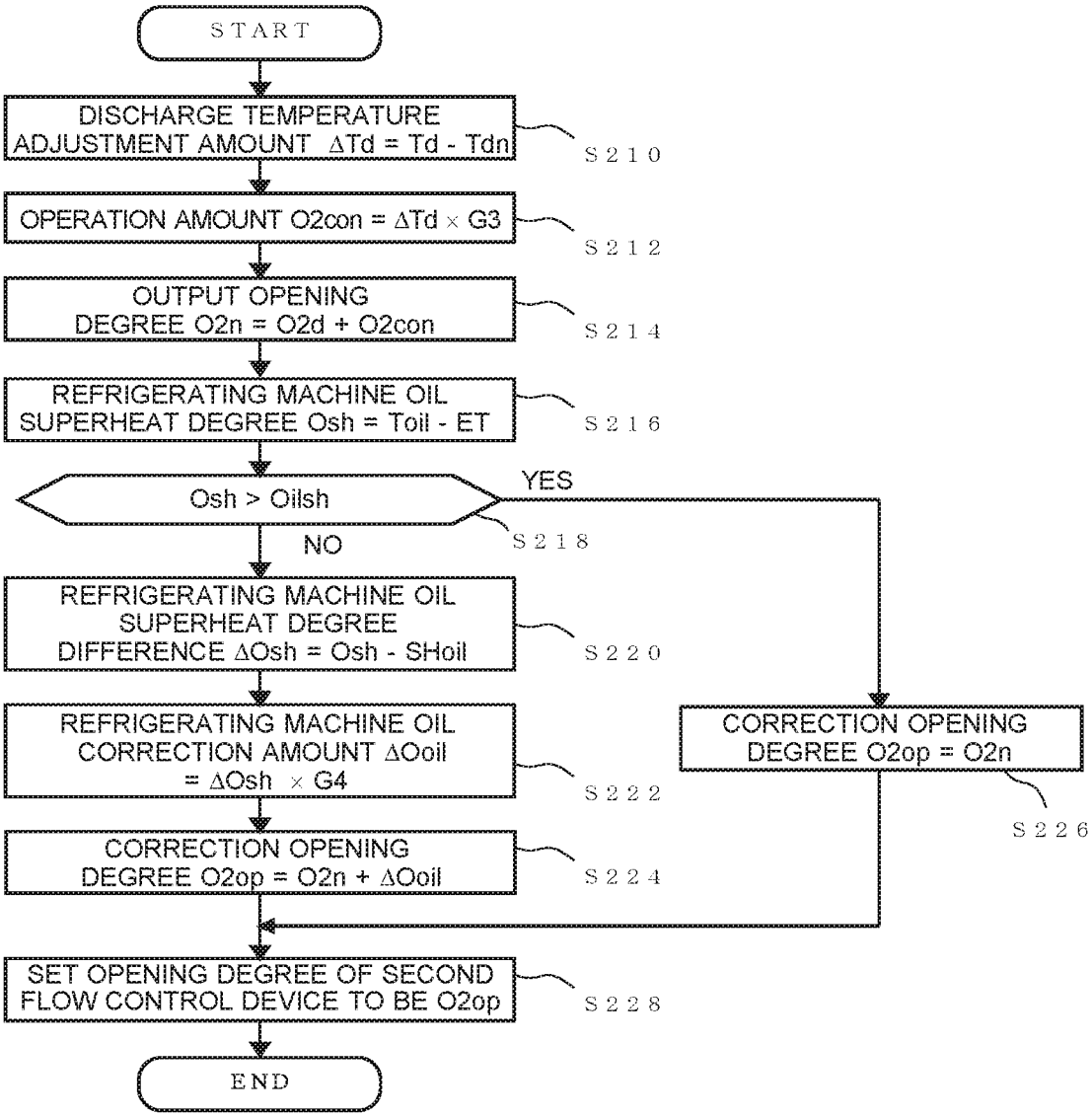
FIG. 10 is a diagram for description of processing 1 illustrated in FIG. 9.

FIG. 9 is a diagram for description of an exemplary operation of the air-conditioning apparatus illustrated in FIG. 8, and FIG. 10 is a diagram for description of processing 1 illustrated in FIG. 9. The following describes operations of the first flow control device 72 and the second flow control device 75 with reference to FIGS. 9 and 10. The opening degrees of the first flow control device 72 and the second flow control device 75 are controlled on the basis of, for example, the discharge temperature of the compressor 10 measured by the discharge temperature sensor 80. Moreover, which is to be controlled is switched between the opening degree of the first flow control device 72 and the opening degree of the second flow control device 75 on the basis of the outlet temperature of the auxiliary heat exchanger 71 measured by the auxiliary heat exchanger outlet temperature sensor 83.

The controller 97 executes control described below, for example, each set constant period (for example, 30 seconds). First, at step S02 in FIG. 9, the controller 97 acquires the first flow control device current opening degree O1*d* that is the current opening degree of the first flow control device 72, a second flow control device current opening degree O2*d* that is the current opening degree of the second flow control device 75, the discharge temperature Td that is the temperature on the discharge side of the compressor 10, the auxiliary heat exchanger outlet side temperature T1 that is the temperature on the outlet side of the auxiliary heat exchanger 71, the outside air temperature Ta that is the temperature of outside air, the refrigerating machine oil temperature Toil that is the temperature of refrigerating machine oil in the shell of the compressor 10, and the discharge side pressure Ps that is the pressure on the discharge side of the compressor 10. For example, the acquisition unit (not illustrated) of the controller 97 acquires the first flow control device current opening degree O1*d* from the first flow control device 72, acquires the second flow control device current opening degree O2*d* from the second flow control device 75, acquires the discharge temperature Td from the discharge temperature sensor 80, acquires the auxiliary heat exchanger outlet side temperature T1 from the auxiliary heat exchanger outlet temperature sensor 83, acquires the outside air temperature Ta from the outside air temperature sensor 96, acquires the refrigerating machine oil temperature Toil from the refrigerating machine oil temperature sensor 81, and acquires the discharge side pressure Ps from the high-pressure sensor 79.

At step S04, the controller 97 acquires the condensing temperature CT that is the condensing temperature of refrigerant. Specifically, the controller 97 converts the discharge side pressure Pd into the condensing temperature CT of refrigerant.

At step S06, the controller 97 calculates the temperature difference ΔT by subtracting the outside air temperature Ta from the auxiliary heat exchanger outlet side temperature T1.

At step S108, the controller 97 compares the temperature difference ΔT with the temperature difference threshold Tth and determines whether the second flow control device 75 is opened or closed on the basis of the second flow control device current opening degree O2*d*. The temperature difference threshold Tth is a value set in advance and stored in the storage unit (not illustrated). The temperature difference threshold Tth is, for example, 5 degrees C. When the temperature difference ΔT is smaller than the temperature difference threshold Tth and the second flow control device 75 is closed, the controller 97 proceeds to step S110. When the temperature difference ΔT is equal to or larger than the temperature difference threshold Tth or the second flow control device 75 is opened, the controller 97 proceeds to step S200. As describes below, the first flow control device 72 is to be controlled when the temperature difference ΔT is smaller than the temperature difference threshold Tth and the second flow control device 75 is closed, or the second flow control device 75 is to be controlled when the temperature difference ΔT is equal to or larger than the temperature difference threshold Tth or the second flow control device 75 is opened.

At step S110, the controller 97 calculates the discharge temperature adjustment amount ΔTd by subtracting the target discharge temperature Tdn from the discharge temperature Td. The target discharge temperature Tdn is a value set in advance and related to the specifications of the compressor 10. The target discharge temperature Tdn is stored in the storage unit (not illustrated). At step S112, the controller 97 calculates an operation amount O1*con* by multiplying the discharge temperature adjustment amount ΔTd by the control constant G1. The control constant G1 is a positive value related to the amount of control of the first flow control device 72. The control constant G1 is set in advance and stored in the storage unit (not illustrated). Thus, when the discharge temperature adjustment amount ΔTd is positive, in other words, when the discharge temperature is higher than the discharge temperature target value, the operation amount O1*con* of the first flow control device 72 is calculated such that the opening degree is increased. When the discharge temperature adjustment amount ΔTd is negative, in other words, when the discharge temperature is lower than the discharge temperature target value, the operation amount O1*con* of the first flow control device 72 is calculated such that the opening degree is decreased. At step S114, the controller 97 calculates an output opening degree O1*n* by adding the operation amount O1*con* to the first flow control device current opening degree O1*d*.

At step S116, the controller 97 calculates the refrigerating machine oil superheat degree Osh by subtracting the condensing temperature ET from the refrigerating machine oil temperature Toil. At step S118, the controller 97 compares the refrigerating machine oil superheat degree Osh with the refrigerating machine oil superheat degree threshold OILsh. The refrigerating machine oil superheat degree threshold OILsh is a value set in advance and stored in the storage unit (not illustrated). The refrigerating machine oil superheat degree threshold OILsh is, for example, 30 K.

At step S118, when the refrigerating machine oil superheat degree Osh is equal to or smaller than the refrigerating machine oil superheat degree threshold OILsh, the controller 97 proceeds to step S120 and calculates the refrigerating machine oil superheat degree difference ΔOsh by subtracting the refrigerating machine oil superheat degree target value SHoil from the refrigerating machine oil superheat degree Osh. The refrigerating machine oil superheat degree target value SHoil is a value set in advance and stored in the storage unit (not illustrated). The refrigerating machine oil superheat degree target value SHoil is, for example, 10 K.

At step S122, the controller 97 calculates the refrigerating machine oil correction amount ΔOoil by multiplying the refrigerating machine oil superheat degree difference ΔOsh by the control constant G2. The control constant G2 is set so that the correction amount of the first flow control device 72 is always calculated such that the opening degree is decreased when the refrigerating machine oil superheat degree difference ΔOsh of the refrigerating machine oil superheat degree Osh is positive and the correction amount of the first flow control device 72 increases as the refrigerating machine oil superheat degree difference ΔOsh decreases, in other words, as the refrigerating machine oil superheat degree Osh approaches the target value of the refrigerating machine oil superheat degree Osh. The control constant G2 is also set so that the correction amount of the first flow control device 72 is a fixed value when the refrigerating machine oil superheat degree difference ΔOsh of the refrigerating machine oil superheat degree Osh is negative, in other words, when the refrigerating machine oil superheat degree Osh is smaller than the target value of the refrigerating machine oil superheat degree Osh.

At step S124, the controller 97 calculates a correction opening degree O1*op* by adding the refrigerating machine oil correction amount ΔOoil to an output opening degree O1*nex*, and then proceeds to step S128.

At step S118, when the refrigerating machine oil superheat degree Osh is smaller than the refrigerating machine oil superheat degree threshold OILsh, the controller 97 proceeds to step S126 and calculates the correction opening degree O1*op* by defining the output opening degree Onex as the correction opening degree O1*op*, and then proceeds to step S128.

At step S128, the controller 97 sets the opening degree of the first flow control device 72 to be the correction opening degree O1*op*.

At step S108, when the temperature difference ΔT is equal to or larger than the temperature difference threshold Tth or the second flow control device 75 is opened, the controller 97 proceeds to step S200.

At step S210 in FIG. 10, the controller 97 calculates the discharge temperature adjustment amount ΔTd by subtracting the target discharge temperature Tdn from the discharge temperature Td. The target discharge temperature Tdn is a value set in advance and related to the specifications of the compressor 10. The target discharge temperature Tdn is stored in the storage unit (not illustrated). At step S212, the controller 97 calculates an operation amount O2*con* by multiplying the discharge temperature adjustment amount ΔTd by a control constant G3. The control constant G3 is a positive value related to the amount of control of the second flow control device 75. The control constant G3 is set in advance and stored in the storage unit (not illustrated). Thus, when the discharge temperature adjustment amount ΔTd is positive, in other words, when the discharge temperature is higher than the discharge temperature target value, the operation amount O2*con* of the second flow control device 75 is calculated such that the opening degree is increased. When the discharge temperature adjustment amount ΔTd is negative, in other words, when the discharge temperature is lower than the discharge temperature target value, the operation amount O2*con* of the second flow control device 75 is calculated such that the opening degree is decreased. At step S214, the controller 97 calculates an output opening degree O2*n* by adding the operation amount O2*con* to the second flow control device current opening degree O2*d*.

At step S216, the controller 97 calculates the refrigerating machine oil superheat degree Osh by subtracting the condensing temperature ET from the refrigerating machine oil temperature Toil. At step S218, the controller 97 compares the refrigerating machine oil superheat degree Osh with the refrigerating machine oil superheat degree threshold OILsh. The refrigerating machine oil superheat degree threshold OILsh is a value set in advance and stored in the storage unit (not illustrated). The refrigerating machine oil superheat degree threshold OILsh is, for example, 30 K.

At step S218, when the refrigerating machine oil superheat degree Osh is equal to or smaller than the refrigerating machine oil superheat degree threshold OILsh, the controller 97 proceeds to step S220 and calculates the refrigerating machine oil superheat degree difference ΔOsh by subtracting the refrigerating machine oil superheat degree target value SHoil from the refrigerating machine oil superheat degree Osh. The refrigerating machine oil superheat degree target value SHoil is a value set in advance and stored in the storage unit (not illustrated). The refrigerating machine oil superheat degree target value SHoil is, for example, 10 K.

At step S222, the controller 97 calculates the refrigerating machine oil correction amount ΔOoil by multiplying the refrigerating machine oil superheat degree difference ΔOsh by a control constant G4. The control constant G4 is set so that the correction amount of the second flow control device 75 is always calculated such that the opening degree is decreased when the refrigerating machine oil superheat degree difference ΔOsh of the refrigerating machine oil superheat degree Osh is positive and the correction amount of the second flow control device 75 increases as the refrigerating machine oil superheat degree difference ΔOsh decreases, in other words, as the refrigerating machine oil superheat degree Osh approaches the target value of the refrigerating machine oil superheat degree Osh. The control constant G4 is also set so that the correction amount of the second flow control device 75 is a fixed value when the refrigerating machine oil superheat degree difference ΔOsh of the refrigerating machine oil superheat degree Osh is negative, in other words, when the refrigerating machine oil superheat degree Osh is smaller than the target value of the refrigerating machine oil superheat degree Osh.

At step S224, the controller 97 calculates a correction opening degree O2*op* by adding a refrigerating machine oil correction amount ΔOoil2 to an output opening degree O2*nex*, and then proceeds to step S228.

At step S218, when the refrigerating machine oil superheat degree Osh is smaller than the refrigerating machine oil superheat degree threshold OILsh, the controller 97 proceeds to step S226 and calculates the correction opening degree O2*op* by defining the output opening degree O2*nex* as the correction opening degree O2*op*, and then proceeds to step S228.

At step S228, the controller 97 sets the opening degree of the second flow control device 75 to be the correction opening degree O2*op*.

[Effects of Operations of First Flow Control Device and Second Flow Control Device]

In this manner, upper limits can be set to the flow rates of refrigerating machine oil and gas refrigerant bypassed from the oil separator 11 by performing such opening degree control necessity determination on the basis of the outlet temperature of the auxiliary heat exchanger 71. This configuration prevents refrigerating machine oil and gas refrigerant from being excessively bypassed, thereby reducing capacity degradation and performance degradation.

Embodiment 4

Figure 11:
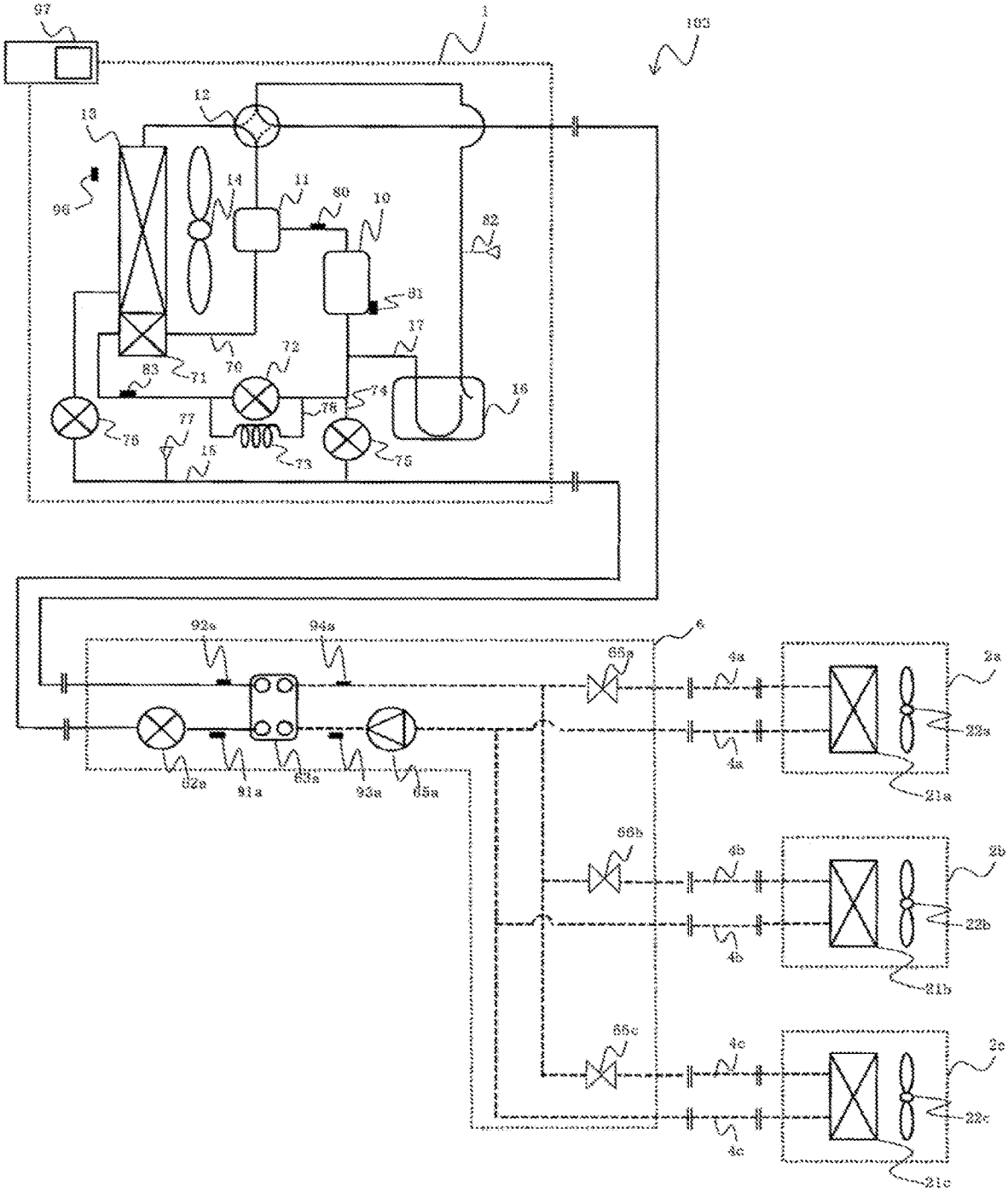
FIG. 11 is a diagram schematically illustrating an exemplary circuit configuration of an air-conditioning apparatus according to Embodiment 4 of the present invention.

FIG. 11 is a diagram schematically illustrating an exemplary circuit configuration of an air-conditioning apparatus according to Embodiment 4 of the present invention. In this air-conditioning apparatus 103 illustrated in FIG. 11, any component having a configuration identical to that of the air-conditioning apparatus 102 illustrated in FIG. 8 is denoted by an identical reference sign, and description of the component will be omitted. Unlike the air-conditioning apparatus 102 illustrated in FIG. 8, the air-conditioning apparatus 103 illustrated in FIG. 11 includes a relay device 6.

In the air-conditioning apparatus 103, a primary side cycle through which first refrigerant (hereinafter referred to as refrigerant) circulates is formed between the outdoor unit 1 and the relay device 6, a secondary side cycle through which heat medium (hereinafter referred to as brine) circulates is formed between the relay device 6 and indoor units 2*a* to 2*c*, and heat exchange between the primary side cycle and the secondary side cycle is performed at a first middle heat exchanger 63*a* installed on the relay device 6. The brine may be, for example, water, antifreeze liquid, or water with added anticorrosion material.

[Indoor Unit]

The plurality of indoor units 2*a* to 2*c* have, for example, identical configurations and include load side heat exchangers 21*a* to 21*c*, respectively. The load side heat exchangers 21*a* to 21*c* are connected to the relay device 6 through branch pipes 4*a* to 4*c* and configured to generate heating air or cooling air to be supplied to an indoor space through heat exchange between air supplied from air-sending devices of fans 22*a* to 22*c* and brine.

[Relay Device]

The relay device 6 includes a first flow controller 62*a*, the first middle heat exchanger 63*a*, a first pump 65*a*, and a plurality of first flow switching devices 66*a* to 66*c*.

The first flow controller 62*a* is, for example, an electronic expansion valve having a variably controllable opening degree, and acts as a pressure reducing valve or an expansion valve configured to depressurize and expand refrigerant. The first flow controller 62*a* is provided upstream of the first middle heat exchanger 63*a* in the primary side cycle in a direction of refrigerant flow in the cooling operation mode.

The first middle heat exchanger 63*a* is, for example, a double-pipe heat exchanger or a plate heat exchanger, and configured to exchange heat between refrigerant in the primary side cycle and refrigerant in the secondary side cycle. The first middle heat exchanger 63*a* acts as an evaporator when an indoor unit in operation performs cooling, and the first middle heat exchanger 63*a* acts as a condenser when the indoor unit in operation performs heating.

The first pump 65*a* is, for example, an inverter centrifugal pump and configured to suck brine and increase the pressure of the brine. The first pump 65*a* is provided upstream of the first middle heat exchanger 63*a* of the secondary side cycle.

The plurality of first flow switching devices 66*a* to 66*c* are provided for the plurality of respective indoor units 2*a* to 2*c* in a number (in the example illustrated in FIG. 11, three) equal to the installation number of indoor units. The plurality of first flow switching devices 66*a* to 66*c* are, for example, on-off valves and configured to open and close passages from the first middle heat exchanger 63*a* on inflow sides of the indoor units 2*a* to 2*c*, respectively. The first flow switching devices 66*a* to 66*c* are provided downstream of the first middle heat exchanger 63*a* of the secondary side cycle.

In the relay device 6, an inlet temperature sensor 91*a* is provided at an inlet of the first middle heat exchanger 63*a* to the primary side cycle, and an outlet temperature sensor 92*a* is provided at an outlet of the first middle heat exchanger 63*a* from the primary side cycle. The inlet temperature sensor 91*a* and the outlet temperature sensor 92*a* are each preferably, for example, a thermistor.

In the relay device 6, an indoor unit outlet temperature sensor 93*a* is provided at an inlet of the first middle heat exchanger 63*a* to the secondary side cycle, and an indoor unit inlet temperature sensor 94*a* is provided at an outlet of the first middle heat exchanger 63*a* from the secondary side cycle. The indoor unit outlet temperature sensor 93*a* and the indoor unit inlet temperature sensor 94*a* are each preferably, for example, a thermistor.

As described above, similarly to the air-conditioning apparatus 100 illustrated in FIGS. 1 to 4, in the air-conditioning apparatus 103 illustrated in FIG. 11, the refrigerating machine oil and part of the gas refrigerant separated at the oil separator 11 are cooled and injected to the suction unit of the compressor 10 through the first flow control device 72.

Embodiment 5

Figure 12:
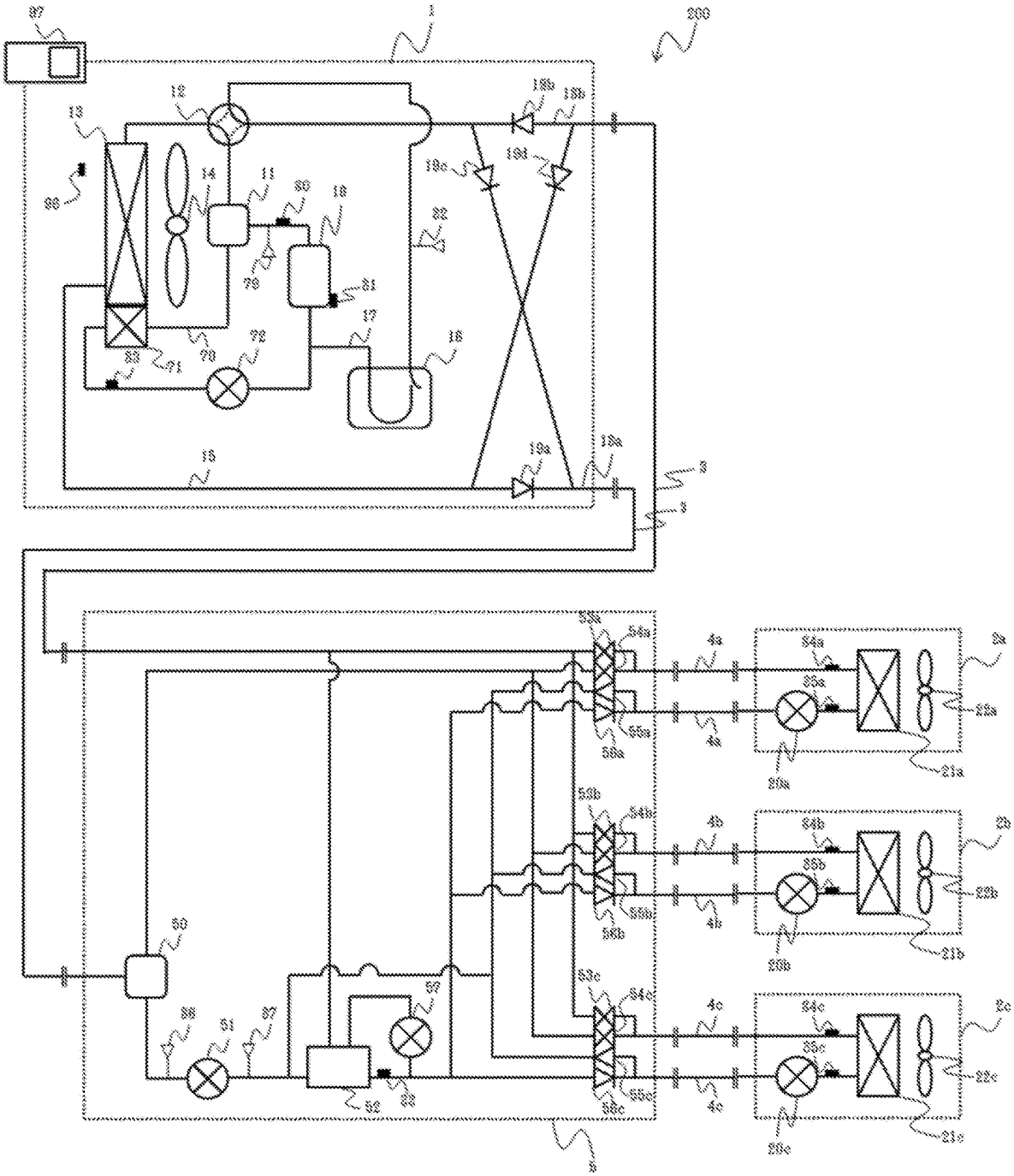
FIG. 12 is a diagram schematically illustrating an exemplary circuit configuration of an air-conditioning apparatus according to Embodiment 5 of the present invention.

FIG. 12 is a diagram schematically illustrating an exemplary circuit configuration of an air-conditioning apparatus according to Embodiment 5 of the present invention. The following describes this air-conditioning apparatus 200 with reference to FIG. 12. In FIG. 12, any component having a configuration identical to that of the air-conditioning apparatus 100 illustrated in FIG. 1 is denoted by an identical reference sign, and description of the component will be omitted.

The air-conditioning apparatus 200 illustrated in FIG. 12 includes the single outdoor unit 1 as a heat source apparatus, the plurality of indoor units 2*a* to 2*c*, and a relay device 5 disposed between the outdoor unit 1 and the indoor units 2*a* to 2*c*. The outdoor unit 1 and the relay device 5 are connected to each other through the main pipes 3 through which refrigerant circulates, and the relay device 5 and the plurality of indoor units 2*a* to 2*c* are connected to each other through the branch pipes 4*a* to 4*c* through which refrigerant circulates. Cooling energy or heating energy generated by the outdoor unit 1 is circulated to the indoor units 2*a* to 2*c* through the relay device 5.

The two main pipes 3 are used to connect the outdoor unit 1 and the relay device 5, and the two branch pipes 4*a*, 4*b*, or 4*c* are used to connect the relay device 5 and the corresponding indoor unit 2. Installation is easier when two pipes are used to connect the outdoor unit 1 with the relay device 5 and connect the indoor units 2*a* to 2*c* with the relay device 5 in this manner.

[Outdoor Unit]

Similarly to the outdoor unit 1 according to Embodiment 1, the outdoor unit 1 includes the compressor 10, the oil separator 11, the refrigerant flow switching device 12, the heat source side heat exchanger 13, the accumulator 16, the first bypass passage 70, the auxiliary heat exchanger 71, and the first flow control device 72, which are connected to each other. The outdoor unit 1 also includes the fan 14 as an air-sending device.

In addition, the outdoor unit 1 includes a first connection pipe 18*a*, a second connection pipe 18*b*, and first backflow prevention devices 19*a* to 19*d* that are each, for example, a check valve. The first backflow prevention device 19*a* is configured to prevent backflow of high-temperature and high-pressure gas refrigerant from the first connection pipe 18*a* to the heat source side heat exchanger 13 in the heating only operation mode and a heating main operation mode. The first backflow prevention device 19*b* is configured to prevent backflow of high-temperature and high-pressure gas refrigerant from a passage on the discharge side of the compressor 10 to the second connection pipe 18*b* in the heating only operation mode and the heating main operation mode. The first backflow prevention device 19*c* is configured to prevent backflow of high-pressure liquid refrigerant or two-phase gas-liquid refrigerant from the first connection pipe 18*a* to the accumulator 16 in the cooling only operation mode and a cooling main operation mode. The first backflow prevention device 19*d* is configured to prevent backflow of high-pressure liquid refrigerant or two-phase gas-liquid refrigerant from the first connection pipe 18*a* to the accumulator 16 in the cooling only operation mode and the cooling main operation mode.

In this manner, when the first connection pipe 18*a*, the second connection pipe 18*b*, and the first backflow prevention devices 19*a* to 19*d* are provided, the direction of refrigerant flowing into the relay device 5 can be maintained constant irrespective of an operation requested by the indoor units 2. Although the above description is made on the example in which the first backflow prevention devices 19*a* to 19*d* are check valves, any configuration capable of preventing refrigerant backflow is applicable, and each device may be an opening and closing device or an expansion device having a fully closing function.

[Indoor Unit]

The plurality of indoor units 2*a* to 2*c* have, for example, identical configurations and include the load side heat exchangers 21*a* to 21*c* and load side expansion devices 20*a* to 20*c*, respectively. The load side heat exchangers 21*a* to 21*c* are connected to the outdoor unit 1 through the branch pipes 4*a* to 4*c*, the relay device 5, and the main pipes 3, and configured to exchange heat between refrigerant and air supplied from the fans 22*a* to 22*c* and generate heating air or cooling air to be supplied to an indoor space. The load side expansion devices 20*a* to 20*c* are each, for example, an electronic expansion valve having a variably controllable opening degree, and each act as a pressure reducing valve or an expansion valve configured to depressurize and expand refrigerant. The load side expansion devices 20*a* to 20*c* are provided upstream of the load side heat exchangers 21*a* to 21*c* in a direction of refrigerant flow in the cooling only operation mode.

The indoor units 2 are each provided with a corresponding one of inlet side temperature sensors 85*a* to 85*c* each configured to measure the temperature of refrigerant flowing into a corresponding one of the load side heat exchangers 21, and a corresponding one of outlet side temperature sensors 84*a* to 84*c* each configured to measure the temperature of refrigerant flowing out of a corresponding one of the load side heat exchangers 21. The inlet side temperature sensors 85*a* to 85*c* and the outlet side temperature sensors 84*a* to 84*c* are each, for example, a thermistor, and configured to transfer measured inlet side temperatures and outlet side temperatures of the load side heat exchangers 21*a* to 21*c* to the controller 97.

Although FIG. 12 illustrates the example in which the three indoor units 2*a* to 2*c* are connected to the outdoor unit 1 through the relay device 5 and the refrigerant pipes 4, the number of connected indoor units is not limited to three but may be two or larger.

[Relay Device 5]

The relay device 5 includes a gas-liquid separator 50, an inter-refrigerant heat exchanger 52, a third expansion device 51, a fourth expansion device 57, a plurality of first opening and closing devices 53*a* to 53*c*, a plurality of second opening and closing devices 54*a* to 54*c*, a plurality of second backflow prevention devices 55*a* to 55*c* as backflow prevention devices such as check valves, and a plurality of third backflow prevention devices 56*a* to 56*c* as backflow prevention devices such as check valves.

In a cooling and heating mixed operation mode in which a cooling load is larger than a heating load, the gas-liquid separator 50 is configured to separate, into liquid and gas, high-pressure refrigerant in the two-phase gas-liquid state generated at the outdoor unit 1 so that the liquid flows into a lower pipe in FIG. 12 to supply cooling energy to the indoor units 2 and the gas flows into an upper pipe in FIG. 12 to supply heating energy to the indoor units 2. The gas-liquid separator 50 is installed at an inlet of the relay device 5.

The inter-refrigerant heat exchanger 52 is, for example, a double-pipe heat exchanger or a plate heat exchanger and configured to exchange heat between high-pressure or middle-pressure refrigerant and low-pressure refrigerant in the cooling only operation mode, the cooling main operation mode, and the heating main operation mode to obtain a sufficient subcooling degree of liquid refrigerant or two-phase gas-liquid refrigerant to be supplied to the load side expansion devices 20*a* and 20*b* of the indoor units 2 in which cooling loads are generated. A passage of the inter-refrigerant heat exchanger 52 for high-pressure or middle-pressure refrigerant is connected to a point between the third expansion device 51 and the second backflow prevention devices 55*a* to 55*c*. A low-pressure refrigerant passage has one end connected to a point between the second backflow prevention devices 55*a* to 55*c* and an outlet side of the passage of the inter-refrigerant heat exchanger 52 for high-pressure or middle-pressure refrigerant, and the other end communicated with a low-pressure pipe on an outlet side of the relay device 5 through the fourth expansion device 57 and the inter-refrigerant heat exchanger 52.

The third expansion device 51 acts as a pressure reducing valve or an on-off valve and is configured to adjust the pressure of liquid refrigerant to a set pressure through decompression or open and close the passage of the liquid refrigerant. The third expansion device 51 is, for example, an electronic expansion valve having a variably controllable opening degree and provided on a pipe to which liquid refrigerant from the gas-liquid separator 50 flows out.

The fourth expansion device 57 acts as a pressure reducing valve or an on-off valve and is configured to open and close a refrigerant passage in the heating only operation mode and adjust the flow rate of bypass liquid depending on an indoor side load in the heating main operation mode. In the cooling only operation mode, the cooling main operation mode, and the heating main operation mode, the fourth expansion device 57 is configured to allow refrigerant to flow out to the inter-refrigerant heat exchanger 52, thereby adjusting the degree of subcooling of refrigerant to be supplied to the load side expansion devices 20*a* to 20*c* of the indoor units 2 on which cooling loads are generated. The fourth expansion device 57 is, for example, an electronic expansion valve having a variably controllable opening degree and installed on a passage on a low-pressure refrigerant inlet side of the inter-refrigerant heat exchanger 52.

The plurality of first opening and closing devices 53*a* to 53*c* are provided for the plurality of respective indoor units 2*a* to 2*c* in a number (in the example illustrated in FIG. 12, three) equal to the installation number of indoor units. The plurality of second opening and closing devices 54*a* to 54*c* are each, for example, a solenoid valve and configured to open and close the passage of low-pressure and low-temperature gas refrigerant flowing out of the indoor units 2*a* to 2*c*. The first opening and closing devices 53*a* to 53*c* are connected to the low-pressure pipe communicated with the outlet side of the relay device 5. The first opening and closing devices 53*a* to 53*c* may be each any device capable of opening and closing a passage, such as an expansion device having a fully closing function.

The plurality of second opening and closing devices 54*a* to 54*c* are provided for the plurality of respective indoor units 2*a* to 2*c* in a number (in the example illustrated in FIG. 12, three) equal to the installation number of indoor units. The plurality of second opening and closing devices 54*a* to 54*c* are each, for example, a solenoid valve and configured to open and close the passages of high-temperature and high-pressure gas refrigerant to be supplied to the indoor units 2*a* to 2*c*. The second opening and closing devices 54*a* to 54*c* are each connected to a gas side pipe of the gas-liquid separator 50. The second opening and closing devices 54*a* to 54*c* may be each any device capable of opening and closing a passage, such as an expansion device having a fully closing function.

The plurality of second backflow prevention devices 55*a* to 55*c* are provided for the plurality of respective indoor units 2*a* to 2*c* in a number (in the example illustrated in FIG. 12, three) equal to the installation number of indoor units. The plurality of second backflow prevention devices 55*a* to 55*c* are configured to allow middle-temperature and middle-pressure liquid refrigerant or two-phase gas-liquid refrigerant to flow out from the indoor units 2*a* to 2*c* that each perform the heating operation, and are each connected to a pipe on an outlet side of the third expansion device 51. With this configuration, in the cooling main operation mode and the heating main operation mode, middle-temperature and middle-pressure liquid refrigerant or two-phase gas-liquid refrigerant that has flowed out of the load side expansion devices 20*a* and 20*b* of the indoor units 2 that each perform the heating operation and that is not sufficiently subcooled can be prevented from flowing into the load side expansion devices 20*a* and 20*b* of the indoor units 2 that each perform the cooling operation. Although the second backflow prevention devices 55*a* to 55*c* are illustrated as check valves, any device capable of preventing refrigerant backflow, such as an opening and closing device and an expansion device having a fully closing function, is applicable.

The plurality of third backflow prevention devices 56*a* to 56*c* are provided for the plurality of respective indoor units 2*a* to 2*c* in a number (in the example illustrated in FIG. 12, three) equal to the installation number of indoor units. The plurality of third backflow prevention devices 56*a* to 56*c* are configured to allow high-pressure liquid refrigerant to flow into the indoor units 2 that each perform the cooling operation and are each connected to an outlet pipe of the third expansion device 51. In the cooling main operation mode and the heating main operation mode, the third backflow prevention devices 56*a* to 56*c* prevent middle-temperature and middle-pressure liquid refrigerant or two-phase gas-liquid refrigerant that has flowed out of the third expansion device 51 and that is not sufficiently subcooled, from flowing into the load side expansion devices 20 of the indoor units 2 that each perform the cooling operation. Although the third backflow prevention devices 56*a* to 56*c* are illustrated as check valves, any device capable of preventing refrigerant backflow, such as an opening and closing device and an expansion device having a fully closing function, is applicable.

In the relay device 5, an inlet side pressure sensor 86 is provided on an inlet side of the third expansion device 51, and an outlet side pressure sensor 87 is provided on the outlet side of the third expansion device 51. The inlet side pressure sensor 86 is configured to measure the pressure of high-pressure refrigerant, and the outlet side pressure sensor 87 is configured to measure the middle pressure of liquid refrigerant at the outlet of the third expansion device 51 in the cooling main operation mode.

In addition, the relay device 5 is provided with a temperature sensor 88 configured to measure the temperature of high-pressure or middle-pressure refrigerant flowing out of the inter-refrigerant heat exchanger 52. The temperature sensor 88 is provided to a pipe on the outlet side of the passage of the inter-refrigerant heat exchanger 52 for high-pressure or middle-pressure refrigerant, and is preferably, for example, a thermistor.

The controller 97 is configured to execute each operation mode to be described later by controlling, for example, the driving frequency of the compressor 10, the rotation frequency of the fan 14 (activation and deactivation of the fan 14 is also included), switching of the refrigerant flow switching device 12, the opening degree of the first flow control device 72, the opening degrees of the load side expansion devices 20*a* to 20*c*, and opening and closing of the first opening and closing devices 53*a* to 53*c*, the second opening and closing devices 54*a* to 54*c*, the third expansion device 51, and the fourth expansion device 57 on the basis of measurement information of various sensors and an instruction from the remote controller. The controller 97 may be provided to at least one of the indoor units 2*a* to 2*c* or may be provided to the relay device 5.

The following describes each operation mode executed by the air-conditioning apparatus 200. The air-conditioning apparatus 200 can execute the cooling operation or the heating operation at any indoor unit having received an instruction among the indoor units 2*a* to 2*c*. In other words, the air-conditioning apparatus 200 can execute identical operations at all of the indoor units 2*a* to 2*c* or different operations at the indoor units 2*a* to 2*c*.

The operation modes executed by the air-conditioning apparatus 200 include the cooling only operation mode, the cooling main operation mode, the heating only operation mode, and the heating main operation mode. The cooling only operation mode is an operation mode in which the indoor units 2*a* to 2*c* all execute the cooling operation, the cooling main operation mode is an operation mode in which the indoor units 2*a* to 2*c* execute a cooling and heating mixed operation and a cooling load is larger than a heating load, the heating only operation mode is an operation mode in which the indoor units 2*a* to 2*c* all execute the heating operation, and the heating main operation mode is an operation mode in which the indoor units 2*a* to 2*c* execute the cooling and heating mixed operation and a heating load is larger than a cooling load. Each operation mode will be described below.

[Cooling Only Operation Mode]

Figure 13:
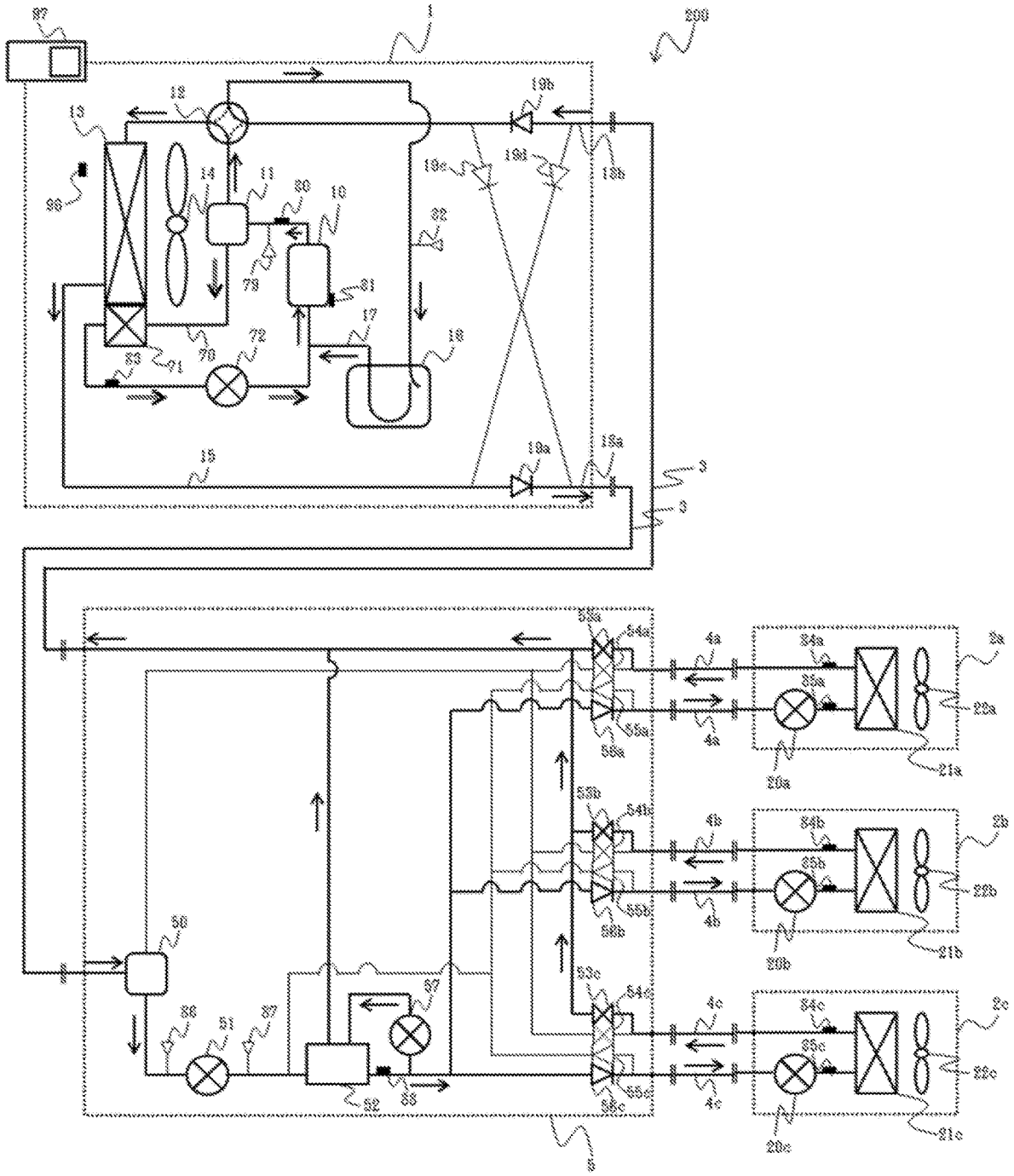
FIG. 13 is a diagram for description of exemplary refrigerant flow in the air-conditioning apparatus illustrated in FIG. 12 in a cooling only operation mode.

FIG. 13 is a diagram for description of exemplary refrigerant flow in the air-conditioning apparatus illustrated in FIG. 12 in the cooling only operation mode. In FIG. 13, a passage through which refrigerant circulates is illustrated with a bold line, the flow direction of refrigerant is illustrated with a solid-line arrow, and the flow direction of refrigerating machine oil and refrigerant is illustrated with a double-line arrow. With reference to FIG. 13, the following describes the cooling only operation mode in an example in which cooling loads are generated at all of the load side heat exchangers 21*a* to 21*c*. In the cooling only operation mode illustrated in FIG. 13, the controller 97 switches the refrigerant flow switching device 12 so that refrigerant discharged from the compressor 10 flows into the heat source side heat exchanger 13.

First, low-temperature and low-pressure refrigerant is compressed by the compressor 10 and discharged as high-temperature and high-pressure gas refrigerant. The high-temperature and high-pressure gas refrigerant discharged from the compressor 10 flows into the heat source side heat exchanger 13 through the oil separator 11 and the refrigerant flow switching device 12. Then, the refrigerant becomes high-pressure liquid refrigerant by transferring heat to outdoor air at the heat source side heat exchanger 13. The refrigerant flows out of the heat source side heat exchanger 13, and the high-pressure liquid refrigerant flows out of the outdoor unit 1 through the first backflow prevention device 19*a* and flows into the relay device 5 through the main pipe 3.

The high-pressure liquid refrigerant flowing into the relay device 5 passes through the gas-liquid separator 50 and the third expansion device 51 and is sufficiently subcooled at the inter-refrigerant heat exchanger 52. Subsequently, most of the subcooled high-pressure refrigerant passes through the second backflow prevention devices 55*a* to 55*c* and the branch pipes 4*a* to 4*c* and is expanded to low-temperature and low-pressure refrigerant in the two-phase gas-liquid state at the load side expansion devices 20*a* and 20*b*. The remaining high-pressure refrigerant is expanded to low-temperature and low-pressure refrigerant in the two-phase gas-liquid state at the fourth expansion device 57. Then, the low-temperature and low-pressure refrigerant in the two-phase gas-liquid state becomes low-temperature and low-pressure gas refrigerant through heat exchange with high-pressure liquid refrigerant at the inter-refrigerant heat exchanger 52 and flows into the low-pressure pipe of the outlet side of the relay device 5. In this case, the opening degree of the fourth expansion device 57 is controlled so that a subcool (subcooling degree) obtained by using the difference between a value obtained converting a pressure measured by the outlet side pressure sensor 87 into a saturated temperature and a temperature measured by the temperature sensor 88 is constant.

Most of the low-temperature and low-pressure refrigerant in the two-phase gas-liquid state flowing out of the load side expansion devices 20*a* to 20*c* flows into the load side heat exchangers 21*a* to 21*c* acting as evaporators, respectively, and becomes low-temperature and low-pressure gas refrigerant while cooling indoor air by receiving heat from the indoor air. In this case, the opening degrees of the load side expansion devices 20*a* and 20*b* are controlled so that a superheat (superheat degree) obtained by using the difference between a temperature measured by the inlet side temperature sensor 85 and a temperature measured by the outlet side temperature sensor 84 is constant.

The gas refrigerant flowing out of the load side heat exchangers 21*a* to 21*c* passes through the branch pipes 4*a* to 4*c* and the first opening and closing devices 53, joins to gas refrigerant flowing out of the inter-refrigerant heat exchanger 52, flows out of the relay device 5, and flows into the outdoor unit 1 again through the main pipe 3. The refrigerant flowing into the outdoor unit 1 passes through the first backflow prevention device 19*b* and is sucked into the compressor 10 again through the refrigerant flow switching device 12 and the accumulator 16.

When any load side heat exchanger has no thermal load, refrigerant does not need to flow to the load side heat exchanger having no thermal load, and thus a load side expansion device connected to the load side heat exchanger having no thermal load is closed. Then, when a thermal load is generated on the load side heat exchanger, the load side expansion device connected to the load side heat exchanger on which a thermal load is generated can be opened to circulate refrigerant. In this case, for example, similarly to the load side expansion devices 20*a* to 20*c* described above, the opening degree of the load side expansion device is controlled so that a superheat (superheat degree) obtained by using the difference between temperatures measured by the inlet side temperature sensor 85 and the outlet side temperature sensor 84 is constant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Cooling Main Operation Mode]

Figure 14:
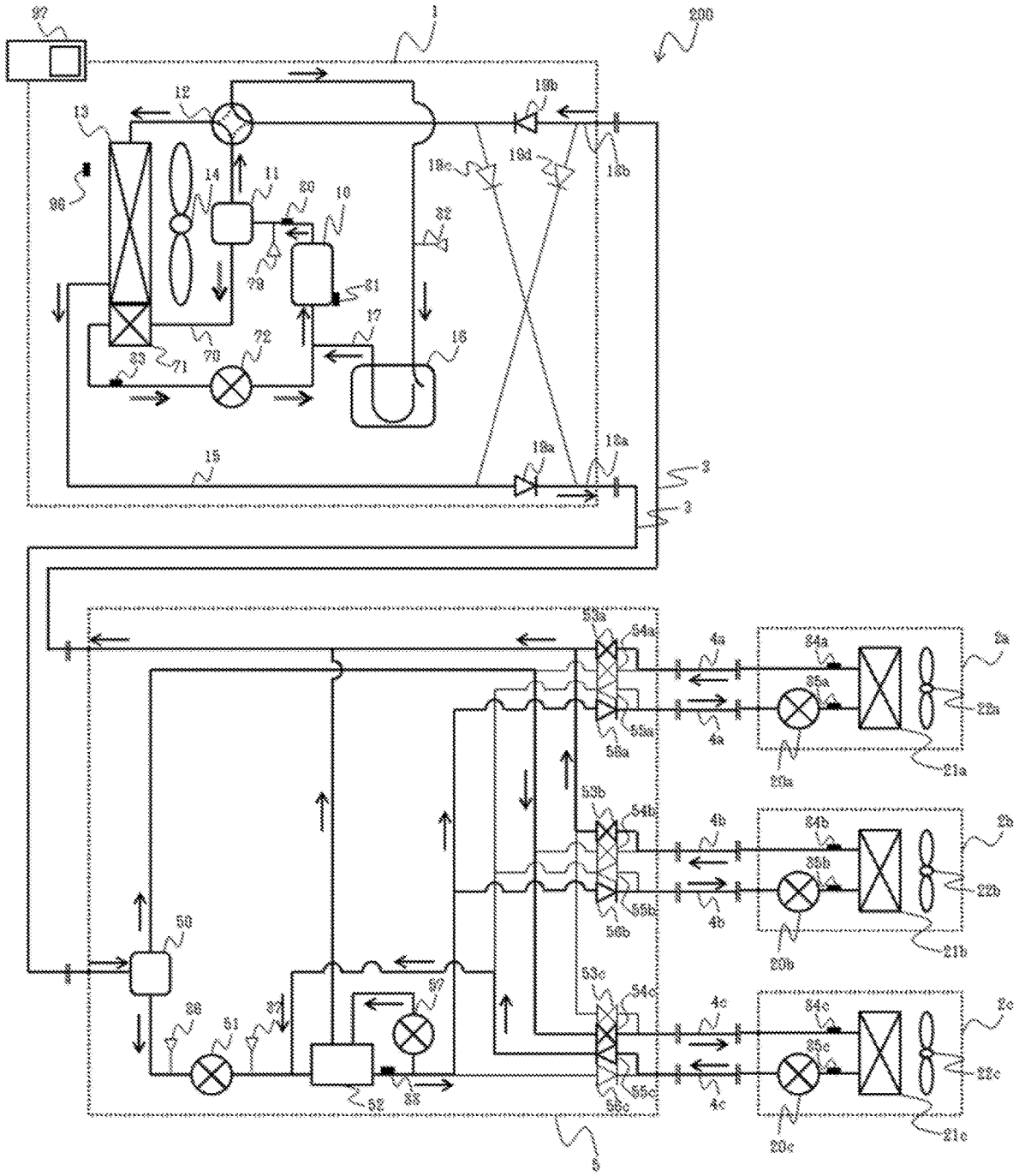
FIG. 14 is a diagram for description of exemplary refrigerant flow in the air-conditioning apparatus illustrated in FIG. 12 in a cooling main operation mode.

FIG. 14 is a diagram for description of exemplary refrigerant flow in the air-conditioning apparatus illustrated in FIG. 12 in the cooling main operation mode. With reference to FIG. 14, the following describes the cooling main operation mode in an example in which cooling loads are generated on the load side heat exchangers 21*a* and 21*b* and heating loads are generated on the load side heat exchanger 21*c*. In FIG. 14, a passage through which refrigerant circulates is illustrated with a bold line, the flow direction of refrigerant is illustrated with a solid-line arrow, and the flow direction of refrigerating machine oil and refrigerant is illustrated with a double-line arrow. In the cooling main operation mode illustrated in FIG. 14, the controller 97 switches the refrigerant flow switching device 12 so that heat source side refrigerant discharged from the compressor 10 flows into the heat source side heat exchanger 13.

First, low-temperature and low-pressure refrigerant is compressed by the compressor 10 and discharged as high-temperature and high-pressure gas refrigerant. The high-temperature and high-pressure gas refrigerant discharged from the compressor 10 flows into the heat source side heat exchanger 13 through the oil separator 11 and the refrigerant flow switching device 12. Then, the refrigerant becomes refrigerant in the two-phase gas-liquid state while transferring heat to outdoor air at the heat source side heat exchanger 13. The refrigerant flowing out of the heat source side heat exchanger 13 flows into the relay device 5 through the first backflow prevention device 19*a* and the main pipe 3.

The refrigerant in the two-phase gas-liquid state flowing into the relay device 5 is separated into high-pressure gas refrigerant and high-pressure liquid refrigerant by the gas-liquid separator 50. The high-pressure gas refrigerant passes through the second opening and closing device 54*c* and the branch pipe 4*c*, and then flows into the load side heat exchanger 21*c* acting as a condenser and becomes liquid refrigerant while heating indoor space by transferring heat to the indoor air. In this case, the opening degree of the load side expansion device 20*c* is controlled so that a subcool (subcooling degree) obtained by using the difference between a value obtained by converting a pressure measured by the inlet side pressure sensor 86 into a saturated temperature and a temperature measured by the inlet side temperature sensor 85*c* is constant. The liquid refrigerant flowing out of the load side heat exchanger 21*c* is expanded at the load side expansion device 20*c* and passes through the branch pipe 4*c* and the second backflow prevention device 55*c*.

The liquid refrigerant passing through the second backflow prevention device 55*c* is separated by the gas-liquid separator 50 and then joins to middle-pressure liquid refrigerant expanded to middle pressure by the third expansion device 51. In this case, the opening degree of the third expansion device 51 is controlled so that the pressure difference between a pressure measured by the inlet side pressure sensor 86 and a pressure measured by the outlet side pressure sensor 87 is equal to a predetermined pressure difference (for example, 0.3 MPa).

The liquid refrigerant having joined is sufficiently subcooled at the inter-refrigerant heat exchanger 52. Subsequently, most of the refrigerant passes through the third backflow prevention devices 56*a* and 56*b* and the branch pipes 4*a* and 4*b*, and then is expanded to low-temperature and low-pressure refrigerant in the two-phase gas-liquid state at the load side expansion devices 20*a* and 20*b*. The remaining liquid refrigerant is expanded to low-temperature and low-pressure refrigerant in the two-phase gas-liquid state at the fourth expansion device 57. In this case, the opening degree of the fourth expansion device 57 is controlled so that a subcool (subcooling degree) obtained by using the difference between a value obtained converting a pressure measured by the outlet side pressure sensor 87 into a saturated temperature and a temperature measured by the temperature sensor 88 is constant. Subsequently, the low-temperature and low-pressure refrigerant in the two-phase gas-liquid state becomes low-temperature and low-pressure gas refrigerant through heat exchange with middle-pressure liquid refrigerant at the inter-refrigerant heat exchanger 52, and flows into the low-pressure pipe of the outlet side of the relay device 5.

The high-pressure liquid refrigerant separated by the gas-liquid separator 50 flows into the indoor units 2*a* and 2*b* through the inter-refrigerant heat exchanger 52 and the second backflow prevention devices 55*a* and 55*b*. Most of refrigerant in the two-phase gas-liquid state expanded at the load side expansion devices 20*a* and 20*b* of the indoor units 2*a* and 2*b* flows into the load side heat exchangers 21*a* and 21*b* acting as evaporators and becomes low-temperature and low-pressure gas refrigerant while cooling indoor air by receiving heat from the indoor air. In this case, the opening degrees of the load side expansion devices 20*a* and 20*b* are controlled so that a superheat (superheat degree) obtained by using the difference between a temperature measured by the inlet side temperature sensor 85*a* or 85*b* and a temperature measured by the outlet side temperature sensor 86*a* or 86*b*, respectively, is constant. The gas refrigerant flowing out of the load side heat exchangers 21*a* and 21*b* passes through the branch pipes 4*a* and 4*b* and the first opening and closing devices 53*a* and 53*b*, joins to the remaining gas refrigerant flowing out of the inter-refrigerant heat exchanger 52, flows out of the relay device 5, and flows into the outdoor unit 1 again through the main pipe 3. The refrigerant flowing into the outdoor unit 1 passes through the first backflow prevention device 19*d* and is sucked into the compressor 10 again through the refrigerant flow switching device 12 and the accumulator 16.

When any load side heat exchanger has no thermal load, refrigerant does not need to flow to the load side heat exchanger having no thermal load, and thus a load side expansion device connected to the load side heat exchanger having no thermal load is closed. Then, when a thermal load is generated on the load side heat exchanger, the load side expansion device connected to the load side heat exchanger on which a thermal load is generated can be opened to circulate refrigerant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Heating Only Operation Mode]

Figure 15:
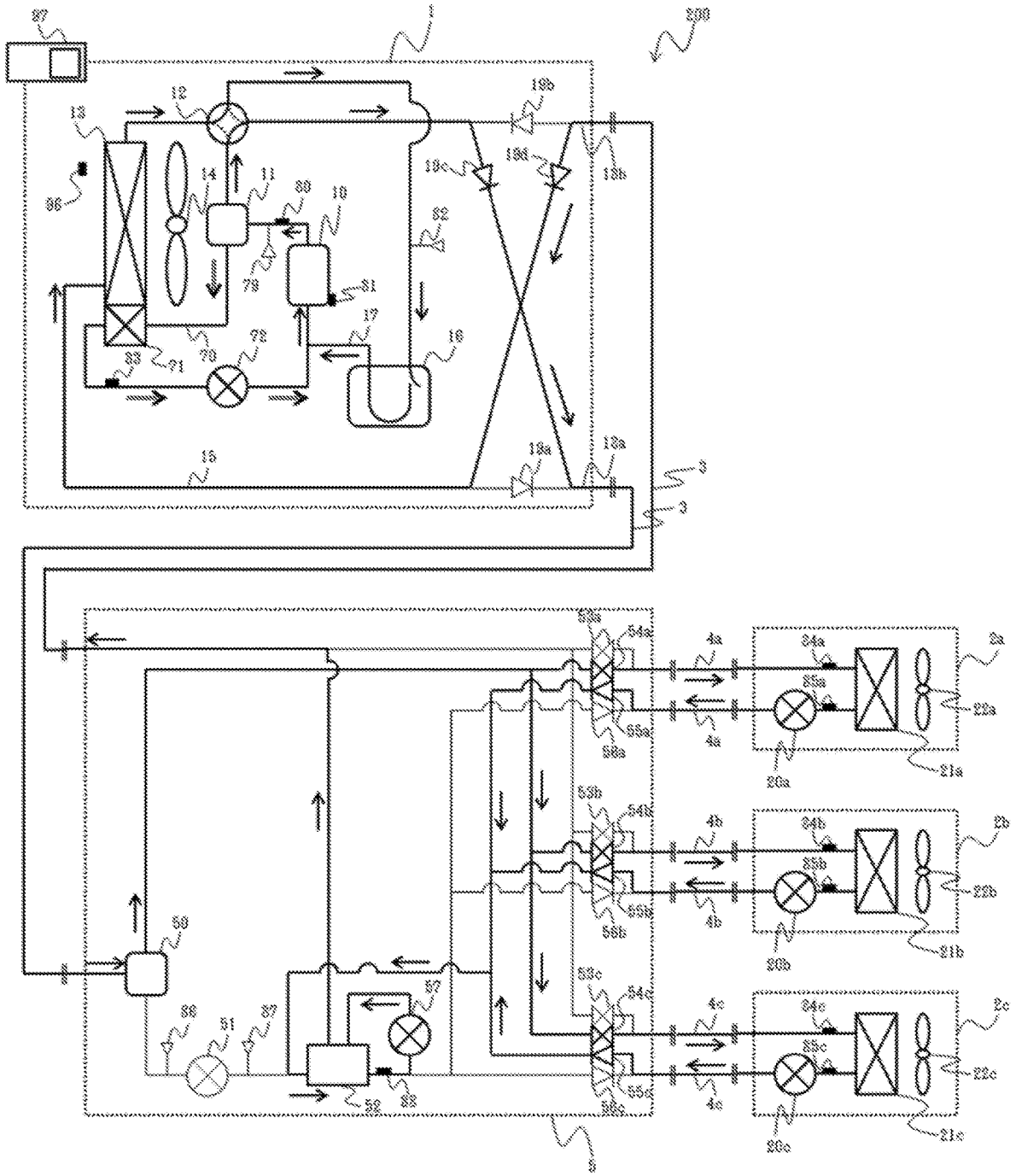
FIG. 15 is a diagram for description of exemplary refrigerant flow in the air-conditioning apparatus illustrated in FIG. 12 in a heating only operation mode.

FIG. 15 is a diagram for description of exemplary refrigerant flow in the air-conditioning apparatus illustrated in FIG. 12 in the heating only operation mode. In FIG. 15, a passage through which refrigerant circulates is illustrated with a bold line, the flow direction of refrigerant is illustrated with a solid-line arrow, and the flow direction of refrigerating machine oil and refrigerant is illustrated with a double-line arrow. With reference to FIG. 15, the following describes the heating only operation mode in an example in which heating loads are generated on all of the load side heat exchangers 21*a* to 21*c*. In the heating only operation mode illustrated in FIG. 15, the controller 97 switches the refrigerant flow switching device 12 so that heat source side refrigerant discharged from the compressor 10 flows into the relay device 5 without passing through the heat source side heat exchanger 13.

First, low-temperature and low-pressure refrigerant is compressed by the compressor 10 and discharged as high-temperature and high-pressure gas refrigerant. The high-temperature and high-pressure gas refrigerant discharged from the compressor 10 passes through the oil separator 11, the refrigerant flow switching device 12, and the first backflow prevention device 19*c*, and flows out of the outdoor unit 1. The high-temperature and high-pressure gas refrigerant flowing out of the outdoor unit 1 flows into the relay device 5 through the main pipe 3.

The high-temperature and high-pressure gas refrigerant flowing into the relay device 5 passes through the gas-liquid separator 50, the second opening and closing devices 54*a* to 54*c*, and the branch pipes 4*a* to 4*c*, and then flows into the load side heat exchangers 21*a* to 21*c* acting as condensers. The refrigerant flowing into the load side heat exchangers 21*a* to 21*c* becomes liquid refrigerant while heating indoor space by transferring heat to the indoor air. The liquid refrigerant flowing out of the load side heat exchangers 21*a* to 21*c* is expanded at the load side expansion devices 20*a* to 20*c*, respectively, and flows into the outdoor unit 1 again through the branch pipes 4*a* to 4*c*, the second backflow prevention devices 55*a* to 55*c*, the inter-refrigerant heat exchanger 52, the fourth expansion device 57 controlled to be opened, and the main pipe 3. In this case, the opening degrees of the load side expansion devices 20*a* to 20*c* are controlled so that a subcool (subcooling degree) obtained by using the difference between a value obtained by converting a pressure measured by the inlet side pressure sensor 86 into a saturated temperature and a temperature measured by each of the inlet side temperature sensors 85*a* to 85*c* is constant.

The refrigerant flowing into the outdoor unit 1 passes through the first backflow prevention device 19*d*, becomes low-temperature and low-pressure gas refrigerant while receiving heat from outdoor air at the heat source side heat exchanger 13, and is sucked into the compressor 10 again through the refrigerant flow switching device 12 and the accumulator 16.

When any load side heat exchanger has no thermal load, refrigerant does not need to flow to the load side heat exchanger having no thermal load, and thus a load side expansion device connected to the load side heat exchanger having no thermal load is closed. Then, when a thermal load is generated on the load side heat exchanger, the load side expansion device connected to the load side heat exchanger on which a thermal load is generated can be opened to circulate refrigerant. In this case, the opening degree of the load side expansion device is controlled so that, for example, a subcool (subcooling degree) obtained by using the difference between a value obtained by converting a pressure measured by the inlet side pressure sensor 86 into a saturated temperature and a temperature measured by the corresponding inlet side temperature sensor 85 is constant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Heating Main Operation Mode]

Figure 16:
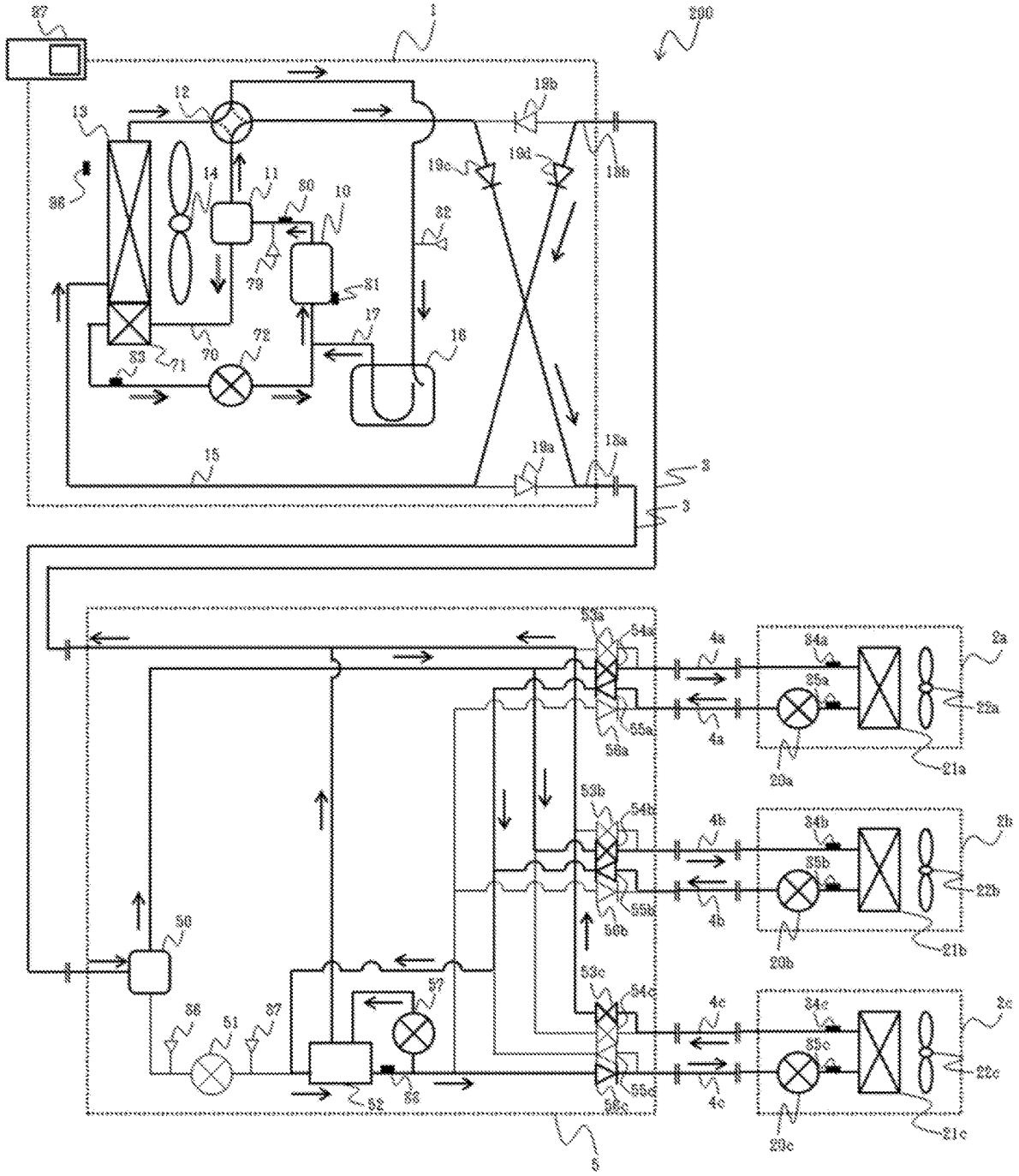
FIG. 16 is a diagram for description of exemplary refrigerant flow in the air-conditioning apparatus illustrated in FIG. 12 in a heating main operation mode.

FIG. 16 is a diagram for description of exemplary refrigerant flow in the air-conditioning apparatus illustrated in FIG. 12 in the heating main operation mode. In FIG. 16, a passage through which refrigerant circulates is illustrated with a bold line, the flow direction of refrigerant is illustrated with a solid-line arrow, and the flow direction of refrigerating machine oil and refrigerant is illustrated with a double-line arrow. With reference to FIG. 16, the following describes the heating main operation mode in an example in which heating loads are generated on the load side heat exchangers 21*a* and 21*b* and cooling loads are generated on the load side heat exchanger 21*c*. In the heating main operation mode illustrated in FIG. 16, the controller 97 switches the refrigerant flow switching device 12 so that heat source side refrigerant discharged from the compressor 10 flows into the relay device 5 without passing through the heat source side heat exchanger 13.

First, low-temperature and low-pressure refrigerant is compressed by the compressor 10 and discharged as high-temperature and high-pressure gas refrigerant. The high-temperature and high-pressure gas refrigerant discharged from the compressor 10 passes through the oil separator 11, the refrigerant flow switching device 12, and the first backflow prevention device 19*c* and flows out of the outdoor unit 1. The high-temperature and high-pressure gas refrigerant flowing out of the outdoor unit 1 flows into the relay device 5 through the main pipe 3.

The high-temperature and high-pressure gas refrigerant flowing into the relay device 5 passes through the gas-liquid separator 50, the second opening and closing devices 54*a* and 54*b*, and the branch pipes 4*a* and 4*b*, and then flows into the load side heat exchangers 21*a* and 21*b* acting as condensers. The refrigerant flows into the load side heat exchangers 21*a* and 21*b*, and the refrigerant becomes liquid refrigerant while heating indoor space by transferring heat to the indoor air. The liquid refrigerant flowing out of the load side heat exchangers 21*a* and 21*b* is expanded at the load side expansion devices 20*a* and 20*b*, passes through the branch pipes 4*a* and 4*b* and the second backflow prevention devices 55*a* and 55*b*, and is sufficiently subcooled at the inter-refrigerant heat exchanger 52. Subsequently, most of the liquid refrigerant passes through the third backflow prevention device 56*c* and the branch pipe 4*c*, and then is expanded to low-temperature and low-pressure refrigerant in the two-phase gas-liquid state at the load side expansion device 20*c*. The remaining liquid refrigerant is expanded to low-temperature and low-pressure refrigerant in the two-phase gas-liquid at the fourth expansion device 57, which is also used as a bypass, becomes low-temperature and low-pressure gas or refrigerant in the two-phase gas-liquid state through heat exchange with liquid refrigerant at the inter-refrigerant heat exchanger 52, and then flows into the low-pressure pipe of the outlet side of the relay device 5.

Most of the refrigerant in the two-phase gas-liquid state expanded at the load side expansion device 20*c* flows into the load side heat exchanger 21*c* acting as an evaporator, and becomes low-temperature and middle-pressure refrigerant in the two-phase gas-liquid state while cooling indoor air by receiving heat from the indoor air. The two-phase gas-liquid refrigerant flowing out of the load side heat exchanger 21*c* passes through the branch pipe 4*c* and the first opening and closing device 53*c* joins to the remaining refrigerant flowing out of the inter-refrigerant heat exchanger 52, flows out of the relay device 5, and flows into the outdoor unit 1 again through the main pipe 3.

The refrigerant flowing into the outdoor unit 1 passes through the first backflow prevention device 19*d*, becomes low-temperature and low-pressure refrigerant in the two-phase gas-liquid state, becomes low-temperature and low-pressure gas refrigerant while receiving heat from outdoor air at the heat source side heat exchanger 13, and is sucked into the compressor 10 again through the refrigerant flow switching device 12 and the accumulator 16.

In this case, the opening degrees of the load side expansion devices 20*a* and 20*b* are controlled so that a subcool (subcooling degree) obtained as the difference between a value obtained by converting a pressure measured by the inlet side pressure sensor into a saturated temperature and a temperature measured by each of the inlet side temperature sensors 85*a* and 85*b* is constant. The opening degree of the load side expansion device 20*c* is controlled so that a superheat (superheat degree) obtained by using the difference between a temperature measured by the inlet side temperature sensor 85*c* and a temperature measured by the outlet side temperature sensor 84*c* is constant.

The opening degree of the fourth expansion device 57 is controlled so that a subcool (subcooling degree) obtained by using the difference between a value obtained converting a pressure measured by the outlet side pressure sensor 87 into a saturated temperature and a temperature measured by the temperature sensor 88 is constant.

When any load side heat exchanger has no thermal load, refrigerant does not need to flow to the load side heat exchanger having no thermal load, and thus a load side expansion device connected to the load side heat exchanger having no thermal load is closed. Then, when a thermal load is generated on the load side heat exchanger, the load side expansion device connected to the load side heat exchanger on which a thermal load is generated can be opened to circulate refrigerant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

As described above, similarly to the air-conditioning apparatus 100 illustrated in FIGS. 1 to 4, in the air-conditioning apparatus 200 illustrated in FIGS. 12 to 16 in the cooling only operation mode, the cooling main operation mode, the heating only operation mode, and the heating main operation mode, the refrigerating machine oil and part of the gas refrigerant separated at the oil separator 11 are cooled and injected to the suction unit of the compressor 10 through the first flow control device 72.

Embodiment 6

Figure 17:
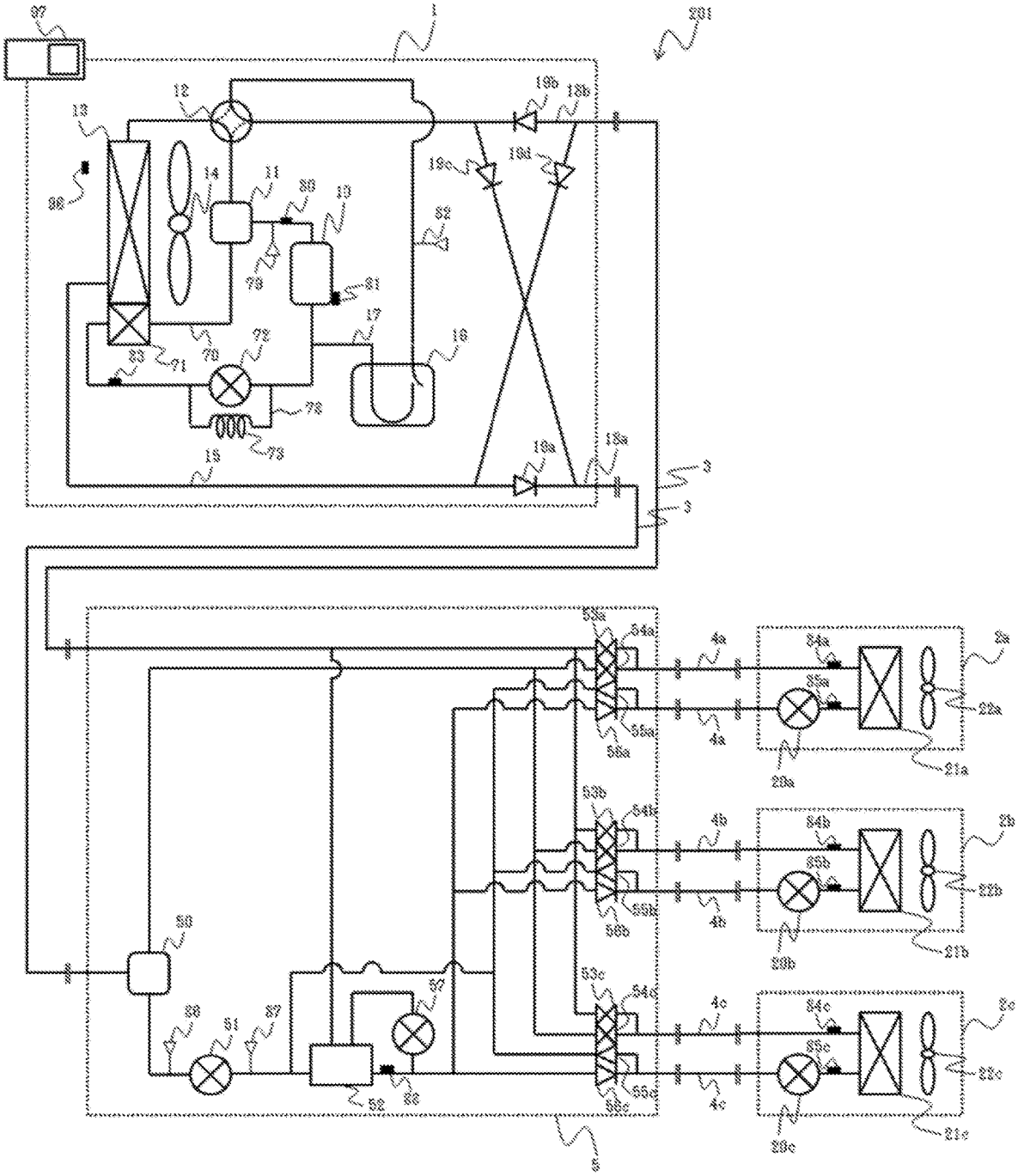
FIG. 17 is a diagram schematically illustrating an exemplary circuit configuration of an air-conditioning apparatus according to Embodiment 6 of the present invention.

FIG. 17 is a diagram schematically illustrating an exemplary circuit configuration of an air-conditioning apparatus according to Embodiment 6 of the present invention. In this air-conditioning apparatus 201 illustrated in FIG. 17, any component having a configuration identical to that of the air-conditioning apparatus 200 illustrated in FIG. 12 is denoted by an identical reference sign, and description of the component will be omitted. The air-conditioning apparatus 201 illustrated in FIG. 17 is different from the air-conditioning apparatus 200 illustrated in FIG. 12 in the configuration of the outdoor unit 1. Specifically, the outdoor unit 1 according to the present embodiment further includes the flow controller 73 disposed in parallel to the first flow control device 72. The flow controller 73 is, for example, a capillary tube that has a fixed passage resistance value.

In the air-conditioning apparatus 201, the controller 97 controls the first flow control device 72 so that the first flow control device 72 is fully closed when the discharge temperature of the compressor 10 measured by, for example, the discharge temperature sensor 80 is equal to or lower than the discharge temperature threshold. The discharge temperature threshold is lower than, for example, a temperature at which the compressor 10 is potentially damaged or a temperature at which refrigerating machine oil potentially degrades, and is set to be, for example, equal to or lower than 115 degrees C. The discharge temperature threshold is set in advance depending on, for example, a limit value of the discharge temperature of the compressor 10, and stored in, for example, the storage unit (not illustrated).

As the outdoor unit 1 according to the present embodiment includes the flow controller 73 disposed in parallel to the first flow control device 72 as described above, refrigerating machine oil, or refrigerating machine oil and refrigerant sequentially circulate the compressor 10, the oil separator 11, the auxiliary heat exchanger 71, the flow controller 73, and the compressor 10 even when the first flow control device 72 suffers anomaly and is closed. With this configuration, even when the first flow control device 72 suffers anomaly and is closed, refrigerating machine oil in an amount enough to prevent refrigerating machine oil in the compressor 10 from running short flows into the suction unit of the compressor 10 through the auxiliary heat exchanger 71 and the flow controller 73. Thus, in the outdoor unit 1 according to the present embodiment, when the first flow control device 72 suffers anomaly and is closed, refrigerating machine oil is maintained in an amount necessary for reduction of increase of the discharge temperature of the compressor 10 and for lubrication and sealing of the compressor 10. As a result, in the outdoor unit 1 according to the present embodiment, the risk of damage on the compressor 10 is reliably reduced.

Embodiment 7

Figure 18:
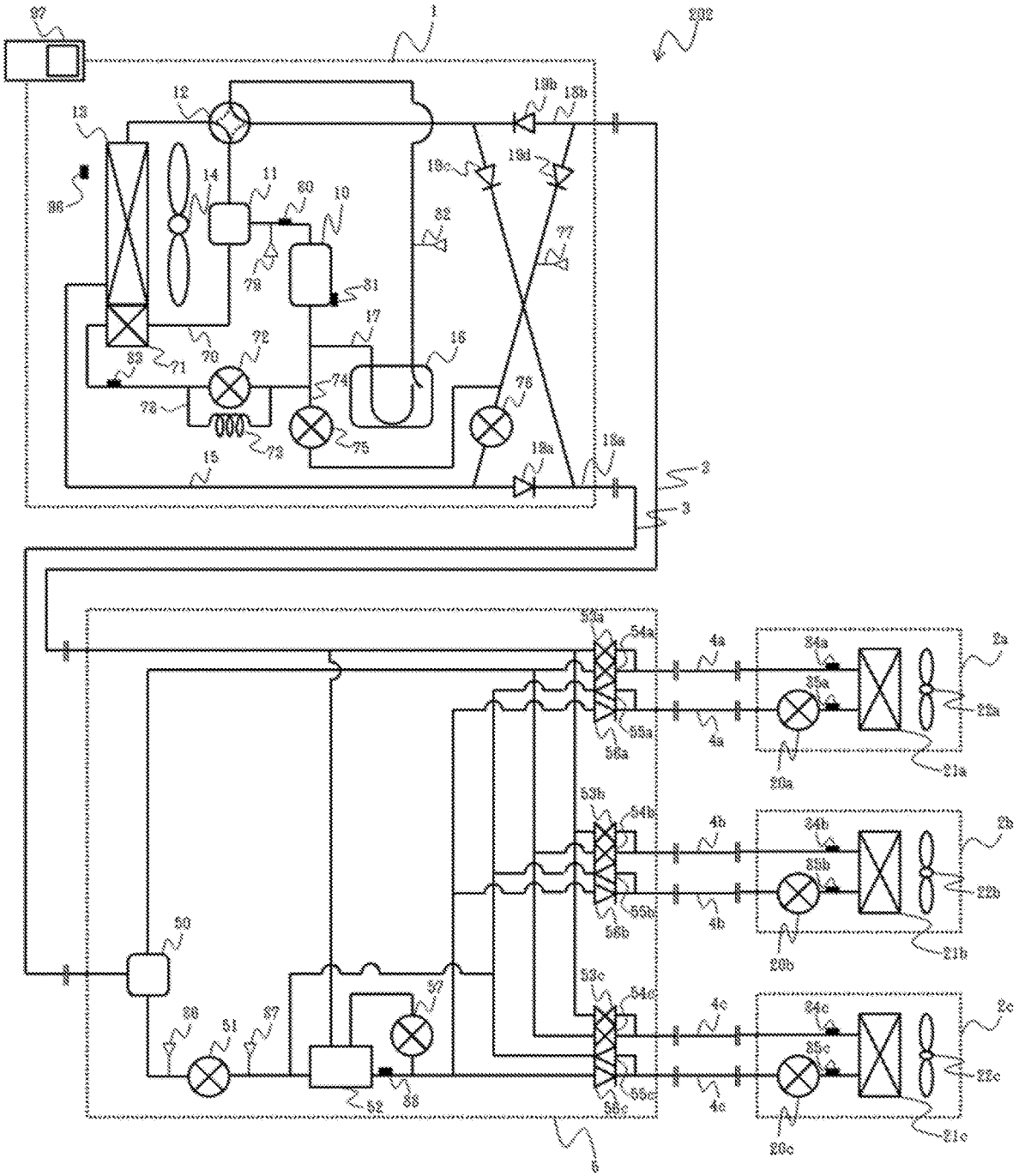
FIG. 18 is a diagram schematically illustrating an exemplary circuit configuration of an air-conditioning apparatus according to Embodiment 7 of the present invention.

FIG. 18 is a diagram schematically illustrating an exemplary circuit configuration of an air-conditioning apparatus according to Embodiment 7 of the present invention. In this air-conditioning apparatus 202 illustrated in FIG. 18, any component having a configuration identical to that of the air-conditioning apparatus 201 illustrated in FIG. 17 is denoted by an identical reference sign, and description of the component will be omitted. The air-conditioning apparatus 202 illustrated in FIG. 18 is different from the air-conditioning apparatus 201 illustrated in FIG. 17 in the configuration of the outdoor unit 1. Specifically, the outdoor unit 1 according to the present embodiment further includes the second bypass passage 74 on which the second flow control device 75 is disposed. In any of the cooling only operation mode, the cooling main operation mode, the heating only operation mode, and the heating main operation mode, the second bypass passage 74 has one end connected to the pipe between the heat source side heat exchanger 13 and the main pipe 3 through which liquid refrigerant circulates, and the other end connected to the outflow side of the first flow control device 72. In other words, the second bypass passage 74 serves as a bypass between the suction side of the compressor 10 and the pipe connecting the heat source side heat exchanger 13 and the load side expansion devices 20*a* and 20*b*. The second bypass passage 74 is a pipe through which low-temperature and high-pressure liquid refrigerant flows into the suction unit of the compressor 10 in the cooling operation, or middle-temperature and middle-pressure liquid refrigerant or two-phase refrigerant flows into the suction unit of the compressor 10 in the heating operation. The second flow control device 75 is, for example, an electronic expansion valve having a variably controllable opening degree, and is configured to adjust the flow rate of liquid refrigerant flowing into the suction unit of the compressor 10 or two-phase refrigerant.

The pressure adjustment device 76 is disposed between the heat source side heat exchanger 13 and the upstream connection part with the second bypass passage 74. In other words, the pressure adjustment device 76 is disposed between the heat source side heat exchanger 13 and the connection part connected to the second bypass passage 74 on the pipe connecting the heat source side heat exchanger 13 and the load side expansion devices 20*a* and 20*b*. The pressure adjustment device 76 is, for example, an electronic expansion valve having a variably controllable opening degree, and adjusts the pressure at the upstream part of the second bypass passage 74 to be middle pressure, for example, in the heating operation. In other words, the pressure adjustment device 76 is configured to adjust the pressure of liquid refrigerant or two-phase refrigerant flowing into the second bypass passage 74. The outdoor unit 1 is also provided with the middle-pressure sensor 77 configured to measure the pressure between the outlets of the load side expansion devices 20 and the pressure adjustment device 76.

The pressure adjustment device 76 is fully opened, for example, in the cooling only operation mode and the cooling main operation mode. For example, in the heating only operation mode and the heating main operation mode, the pressure adjustment device 76 has such an opening degree that the pressure between the outlets of the load side expansion devices 20*a* to 20*c* of the indoor units 2 and the inlet of the pressure adjustment device 76 is increased to middle pressure. Specifically, the pressure adjustment device 76 is controlled so that a value measured by the middle-pressure sensor 77 becomes equal to a pressure value set in advance.

In this manner, in the air-conditioning apparatus 202 according to the present embodiment in any of the cooling only operation mode, the cooling main operation mode, the heating only operation mode, and the heating main operation mode, the suction enthalpy of the compressor 10 can be decreased by fluid cooled through the auxiliary heat exchanger 71 and also by part of refrigerant cooled through the heat source side heat exchanger 13. Thus, in the air-conditioning apparatus 202 according to the present embodiment, when the discharge temperature of the compressor 10 has increased, the increase of the discharge temperature of the compressor 10 can be reduced. Specifically, for example, when the heat exchange capacity, which is the processing capacity of the auxiliary heat exchanger 71, has reached an upper limit of the heat exchange capacity, the increase of the discharge temperature of the compressor 10 can be reduced by opening the second flow control device 75. In the air-conditioning apparatus 202 according to the present embodiment, as the increase of the discharge temperature of the compressor 10 can be reduced, degradation of refrigerating machine oil and damage on the compressor 10 can be reduced. In addition, as refrigerating machine oil at the suction unit of the compressor 10 is reliably cooled, loss due to suction heating of the compressor 10 can be reduced.

Furthermore, as increase of the discharge temperature of the compressor 10 is reduced, the rotation frequency of the compressor 10 can be increased to improve cooling intensity.

Embodiment 8

Figure 19:
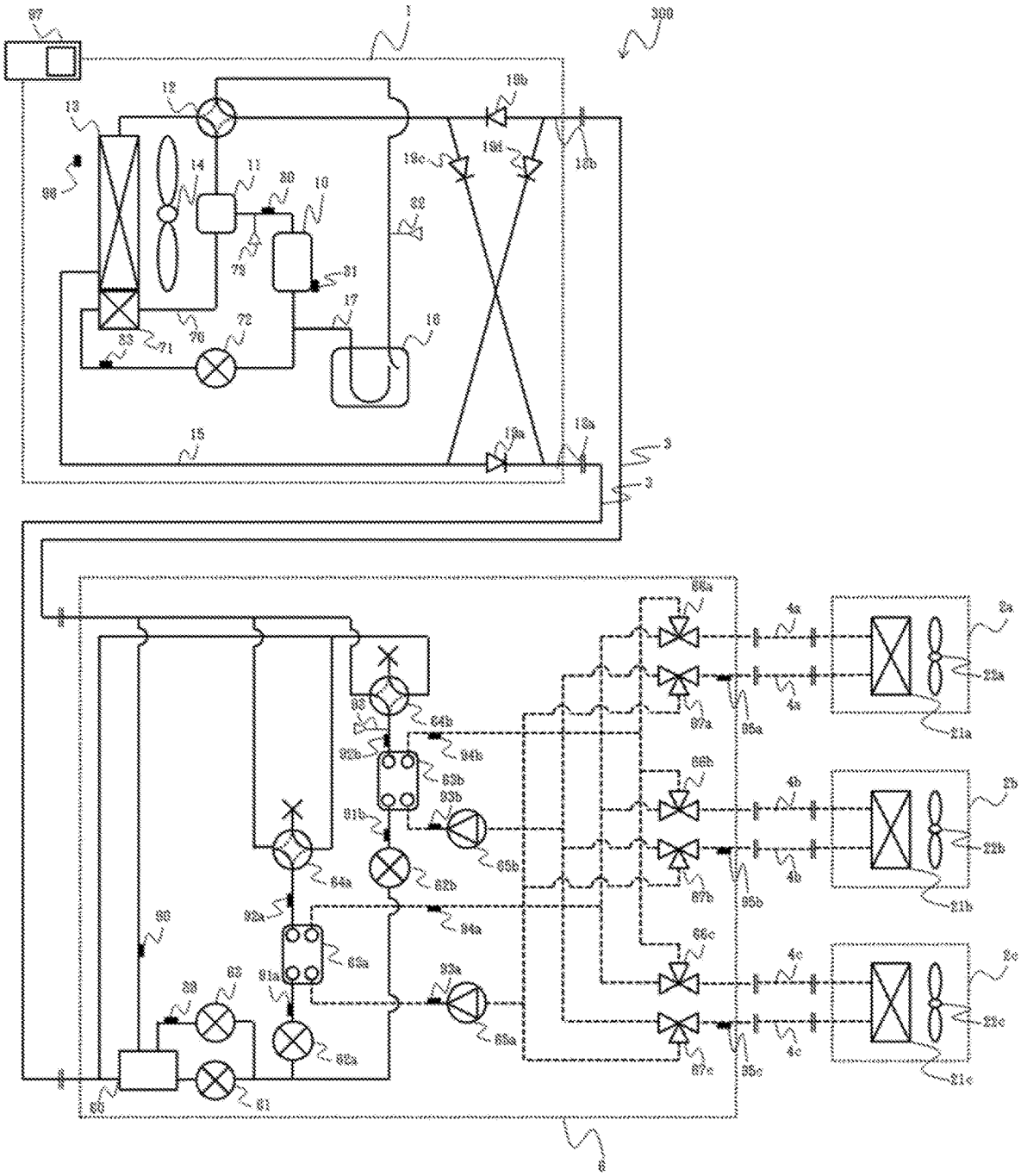
FIG. 19 is a diagram schematically illustrating an exemplary circuit configuration of an air-conditioning apparatus according to Embodiment 8 of the present invention.

FIG. 19 is a diagram schematically illustrating an exemplary circuit configuration of an air-conditioning apparatus according to Embodiment 8 of the present invention. In this air-conditioning apparatus 300 illustrated in FIG. 19, any component having a configuration identical to that of the air-conditioning apparatus 200 illustrated in FIG. 12 is denoted by an identical reference sign, and description of the component will be omitted. The air-conditioning apparatus 300 illustrated in FIG. 19 is different from the air-conditioning apparatus 200 illustrated in FIG. 12 in the configuration of the relay device 6.

In the air-conditioning apparatus 300, a primary side cycle through which first refrigerant (hereinafter referred to as refrigerant) circulates is formed between the outdoor unit 1 and the relay device 6, a secondary side cycle through which heat medium (hereinafter referred to as brine) circulates is formed between the relay device 6 and the indoor units 2*a* to 2*c*, and heat exchange between the primary side cycle and the secondary side cycle is performed at the first middle heat exchanger 63*a* and a second middle heat exchanger 63*b* installed on the relay device 6. The brine may be, for example, water, antifreeze liquid, or water with added anticorrosion material.

[Indoor Unit]

The plurality of indoor units 2*a* to 2*c* have, for example, identical configurations and include the load side heat exchangers 21*a* to 21*c*, respectively. The load side heat exchangers 21*a* to 21*c* are connected to the relay device 6 through the branch pipes 4*a* to 4*c* and configured to generate heating air or cooling air to be supplied to an indoor space through heat exchange between air supplied from the air-sending devices of the fans 22*a* to 22*c* and brine.

[Relay Device]

The relay device 6 includes an inter-refrigerant heat exchanger 60, a third expansion device 61, a fourth expansion device 68, the first flow controller 62*a*, a second flow controller 62*b*, the first middle heat exchanger 63*a*, the second middle heat exchanger 63*b*, a first flow switching device 64*a*, a second flow switching device 64*b*, the first pump 65*a*, a second pump 65*b*, the plurality of first flow switching devices 66*a* to 66*c*, and a plurality of second flow switching devices 67*a* to 67*c*.

The first flow controller 62*a* and the second flow controller 62*b* are each, for example, an electronic expansion valve having a variably controllable opening degree and each act as a pressure reducing valve or an expansion valve configured to depressurize and expand refrigerant. The first flow controller 62*a* and the second flow controller 62*b* are provided upstream of the first middle heat exchanger 63*a* and the second middle heat exchanger 63*b* in the primary side cycle in a direction of refrigerant flow in the cooling only operation mode.

The first middle heat exchanger 63*a* and the second middle heat exchanger 63*b* are each, for example, a double-pipe heat exchanger or a plate heat exchanger, and configured to exchange heat between refrigerant in the primary side cycle and refrigerant in the secondary side cycle. The first middle heat exchanger 63*a* and the second middle heat exchanger 63*b* act as evaporators when all of the indoor units in operation perform cooling, the first middle heat exchanger 63*a* and the second middle heat exchanger 63*b* act as condensers when all of the indoor units in operation perform heating, and one of the first middle heat exchanger 63*a* and the second middle heat exchanger 63*b* acts as a condenser and the other acts as an evaporator when indoor units in operation perform cooling and heating in mixture.

The first flow switching device 64*a* and the second flow switching device 64*b* are each, for example, a four-way valve and configured to switch the refrigerant passage among the cooling only operation mode, the cooling main operation mode, the heating only operation mode, and the heating main operation mode. In the cooling only operation mode, the first middle heat exchanger 63*a* and the second middle heat exchanger 63*b* both act as evaporators. In the cooling main operation mode and the heating main operation mode, for example, the first middle heat exchanger 63*a* acts as an evaporator, and the second middle heat exchanger 63*b* acts as a condenser. In the heating only operation mode, the first middle heat exchanger 63*a* and the second middle heat exchanger 63*b* both act as condensers. The first flow switching device 64*a* and the second flow switching device 64*b* are provided downstream of the first middle heat exchanger 63*a* and the second middle heat exchanger 63*b* in the primary side cycle in a direction of refrigerant flow in the cooling only operation mode.

The first pump 65*a* and the second pump 65*b* are each, for example, an inverter centrifugal pump and configured to suck brine and increase the pressure of the brine. The first pump 65*a* and the second pump 65*b* are provided upstream of the first middle heat exchanger 63*a* and the second middle heat exchanger 63*b* in the secondary side cycle.

The plurality of first flow switching devices 66*a* to 66*c* are provided for the plurality of respective indoor units 2*a* to 2*c* in a number (in the example illustrated in FIG. 19, three) equal to the installation number of indoor units. The plurality of first flow switching devices 66*a* to 66*c* are each, for example, a two-way valve, and configured to switch the connection target of the inflow side of the corresponding one of the indoor units 2*a* to 2*c* between a passage from the first middle heat exchanger 63*a* and a passage from the second middle heat exchanger 63*b*. The first flow switching devices 66*a* to 66*c* are provided downstream of the first middle heat exchanger 63*a* and the second middle heat exchanger 63*b* in the secondary side cycle.

The plurality of second flow switching devices 67*a* to 67*c* are provided for the plurality of respective indoor units 2*a* to 2*c* in a number (in the example illustrated in FIG. 19, three) equal to the installation number of indoor units. The plurality of second flow switching devices 67*a* to 67*c* are each, for example, a two-way valve, and configured to switch the connection target of the outflow side of the corresponding one of the indoor units 2*a* to 2*c* between a passage to the first pump 65*a* and a passage to the second pump 65*b*. The second flow switching devices 67*a* to 67*c* are provided upstream of the first pump 65*a* and the second pump 65*b* in the secondary side cycle.

In the relay device 6, an inlet temperature sensor 89 is provided at a low-pressure side inlet of the inter-refrigerant heat exchanger 60, and an outlet temperature sensor 90 is provided at a low-pressure side outlet of the inter-refrigerant heat exchanger 60. The inlet temperature sensor 89 and the outlet temperature sensor 90 are each preferably, for example, a thermistor.

In the relay device 6, the inlet temperature sensors 91*a* and 91*b* are provided at the inlets of the first middle heat exchanger 63*a* and the second middle heat exchanger 63*b* to the primary side cycle, and the outlet temperature sensors 92*a* and 92*b* are provided at the outlets of the first middle heat exchanger 63*a* and the second middle heat exchanger 63*b* from the primary side cycle. The inlet temperature sensors 91*a* and 91 *b* and the outlet temperature sensors 92*a* and 92*b* are each preferably, for example, a thermistor.

In the relay device 6, the indoor unit outlet temperature sensors 93*a* to 93*b* are provided at the inlets of the first middle heat exchanger 63*a* and the second middle heat exchanger 63*b* to the secondary side cycle, the indoor unit inlet temperature sensors 94*a* and 94*b* are provided at the outlets of the first middle heat exchanger 63*a* and the second middle heat exchanger 63*b* from the secondary side cycle, and indoor unit outlet temperature sensors 95*a* to 95*d* are provided at inlets of the plurality of second flow switching devices 67*a* to 67*c*. The indoor unit outlet temperature sensors 93*a* to 93*b*, the indoor unit inlet temperature sensors 94*a* and 94*b*, and the indoor unit outlet temperature sensors 95*a* to 95*d* are each preferably, for example, a thermistor.

In the relay device 6, an outlet pressure sensor 98 is provided on an outlet side of the second middle heat exchanger 63*b*. The outlet pressure sensor 98 is configured to measure the pressure of high-pressure refrigerant.

[Cooling Only Operation Mode]

Figure 20:
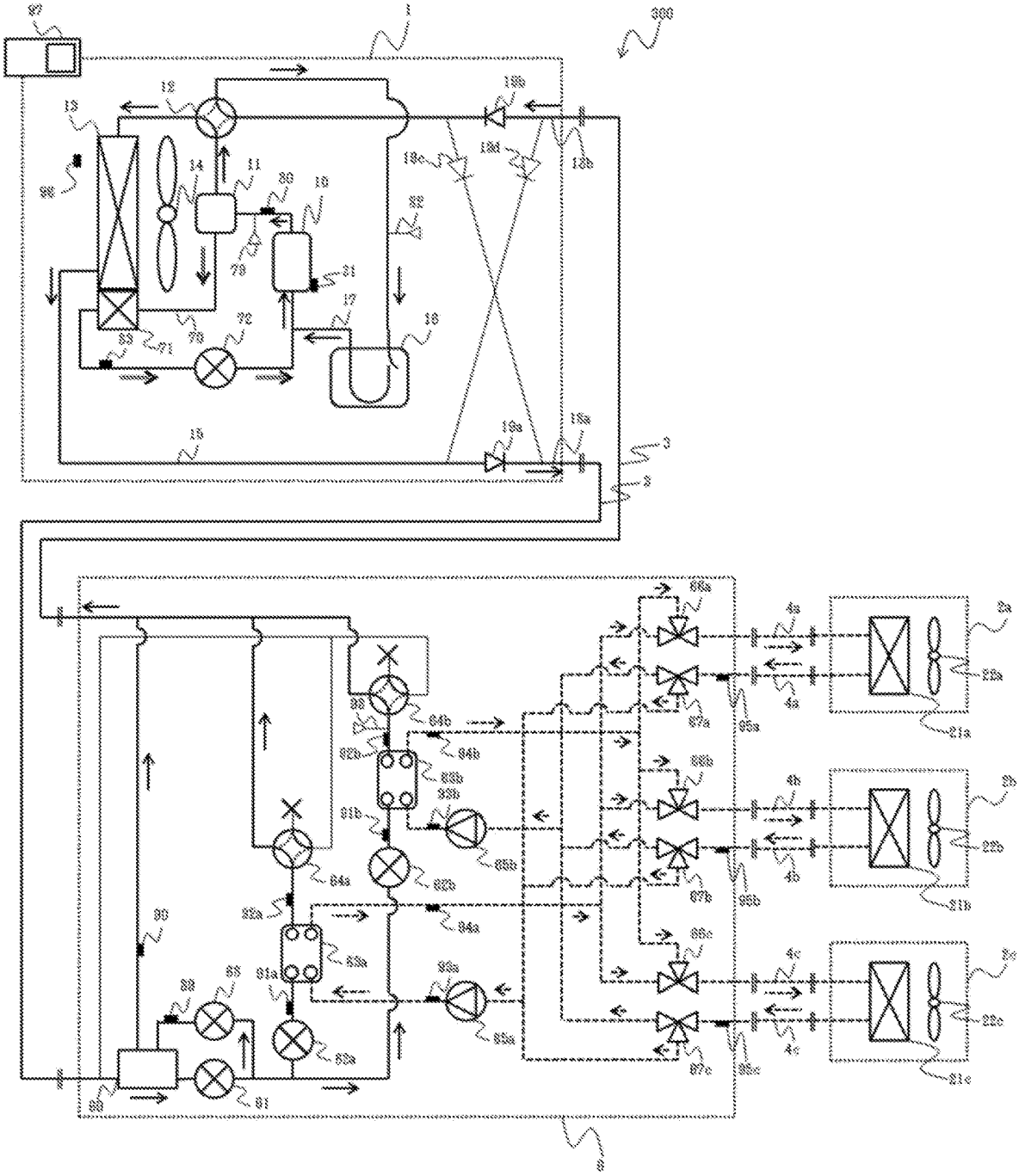
FIG. 20 is a diagram for description of an exemplary operation of the air-conditioning apparatus illustrated in FIG. 19 in the cooling only operation mode.

FIG. 20 is a diagram for description of an exemplary operation of the air-conditioning apparatus illustrated in FIG. 19 in the cooling only operation mode. In FIG. 20, a passage through which refrigerant circulates is illustrated with a bold line, the flow direction of refrigerant is illustrated with a solid-line arrow, the flow direction of refrigerating machine oil and refrigerant is indicated with a double-line arrow, and the flow direction of brine is indicated with a dotted-line arrow. In the cooling only operation mode, the controller 97 switches the refrigerant flow switching device 12 so that refrigerant discharged from the compressor 10 flows into the heat source side heat exchanger 13.

The following first describes an operation of the primary side cycle in the cooling only operation mode. High-pressure liquid refrigerant flowing into the relay device 6 is sufficiently subcooled at the inter-refrigerant heat exchanger 60, and then passes through the third expansion device 61 controlled to be opened. Most of the subcooled high-pressure refrigerant is expanded to low-temperature and low-pressure refrigerant in the two-phase gas-liquid state at the first flow controller 62*a* and the second flow controller 62*b*. The remaining high-pressure refrigerant is expanded to low-temperature and low-pressure refrigerant in the two-phase gas-liquid state at the fourth expansion device 68.

Then, the low-temperature and low-pressure refrigerant in the two-phase gas-liquid state expanded at the fourth expansion device 68 becomes low-temperature and low-pressure gas refrigerant through heat exchange with high-pressure liquid refrigerant at the inter-refrigerant heat exchanger 60 and flows into the low-pressure pipe on the outlet side of the relay device 6. In this case, the opening degree of the fourth expansion device 68 is controlled so that a superheat (superheat degree) obtained by using the difference between a temperature measured by the inlet temperature sensor 89 and a temperature measured by the outlet temperature sensor 90 is constant.

Most of the low-temperature and low-pressure refrigerant in the two-phase gas-liquid state flowing out of the first flow controller 62*a* and the second flow controller 62*b* flows into the first middle heat exchanger 63*a* and the second middle heat exchanger 63*b* acting as evaporators, respectively, and becomes low-temperature and low-pressure gas refrigerant while cooling brine. In this case, the opening degrees of the first flow controller 62*a* and the second flow controller 62*b* are controlled so that a superheat (superheat degree) obtained by using the difference between a temperature measured by the inlet temperature sensor 91*a* or 91*b* and a temperature measured by the outlet temperature sensor 92*a* or 92*b*, respectively, is constant.

The gas refrigerant flowing out of the first middle heat exchanger 63*a* and the second middle heat exchanger 63*b* passes through the first flow switching device 64*a* and the second flow switching device 64*b*, joins to gas refrigerant flowing out of the inter-refrigerant heat exchanger 60, flows out of the relay device 6, and flows into the outdoor unit 1 through the main pipe 3. The refrigerant flowing into the outdoor unit 1 passes through the first backflow prevention device 19*b* and is sucked into the compressor 10 again through the refrigerant flow switching device 12 and the accumulator 16.

The following describes operation of the secondary side cycle in the cooling only operation mode. Brine, the pressure of which is increased at the first pump 65*a* and the second pump 65*b* flows into the first middle heat exchanger 63*a* and the second middle heat exchanger 63*b*. The brine cooled to low temperature at the first middle heat exchanger 63*a* and the second middle heat exchanger 63*b* flows into the load side heat exchangers 21*a* to 21*c* through the first flow switching devices 66*a* to 66*c* being set to be communicated with both or one of the first middle heat exchanger 63*a* and the second middle heat exchanger 63*b*. The brine flowing through the load side heat exchangers 21*a* to 21*c* cools indoor air, thereby performing a cooling operation. During the cooling operation, the brine is heated by the indoor air and returned to the first pump 65*a* and the second pump 65*b* in the relay device 6 through the second flow switching devices 67*a* to 67*c*. In this case, the voltage of the first pump 65*a* or the second pump 65*b* is controlled so that, for example, the difference between a temperature measured by the indoor unit inlet temperature sensor 94*a* or 94*b* and a temperature measured by the indoor unit outlet temperature sensor 93*a* or 93*b* is constant, respectively.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Cooling Main Operation Mode]

Figure 21:
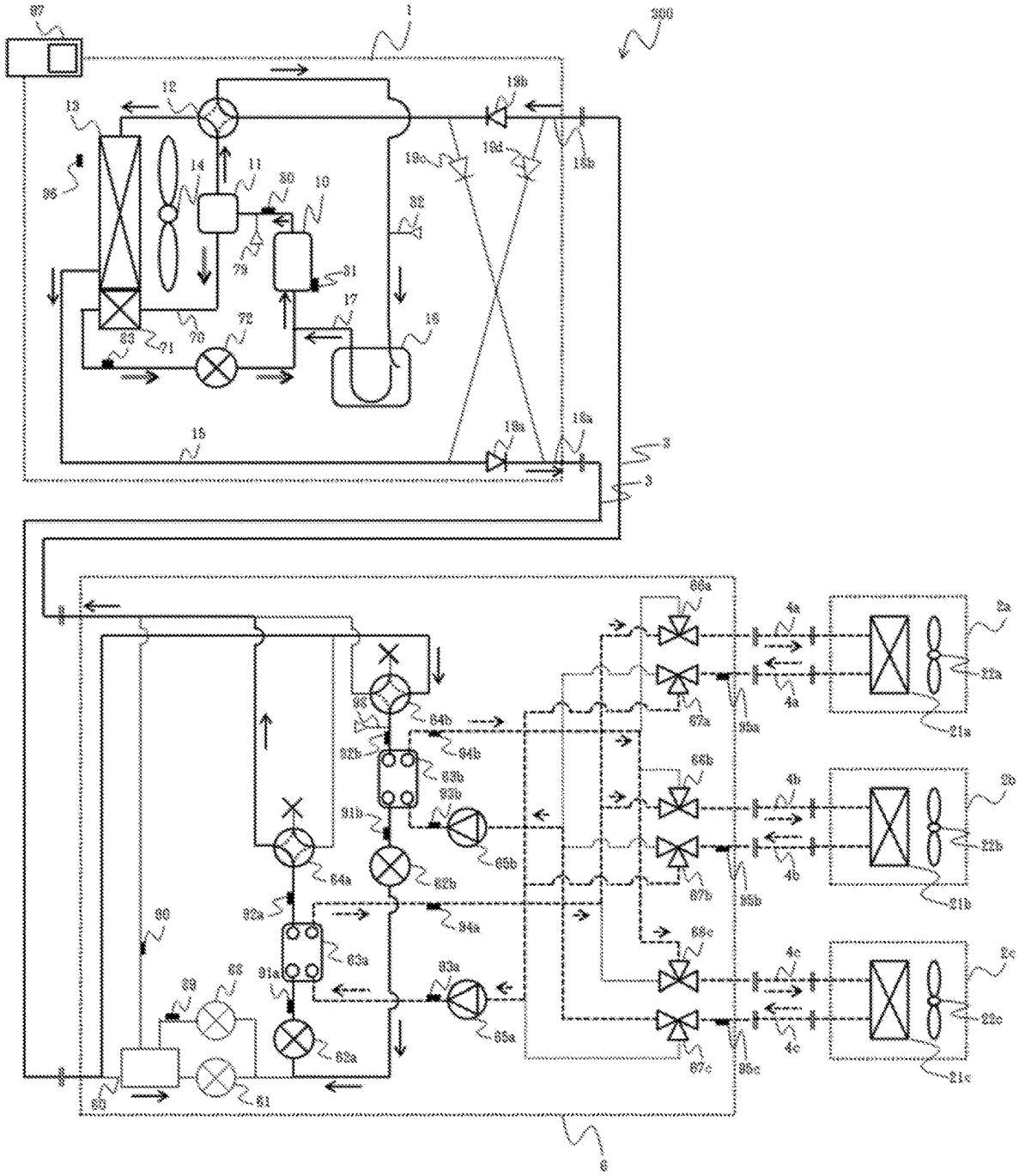
FIG. 21 is a diagram for description of an exemplary operation of the air-conditioning apparatus illustrated in FIG. 19 in the cooling main operation mode.

FIG. 21 is a diagram for description of an exemplary operation of the air-conditioning apparatus illustrated in FIG. 19 in the cooling main operation mode. In FIG. 21, a passage through which refrigerant circulates is illustrated with a bold line, the flow direction of refrigerant is illustrated with a solid-line arrow, the flow direction of refrigerating machine oil and refrigerant is indicated with a double-line arrow, and the flow direction of brine is indicated with a dotted-line arrow. In the cooling main operation mode, the controller 97 switches the refrigerant flow switching device 12 so that refrigerant discharged from the compressor 10 flows into the heat source side heat exchanger 13.

The following first describes an operation of the primary side cycle in the cooling main operation mode. Refrigerant in the two-phase gas-liquid state flowing into the relay device 6 is separated into high-pressure gas refrigerant and high-pressure liquid refrigerant upstream of the inter-refrigerant heat exchanger 60. The high-pressure gas refrigerant passes through the second flow switching device 64*b*, and then flows into the second middle heat exchanger 63*b* acting as a condenser and becomes liquid refrigerant while heating brine. In this case, the opening degree of the second flow controller 62*b* is controlled so that a subcool (subcooling degree) obtained by using the difference between a value obtained by converting a pressure measured by the outlet pressure sensor 98 into a saturated temperature and a temperature measured by the inlet temperature sensor 91*b* is constant. The liquid refrigerant flowing out of the second middle heat exchanger 63*b* is expanded at the second flow controller 62*b*.

The high-pressure liquid refrigerant separated upstream of the inter-refrigerant heat exchanger 60 passes through the inter-refrigerant heat exchanger 60 and becomes middle-pressure liquid refrigerant through expansion to middle pressure at the third expansion device 61. The middle-pressure liquid refrigerant expanded at the third expansion device 61 joins to the liquid refrigerant expanded at the second flow controller 62*b*.

Most of the liquid refrigerant having joined is expanded to low-temperature and low-pressure refrigerant in the two-phase gas-liquid state at the first flow controller 62*a*. The remaining liquid refrigerant thus joined is expanded to low-temperature and low-pressure refrigerant in the two-phase gas-liquid state at the fourth expansion device 68. In this case, the opening degree of the fourth expansion device 68 is controlled so that a superheat (superheat degree) obtained by using the difference between a temperature measured by the inlet temperature sensor 89 and a temperature measured by the outlet temperature sensor 90 is constant. Subsequently, the low-temperature and low-pressure refrigerant in the two-phase gas-liquid state becomes low-temperature and low-pressure gas refrigerant through heat exchange with high-pressure liquid refrigerant at the inter-refrigerant heat exchanger 60, and then flows into the low-pressure pipe on the outlet side of the relay device 6.

Most of the refrigerant in the two-phase gas-liquid state expanded at the first flow controller 62*a* flows into the first middle heat exchanger 63*a* acting as an evaporator and becomes low-temperature and low-pressure gas refrigerant while cooling brine. In this case, the opening degree of the first flow controller 62*a* is controlled so that a superheat (superheat degree) obtained by using the difference between a temperature measured by the inlet temperature sensor 91*a* and a temperature measured by the outlet temperature sensor 92*a* is constant. The gas refrigerant flowing out of the first middle heat exchanger 63*a* passes through the first flow switching device 64*a* and joins to the remaining gas refrigerant flowing out of the inter-refrigerant heat exchanger 60, and then, flows out of the relay device 6 and flows into the outdoor unit 1 again through the main pipe 3. The refrigerant flowing into the outdoor unit 1 passes through the first backflow prevention device 19*b* and is sucked into the compressor 10 again through the refrigerant flow switching device 12 and the accumulator 16.

The following describes an operation of the secondary side cycle in the cooling main operation mode. In the secondary side cycle, for example, the indoor units 2*a* and 2*b* perform the cooling operation, and the indoor unit 2*c* performs the heating operation. The description will be first made on the indoor units 2*a* and 2*b* performing the cooling operation in the cooling main operation mode. Brine, the pressure of which is increased at the first pump 65*a* flows into the first middle heat exchanger 63*a*. The brine cooled to low temperature at the first middle heat exchanger 63*a* flows into the load side heat exchangers 21*a* and 21*b* through the first flow switching devices 66*a* and 66*b* being set to be communicated with the first middle heat exchanger 63*a*. The brine flowing into the load side heat exchangers 21*a* and 21*b* cools indoor air, thereby performing a cooling operation. During the cooling operation, the brine is heated by the indoor air and returned to the first pump 65*a* in the relay device 6 through the second flow switching devices 67*a* and 67*b*. In this case, the voltage of the first pump 65*a* is controlled so that, for example, the difference between a temperature measured by the indoor unit inlet temperature sensor 94*a* and a temperature measured by the indoor unit outlet temperature sensor 93*a* is constant.

The description will be next made on the indoor unit 2*c* performing the heating operation in the cooling main operation mode. Brine, the pressure of which is increased at the second pump 65*b* flows into the second middle heat exchanger 63*b*. The brine heated to high temperature at the second middle heat exchanger 63*b* flows into the load side heat exchanger 21*c* through the first flow switching device 66*c* being set to be communicated with the second middle heat exchanger 63*b*. The brine flowing into the load side heat exchanger 21*c* heats indoor air, thereby performing a heating operation. During the heating operation, the brine is cooled by the indoor air and returned to the second pump 65*b* in the relay device 6 through the second flow switching device 67*c*. In this case, the voltage of the second pump 65*b* is controlled so that, for example, the difference between a temperature measured by the indoor unit inlet temperature sensor 94*b* and a temperature measured by the indoor unit outlet temperature sensor 93*b* is constant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Heating Only Operation Mode]

Figure 22:
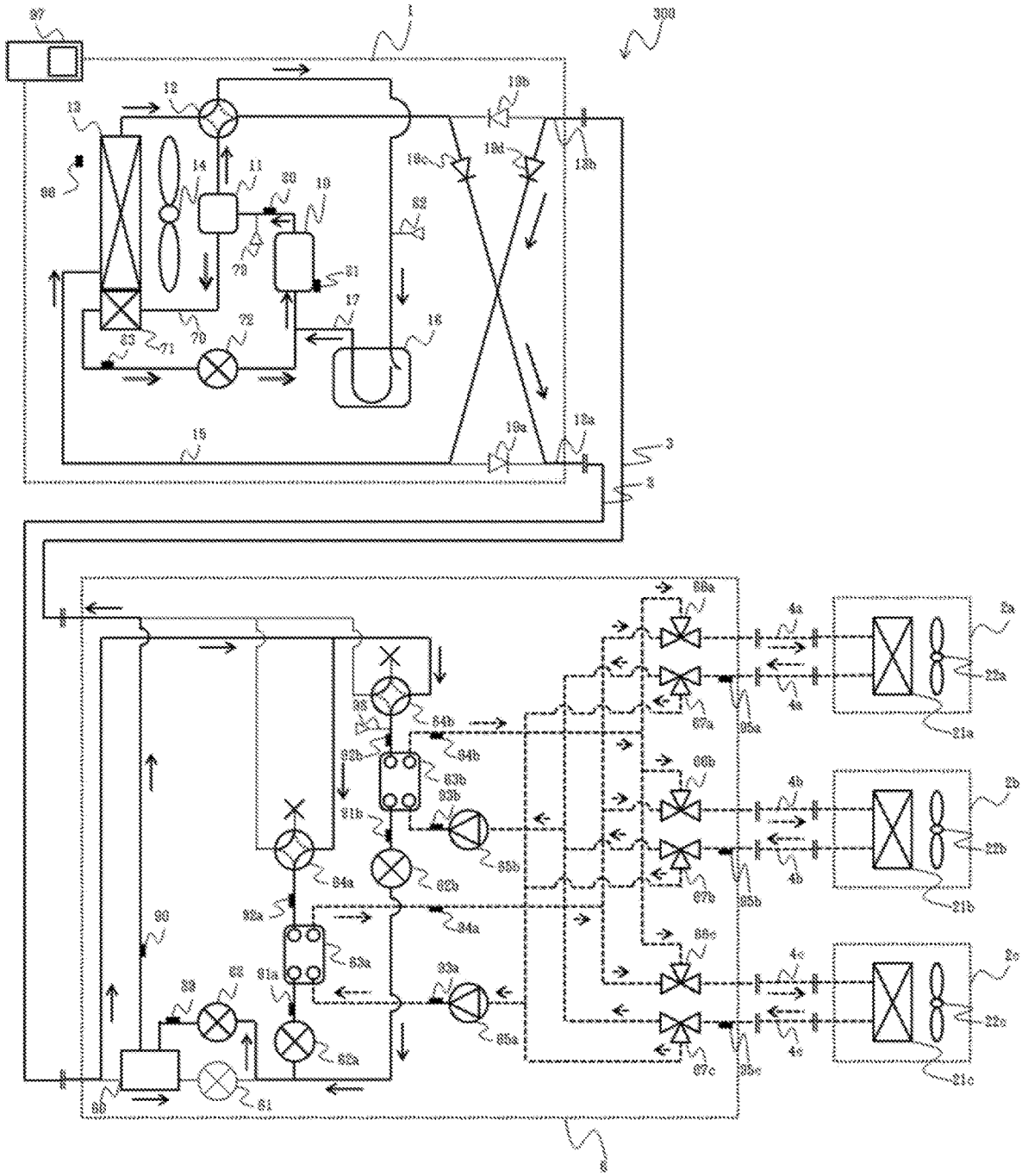
FIG. 22 is a diagram for description of an exemplary operation of the air-conditioning apparatus illustrated in FIG. 19 in the heating only operation mode.

FIG. 22 is a diagram for description of an exemplary operation of the air-conditioning apparatus illustrated in FIG. 19 in the heating only operation mode. In FIG. 22, a passage through which refrigerant circulates is illustrated with a bold line, the flow direction of refrigerant is illustrated with a solid-line arrow, the flow direction of refrigerating machine oil and refrigerant is indicated with a double-line arrow, and the flow direction of brine is indicated with a dotted-line arrow. In the heating only operation mode, the controller 97 switches the refrigerant flow switching device 12 so that heat source side refrigerant discharged from the compressor 10 flows into the relay device 6 without passing through the heat source side heat exchanger 13.

The following first describes an operation of the primary side cycle in the heating only operation mode. High-temperature and high-pressure gas refrigerant flowing into the relay device 6 passes through the first flow switching device 64*a* and the second flow switching device 64*b* and then flows into the first middle heat exchanger 63*a* and the second middle heat exchanger 63*b* acting as condensers, respectively. The refrigerant flowing into the first middle heat exchanger 63*a* and the second middle heat exchanger 63*b* becomes liquid refrigerant while heating brine. The liquid refrigerant flowing out of the first middle heat exchanger 63*a* and the second middle heat exchanger 63*b* is expanded at the first flow controller 62*a* and the second flow controller 62*b*, respectively, and flows into the outdoor unit 1 again through the fourth expansion device 68 controlled to be opened and the main pipe 3. In this case, the opening degree of the first flow controller 62*a* or the second flow controller 62*b* is controlled so that a subcool (subcooling degree) obtained by using the difference between a value obtained by converting a pressure measured by the outlet pressure sensor 98 into a saturated temperature and a temperature measured by the inlet temperature sensor 91*a* or 91*b* is constant.

The following describes an operation of the secondary side cycle in the heating only operation mode. Brine, the pressure of which is increased at the first pump 65*a* and the second pump 65*b* flows into the first middle heat exchanger 63*a* and the second middle heat exchanger 63*b*. The brine heated to high temperature at the first middle heat exchanger 63*a* and the second middle heat exchanger 63*b* flows into the load side heat exchangers 21*a* to 21*c* through the first flow switching devices 66*a* to 66*c* being set to be communicated with both or one of the first middle heat exchanger 63*a* and the second middle heat exchanger 63*b*. The brine flowing through the load side heat exchangers 21*a* to 21*c* heats indoor air, thereby performing a heating operation. During the heating operation, the brine is cooled by the indoor air and returned to the first pump 65*a* and the second pump 65*b* in the relay device 6 through the second flow switching devices 67*a* to 67*c*. In this case, the voltage of the first pump 65*a* or the second pump 65*b* is controlled so that, for example, the difference between a temperature measured by the indoor unit inlet temperature sensor 94*a* or 94*b* and a temperature measured by the indoor unit outlet temperature sensor 93*a* or 93*b* is constant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

[Heating Main Operation Mode]

Figure 23:
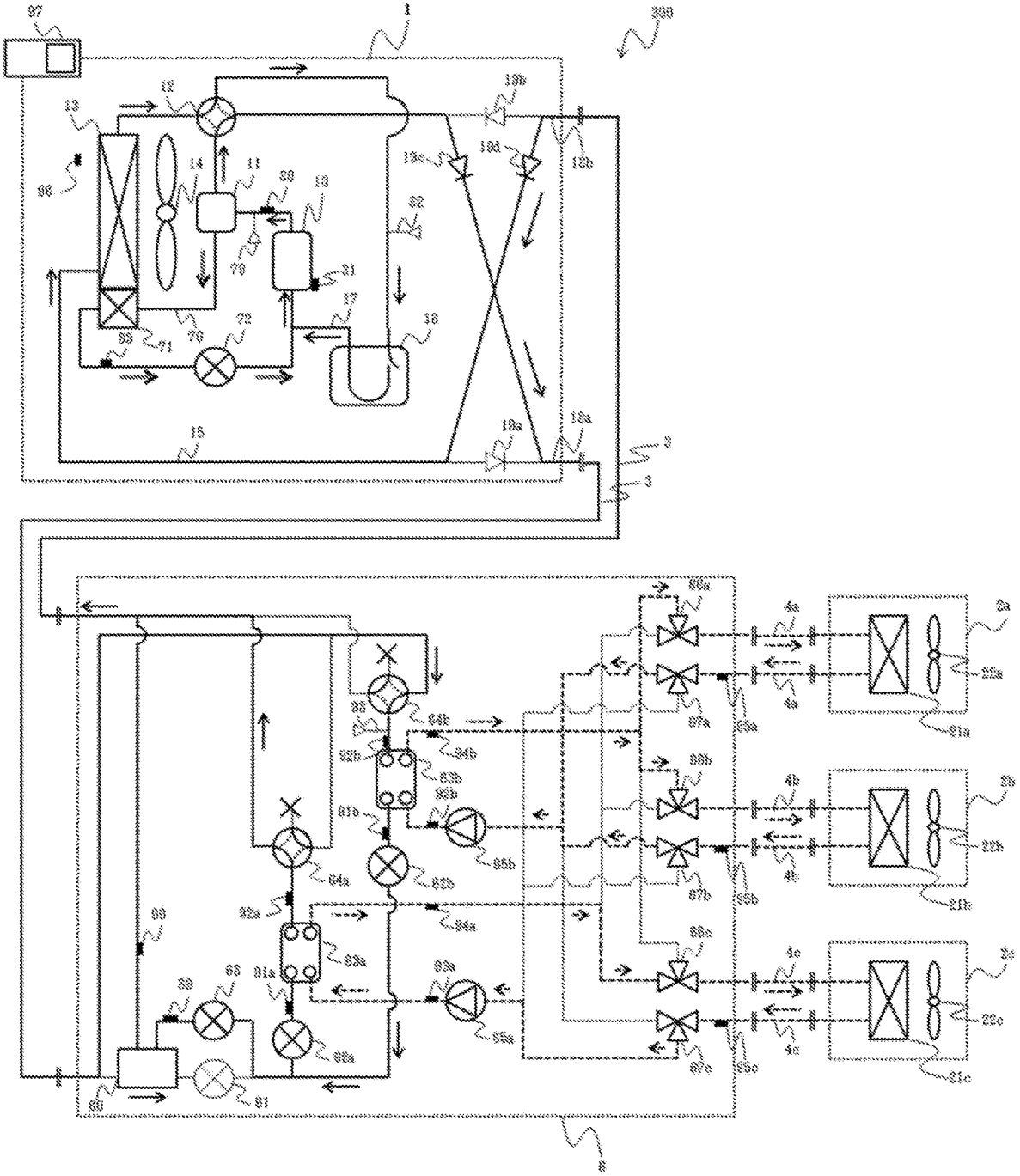
FIG. 23 is a diagram for description of an exemplary operation of the air-conditioning apparatus illustrated in FIG. 19 in the heating main operation mode.

FIG. 23 is a diagram for description of an exemplary operation of the air-conditioning apparatus illustrated in FIG. 19 in the heating main operation mode. In FIG. 23, a passage through which refrigerant circulates is illustrated with a bold line, the flow direction of refrigerant is illustrated with a solid-line arrow, the flow direction of refrigerating machine oil and refrigerant is indicated with a double-line arrow, and the flow direction of brine is indicated with a dotted-line arrow. With reference to FIG. 23, the following describes the heating main operation mode in an example in which heating loads are generated on the load side heat exchangers 21*a* and 21*b* and cooling loads are generated on the load side heat exchanger 21*c*. In the heating main operation mode illustrated in FIG. 23, the controller 97 switches the refrigerant flow switching device 12 so that heat source side refrigerant discharged from the compressor 10 flows into the relay device 6 without passing through the heat source side heat exchanger 13.

The following first describes an operation of the primary side cycle in the heating main operation mode. High-temperature and high-pressure gas refrigerant flowing into the relay device 6 is separated into high-pressure gas refrigerant and high-pressure liquid refrigerant upstream of the inter-refrigerant heat exchanger 60. The high-pressure gas refrigerant passes through the second flow switching device 64*b*, and then flows into the second middle heat exchanger 63*b* acting as a condenser and becomes liquid refrigerant while heating brine. In this case, the opening degree of the second flow controller 62*b* is controlled so that a subcool (subcooling degree) obtained by using the difference between a value obtained by converting a pressure measured by the outlet pressure sensor 98 into a saturated temperature and a temperature measured by the inlet temperature sensor 91*b* is constant. The liquid refrigerant flowing out of the second middle heat exchanger 63*b* is expanded at the second flow controller 62*b*.

The high-pressure liquid refrigerant separated upstream of the inter-refrigerant heat exchanger 60 passes through the inter-refrigerant heat exchanger 60 and becomes middle-pressure liquid refrigerant through expansion to middle pressure at the third expansion device 61. The middle-pressure liquid refrigerant expanded at the third expansion device 61 joins to the liquid refrigerant expanded at the second flow controller 62*b*.

Most of the liquid refrigerant having joined is expanded to low-temperature and low-pressure refrigerant in the two-phase gas-liquid state at the first flow controller 62*a*. The remaining liquid refrigerant thus joined is expanded to low-temperature and low-pressure refrigerant in the two-phase gas-liquid state at the fourth expansion device 68. In this case, the opening degree of the fourth expansion device 68 is controlled so that a superheat (superheat degree) obtained by using the difference between a temperature measured by the inlet temperature sensor 89 and a temperature measured by the outlet temperature sensor 90 is constant. Subsequently, the low-temperature and low-pressure refrigerant in the two-phase gas-liquid state becomes low-temperature and low-pressure gas refrigerant through heat exchange with high-pressure liquid refrigerant at the inter-refrigerant heat exchanger 60, and then flows into the low-pressure pipe on the outlet side of the relay device 6.

Most of the refrigerant in the two-phase gas-liquid state expanded at the first flow controller 62*a* flows into the first middle heat exchanger 63*a* acting as an evaporator and becomes low-temperature and low-pressure gas refrigerant while cooling brine. In this case, the opening degree of the first flow controller 62*a* is controlled so that a superheat (superheat degree) obtained by using the difference between a temperature measured by the inlet temperature sensor 91*a* and a temperature measured by the outlet temperature sensor 92*a* is constant. The gas refrigerant flowing out of the first middle heat exchanger 63*a* passes through the first flow switching device 64*a* and joins to the remaining gas refrigerant flowing out of the inter-refrigerant heat exchanger 60, and then, flows out of the relay device 6 and flows into the outdoor unit 1 again through the main pipe 3. The refrigerant flowing into the outdoor unit 1 passes through the first backflow prevention device 19*b* and is sucked into the compressor 10 again through the refrigerant flow switching device 12 and the accumulator 16.

The following describes an operation of the secondary side cycle in the heating main operation mode. In the secondary side cycle, for example, the indoor units 2*a* and 2*b* perform the heating operation, and the indoor unit 2*c* performs the cooling operation. The description will be first made on the indoor units 2*a* and 2*b* performing the heating operation in the heating main operation mode. Brine, the pressure of which is increased at the second pump 65*b* flows into the second middle heat exchanger 63*b*. The brine heated to high temperature at the second middle heat exchanger 63*b* flows into the load side heat exchangers 21*a* and 21*b* through the first flow switching devices 66*a* and 66*b* being set to be communicated with the second middle heat exchanger 63*b*. The brine flowing into the load side heat exchangers 21*a* and 21*b* heats indoor air, thereby performing a heating operation. During the heating operation, the brine is cooled by the indoor air and returned to the second pump 65*b* in the relay device 6 through the second flow switching devices 67*a* and 67*b*. In this case, the voltage of the second pump 65*b* is controlled so that, for example, the difference between a temperature measured by the indoor unit inlet temperature sensor 94*b* and a temperature measured by the indoor unit outlet temperature sensor 93*b* is constant.

The description will be next made on the indoor unit 2*c* performing the cooling operation in the heating main operation mode. Brine, the pressure of which is increased at the first pump 65*a* flows into the first middle heat exchanger 63*a*. The brine cooled to low temperature at the first middle heat exchanger 63*a* flows into the load side heat exchanger 21*c* through the first flow switching device 66*c* being set to be communicated with the first middle heat exchanger 63*a*. The brine flowing into the load side heat exchanger 21*c* cools indoor air, thereby performing a cooling operation. During the cooling operation, the brine is heated by the indoor air and returned to the first pump 65*a* in the relay device 6 through the second flow switching device 67*c*. In this case, the voltage of the first pump 65*a* is controlled so that, for example, the difference between a temperature measured by the indoor unit inlet temperature sensor 94*a* and a temperature measured by the indoor unit outlet temperature sensor 93*a* is constant.

The following describes refrigerating machine oil flow. Refrigerating machine oil accumulating in the shell of the compressor 10 is heated by refrigerant to a temperature equivalent to that of the refrigerant and discharged from the compressor 10. The high-temperature refrigerating machine oil discharged from the compressor 10 is separated by the oil separator 11 and flows into the auxiliary heat exchanger 71 through the first bypass passage 70. Then, the refrigerating machine oil flowing through the auxiliary heat exchanger 71 is cooled to a temperature equivalent to that of outdoor air supplied from the fan 14 while transferring heat to the outdoor air. The refrigerating machine oil flowing out of the auxiliary heat exchanger 71 is sucked into the compressor 10 again through the first flow control device 72.

As described above, similarly to the air-conditioning apparatus 100 illustrated in FIGS. 1 to 4, in the air-conditioning apparatus 300 illustrated in FIGS. 19 to 23 in the cooling only operation mode, the cooling main operation mode, the heating only operation mode, and the heating main operation mode, the refrigerating machine oil and part of the gas refrigerant separated at the oil separator 11 are cooled and injected to the suction unit of the compressor 10 through the first flow control device 72.

Embodiment 9

Figure 24:
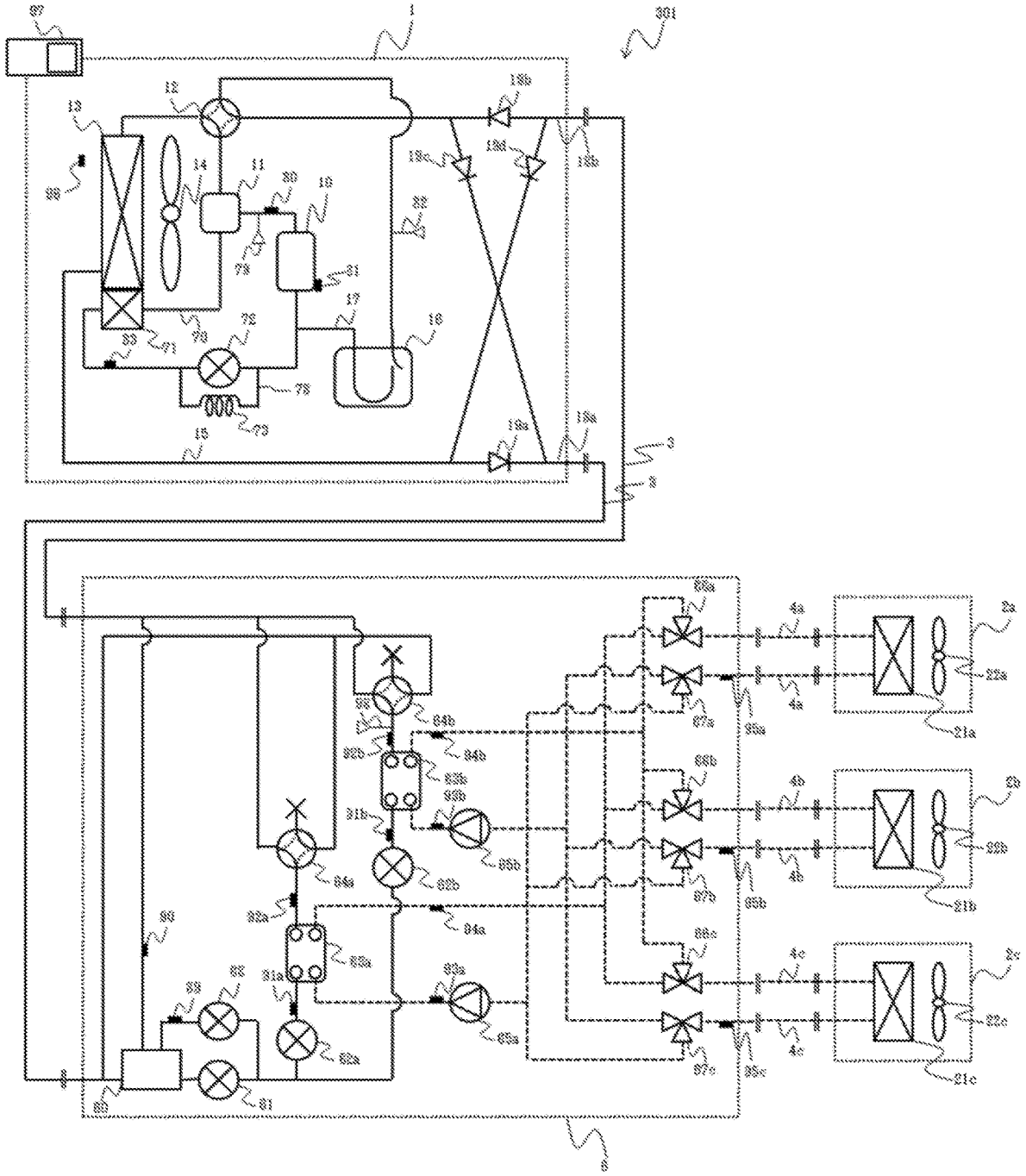
FIG. 24 is a diagram schematically illustrating an exemplary circuit configuration of an air-conditioning apparatus according to Embodiment 9 of the present invention.

FIG. 24 is a diagram schematically illustrating an exemplary circuit configuration of an air-conditioning apparatus according to Embodiment 9 of the present invention. In this air-conditioning apparatus 301 illustrated in FIG. 24, any component having a configuration identical to that of the air-conditioning apparatus 300 illustrated in FIG. 19 is denoted by an identical reference sign, and description of the component will be omitted. The air-conditioning apparatus 301 illustrated in FIG. 24 is different from the air-conditioning apparatus 300 illustrated in FIG. 19 in the configuration of the outdoor unit 1. Specifically, the outdoor unit 1 according to the present embodiment further includes the flow controller 73 disposed in parallel to the first flow control device 72. The flow controller 73 is, for example, a capillary tube that has a fixed passage resistance value.

In the air-conditioning apparatus 301, the controller 97 controls the first flow control device 72 so that the first flow control device 72 is fully closed when the discharge temperature of the compressor 10 measured by, for example, the discharge temperature sensor 80 is equal to or lower than the discharge temperature threshold. The discharge temperature threshold is lower than, for example, a temperature at which the compressor 10 is potentially damaged or a temperature at which refrigerating machine oil potentially degrades, and is set to be, for example, equal to or lower than 115 degrees C. The discharge temperature threshold is set in advance depending on, for example, a limit value of the discharge temperature of the compressor 10, and stored in, for example, the storage unit (not illustrated).

As the outdoor unit 1 according to the present embodiment includes the flow controller 73 disposed in parallel to the first flow control device 72 as described above, refrigerating machine oil, or refrigerating machine oil and refrigerant sequentially circulate the compressor 10, the oil separator 11, the auxiliary heat exchanger 71, the flow controller 73, and the compressor 10 even when the first flow control device 72 suffers anomaly and is closed. With this configuration, even when the first flow control device 72 suffers anomaly and is closed, refrigerating machine oil in an amount enough to prevent refrigerating machine oil in the compressor 10 from running short flows into the suction unit of the compressor 10 through the auxiliary heat exchanger 71 and the flow controller 73. Thus, in the outdoor unit 1 according to the present embodiment, when the first flow control device 72 suffers anomaly and is closed, refrigerating machine oil is maintained in an amount necessary for reduction of increase of the discharge temperature of the compressor 10 and for lubrication and sealing of the compressor 10. As a result, in the outdoor unit 1 according to the present embodiment, the risk of damage on the compressor 10 is reliably reduced.

Embodiment 10

Figure 25:
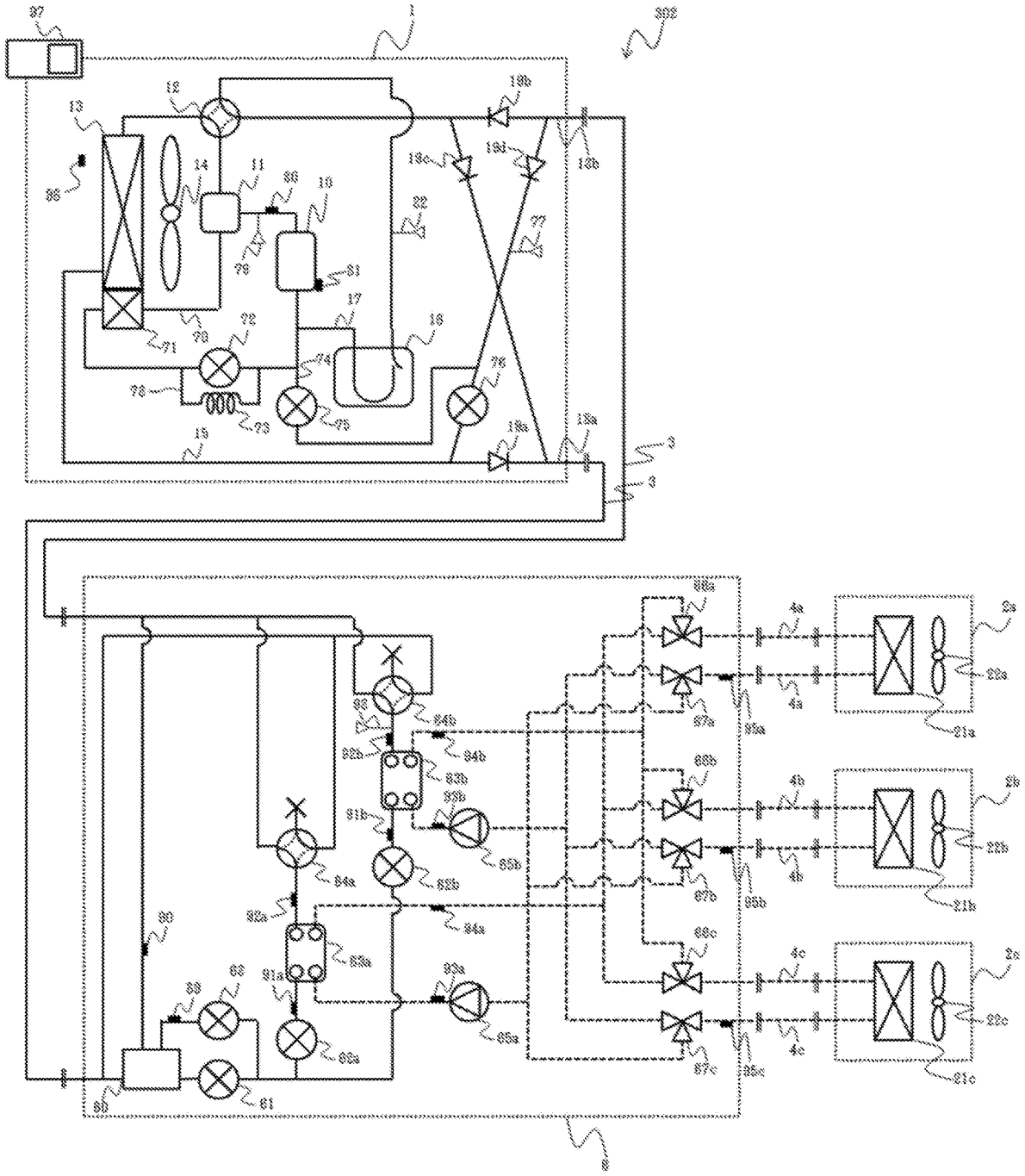
FIG. 25 is a diagram schematically illustrating an exemplary circuit configuration of an air-conditioning apparatus according to Embodiment 10 of the present invention.

FIG. 25 is a diagram schematically illustrating an exemplary circuit configuration of an air-conditioning apparatus according to Embodiment 10 of the present invention. In this air-conditioning apparatus 302 illustrated in FIG. 25, any component having a configuration identical to that of the air-conditioning apparatus 301 illustrated in FIG. 24 is denoted by an identical reference sign, and description of the component will be omitted. The air-conditioning apparatus 302 illustrated in FIG. 25 is different from the air-conditioning apparatus 301 illustrated in FIG. 24 in the configuration of the outdoor unit 1. Specifically, the outdoor unit 1 according to the present embodiment further includes the second bypass passage 74 on which the second flow control device 75 is disposed. In any of the cooling only operation mode, the cooling main operation mode, the heating only operation mode, and the heating main operation mode, the second bypass passage 74 has one end connected to the pipe between the heat source side heat exchanger 13 and the main pipe 3 through which liquid refrigerant circulates, and the other end connected to the outflow side of the first flow control device 72. In other words, the second bypass passage 74 serves as a bypass between the suction side of the compressor 10 and the pipe connecting the heat source side heat exchanger 13 and the load side expansion devices 20*a* and 20*b*. The second bypass passage 74 is a pipe through which low-temperature and high-pressure liquid refrigerant flows into the suction unit of the compressor 10 in the cooling operation, or middle-temperature and middle-pressure liquid refrigerant or two-phase refrigerant flows into the suction unit of the compressor 10 in the heating operation. The second flow control device 75 is, for example, an electronic expansion valve having a variably controllable opening degree, and is configured to adjust the flow rate of liquid refrigerant flowing into the suction unit of the compressor 10 or two-phase refrigerant.

The pressure adjustment device 76 is disposed between the heat source side heat exchanger 13 and the upstream connection part with the second bypass passage 74. In other words, the pressure adjustment device 76 is disposed between the heat source side heat exchanger 13 and the connection part connected to the second bypass passage 74 on the pipe connecting the heat source side heat exchanger 13 and the load side expansion devices 20*a* and 20*b*. The pressure adjustment device 76 is, for example, an electronic expansion valve having a variably controllable opening degree, and adjusts the pressure at the upstream part of the second bypass passage 74 to be middle pressure, for example, in the heating operation. In other words, the pressure adjustment device 76 is configured to adjust the pressure of liquid refrigerant or two-phase refrigerant flowing into the second bypass passage 74. The outdoor unit 1 is also provided with the middle-pressure sensor 77 configured to measure the pressure between the outlets of the load side expansion devices 20 and the pressure adjustment device 76.

The pressure adjustment device 76 is fully opened, for example, in the cooling only operation mode and the cooling main operation mode. For example, in the heating only operation mode and the heating main operation mode, the pressure adjustment device 76 has such an opening degree that the pressure between the outlets of the load side expansion devices 20*a* to 20*c* of the indoor units 2 and the inlet of the pressure adjustment device 76 is increased to middle pressure. Specifically, the pressure adjustment device 76 is controlled so that a value measured by the middle-pressure sensor 77 becomes equal to a pressure value set in advance.

In this manner, in the air-conditioning apparatus 302 according to the present embodiment in any of the cooling only operation mode, the cooling main operation mode, the heating only operation mode, and the heating main operation mode, the suction enthalpy of the compressor 10 can be decreased by fluid cooled through the auxiliary heat exchanger 71 and also by part of refrigerant cooled through the heat source side heat exchanger 13. Thus, in the air-conditioning apparatus 302 according to the present embodiment, when the discharge temperature of the compressor 10 has increased, the increase of the discharge temperature of the compressor 10 can be reduced. Specifically, for example, when the heat exchange capacity, which is the processing capacity of the auxiliary heat exchanger 71, has reached an upper limit of the heat exchange capacity, the increase of the discharge temperature of the compressor 10 can be reduced by opening the second flow control device 75. In the air-conditioning apparatus 302 according to the present embodiment, as the increase of the discharge temperature of the compressor 10 can be reduced, degradation of refrigerating machine oil and damage on the compressor 10 can be reduced. In addition, as refrigerating machine oil at the suction unit of the compressor 10 is reliably cooled, loss due to suction heating of the compressor 10 can be reduced. Furthermore, as increase of the discharge temperature of the compressor 10 is reduced, the rotation frequency of the compressor 10 can be increased to improve cooling intensity.

Figure 26:
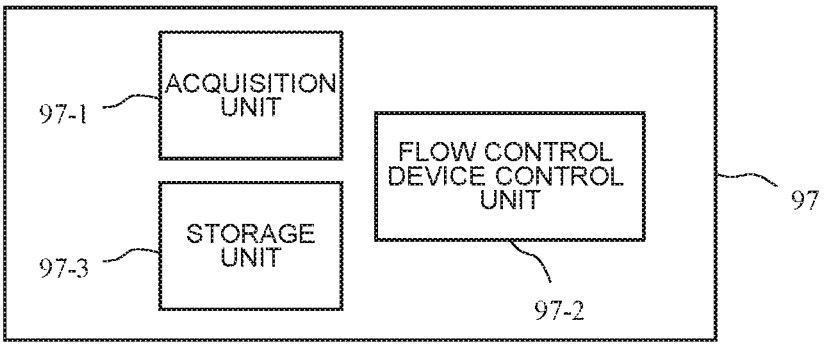
FIG. 26 is a diagram schematically illustrating the configuration of a controller of the air-conditioning apparatus according to each of Embodiments 1 to 10 of the present invention.

FIG. 26 is a diagram schematically illustrating the configuration of the controller of the air-conditioning apparatus according to each of Embodiments 1 to 10 of the present invention. As illustrated in FIG. 26, the controller 97 includes an acquisition unit 97-1 configured to acquire outputs from various sensors, a flow control device control unit 97-2 configured to adjust the opening degree of the first flow control device 72 or the opening degree of the second flow control device 75 on the basis of measurement results of the various sensors acquired by the acquisition unit 97-1, and a storage unit 97-3 configured to store, for example, parameters used to adjust the opening degree of the first flow control device 72 or the opening degree of the second flow control device 75.

As described above, the air-conditioning apparatus according to each of Embodiments 1 to 10 includes the refrigerant circuit 15 in which pipes connect the compressor 10, the heat source side heat exchanger 13, each expansion device 20, and each load side heat exchanger 21 and through which refrigerant circulates, the first bypass passage 70 serving as a bypass between the discharge side of the compressor 10 and the suction side of the compressor 10, the auxiliary heat exchanger 71 disposed in the first bypass passage 70 and configured to cool refrigerant, the first flow control device 72 disposed in the first bypass passage 70 and configured to control passing of refrigerant by adjusting the opening degree of the first flow control device 72, and the discharge temperature sensor 80 configured to measure the temperature of refrigerant discharged from the compressor 10. The opening degree of the first flow control device 72 is increased when a temperature measured by the discharge temperature sensor 80 is higher than a discharge target temperature value that is a target temperature of refrigerant when discharged from the compressor 10, and the opening degree of the first flow control device 72 is decreased when the temperature measured by the discharge temperature sensor 80 is lower than the discharge target temperature value. Preferably, the air-conditioning apparatus further includes the bypass path 78 connected to the first flow control device 72 in parallel. Preferably, the air-conditioning apparatus further includes the flow controller 73 disposed in the bypass path 78 and configured to control passing of refrigerant, and the flow controller 73 has a smaller passage resistance than the passage resistance of the first flow control device 72 when the first flow control device 72 is fully opened. Preferably, the air-conditioning apparatus further includes the oil separator 11 disposed in a pipe connecting the compressor 10 and the expansion device 20 and configured to separate refrigerating machine oil from refrigerant discharged from the compressor 10, and the discharge side of the compressor 10 in the first bypass passage 70 is connected to the oil separator 11. Preferably, the air-conditioning apparatus further includes the auxiliary heat exchanger outlet temperature sensor 83 configured to measure the temperature of fluid subjected to heat exchange at the auxiliary heat exchanger 71, and the outside air temperature sensor 96 configured to measure the temperature of air to be subjected to heat exchange at the heat source side heat exchanger 13, the opening degree of the first flow control device 72 is fixed when the difference between a temperature measured by the auxiliary heat exchanger outlet temperature sensor 83 and a temperature measured by the outside air temperature sensor 96 is larger than a threshold, and when the difference between a temperature measured by the auxiliary heat exchanger outlet temperature sensor 83 and a temperature measured by the outside air temperature sensor 96 is smaller than the threshold, the opening degree of the first flow control device 72 is increased when a temperature measured by the discharge temperature sensor 80 is higher than the discharge target temperature value, or the opening degree of the first flow control device 72 is decreased when the temperature measured by the discharge temperature sensor 80 is lower than the discharge target temperature value. Preferably, the air-conditioning apparatus further includes a condensing temperature measurement device configured to measure the condensing temperature of refrigerant, and the threshold is equal to or smaller than the difference between the condensing temperature acquired by the condensing temperature measurement device and the temperature measured by the outside air temperature sensor 96. Preferably, the air-conditioning apparatus further includes the second bypass passage 74 serving as a bypass between the pipe connecting the heat source side heat exchanger 13 and the expansion device 20, and the suction side of the compressor 10. Preferably, the air-conditioning apparatus further includes the second flow control device 75 disposed in the second bypass passage 74 and configured to control passing of refrigerant by adjusting the opening degree of the second flow control device 75. Preferably, the pressure adjustment device 76 configured to adjust the pressure of refrigerant is disposed between the heat source side heat exchanger 13 and the connection part connected to the second bypass passage 74 on the pipe connecting the heat source side heat exchanger 13 and the expansion device 20. Preferably, the opening degree of the first flow control device 72 or the second flow control device 75 is increased when the temperature measured by the discharge temperature sensor 80 is higher than the discharge target temperature value, and the opening degree of the first flow control device 72 or the second flow control device 75 is decreased when the temperature measured by the discharge temperature sensor 80 is lower than the discharge target temperature value. Preferably, the opening degree of the second flow control device 75 is adjusted when the difference between a temperature measured by the auxiliary heat exchanger outlet temperature sensor 83 and a temperature measured by the outside air temperature sensor 96 is larger than the threshold. With the above-described configuration, the present invention provides an air-conditioning apparatus in which increase of the discharge temperature of the compressor 10 is reduced.

The present invention is not limited to the above-described embodiments, but may be modified in various manners without departing from the scope of the present invention. In other words, any configuration according to the above-described embodiments may be modified as appropriate, or at least part of the configuration may be replaced with another configuration. In addition, any component, the disposition of which is not particularly limited may be disposed at any position at which the function of the component is achieved instead of a disposition disclosed in the embodiments.

For example, although the above description is made on the example in which the discharge temperature threshold is 115 degrees C. in the cooling operation mode and the heating operation mode, the discharge temperature threshold may be, for example, set depending on the limit value of the discharge temperature of the compressor 10.

For example, when the limit value of the discharge temperature of the compressor 10 is 120 degrees C., the operation of the compressor 10 is controlled by the controller 97 so that the discharge temperature of the compressor 10 does not exceed 120 degrees C. For example, when the discharge temperature of the compressor 10 exceeds 110 degrees C., the controller 97 controls the compressor 10 to decelerate by reducing the frequency of the compressor 10. In this configuration in which the limit value of the discharge temperature of the compressor 10 is 120 degrees C. and the compressor 10 is decelerated when the discharge temperature of the compressor 10 exceeds 110 degrees C., the discharge temperature threshold is preferably set to be a temperature (for example, 105 degrees C.) between 110 degrees C. and 100 degrees C. and slightly lower than the threshold of 110 degrees C. for reducing the frequency of the compressor 10.

For example, in a configuration in which the limit value of the discharge temperature of the compressor 10 is 120 degrees C. and the compressor 10 is not decelerated when the discharge temperature of the compressor 10 exceeds 110 degrees C., the discharge temperature threshold is preferably set to be a temperature (for example, 115 degrees C.) between 120 degrees C. and 100 degrees C.

For example, a refrigerant used in the air-conditioning apparatus according to each of the above-described embodiments is not limited to R32 but may be, for example, a refrigerant mixture containing R32. Examples of the refrigerant mixture containing R32 include a refrigerant mixture (zeotropic refrigerant mixture) containing R32 and a refrigerant such as HFO1234yf and HFO1234ze. The refrigerant such as HFO1234yf and HFO1234ze is tetrafluoropropene refrigerant expressed in the chemical formula of $CF_3CF{=}CH_2$ and having a small global warming potential. It is known that R32 or a refrigerant containing R32 leads to increase of the discharge temperature of the compressor 10 by 20 degrees C. approximately from that with R410A in the identical operation state of the compressor 10.

For example, it is known that, when the mass ratio of R32 is equal to or larger than 62% (62 wt %) in a refrigerant mixture of R32 and HFO1234yf, the discharge temperature of a compressor is higher by 3 degrees C. or more than a case in which R410A is used.

For example, it is known that, when the mass ratio of R32 is equal to or larger than 43% (43 wt %) in a refrigerant mixture of R32 and HFO1234ze, the discharge temperature is higher by 3 degrees C. or more than a case in which R410A is used.

The air-conditioning apparatus described in each of the above-described embodiments is capable of decreasing the discharge temperature of a compressor. The effect of temperature decreasing is significant in an air-conditioning apparatus using a refrigerant that leads to increase of the discharge temperature of a compressor as described above.

A refrigerant that leads to increase of the discharge temperature of a compressor is not limited to a refrigerant containing R32, but includes a refrigerant such as $CO_2$ (R744) that is supercritical at a high-pressure side.

For example, in the air-conditioning apparatus according to each of the above-described embodiments, the auxiliary heat exchanger 71 and the heat source side heat exchanger 13 are integrated with each other. However, the auxiliary heat exchanger 71 and the heat source side heat exchanger 13 may be separately provided. In the air-conditioning apparatus according to each of the above-described embodiments, the auxiliary heat exchanger 71 is disposed on the lower side, and the heat source side heat exchanger 13 is disposed on the upper side. However, the auxiliary heat exchanger 71 may be disposed on the upper side, and the heat source side heat exchanger 13 may be disposed on the lower side.

The above-described Embodiments 5 to 8 each describe an exemplary air-conditioning apparatus in which the outdoor unit 1 is connected to the relay device 5 or 6 through the two main pipes 3, but the above-described Embodiments 5 to 8 are not limited to this example. For example, an air-conditioning apparatus in which the outdoor unit 1 is connected to the relay device 5 or 6 through three main pipes is applicable.

For example, in the above-described embodiments, the compressor 10 is a low-pressure shell compressor, but may be a high-pressure shell compressor.

For example, typically, an air-sending device configured to promote condensation or evaporation of refrigerant by air-sending is installed close to a heat source side heat exchanger or a load side heat exchanger in many cases. The above-described embodiments each describe an example in which an air-sending device is installed close to a heat source side heat exchanger, an auxiliary heat exchanger, or a load side heat exchanger, but the above-described embodiments are not limited to this example. For example, a panel heater by radiation may be used as a load side heat exchanger. A heat exchanger configured to exchange heat of refrigerant with water or liquid such as antifreeze liquid may be used as a heat source side heat exchanger or an auxiliary heat exchanger. In other words, any device capable of performing heat radiation or heat removal of refrigerant may be used as a heat source side heat exchanger, an auxiliary heat exchanger, or a load side heat exchanger. For example, a plate heat exchanger is used as a heat exchanger configured to exchange heat of refrigerant with water or liquid such as antifreeze liquid.

The above description is exemplarily made on a direct expansion air-conditioning apparatus in which the outdoor unit 1 and each indoor unit 2 are connected to each other by piping to circulate refrigerant through the air-conditioning apparatus, a direct expansion air-conditioning apparatus in which the outdoor unit 1, the relay device 5, and each indoor unit 2 are connected to each other by piping to circulate refrigerant through the air-conditioning apparatus, and an indirect air-conditioning apparatus in which the outdoor unit 1 and the relay device 6 are connected to each other by piping to circulate refrigerant through the air-conditioning apparatus and the relay device 6 and each indoor unit 2 are connected to each other by piping to circulate brine through the air-conditioning apparatus, but the above-described embodiments are not limited to these examples. For example, the above-described embodiments are also applicable to an air-conditioning apparatus in which refrigerant circulates only in an outdoor unit, brine circulates in the outdoor unit, a relay device, and an indoor unit, and the refrigerant exchanges heat with heat medium at the outdoor unit to perform air-conditioning. The above-described embodiments describe indoor heating (heating operation) and cooling (cooling operation), but are applicable to, instead of an indoor unit, a device configured to exchange heat, for example, between refrigerant and water to generate hot water in a heating operation or cold water in a cooling operation.

REFERENCE SIGNS LIST

1 outdoor unit 2 indoor unit 2*a* indoor unit 2*b* indoor unit 2*c* indoor unit 3 main pipe 4 refrigerant pipe 4*a* branch pipe 4*b* branch pipe

4*c* branch pipe 5 relay device 6 relay device 10 compressor 11 oil separator 12 refrigerant flow switching device 13 heat source side heat exchanger 14 fan 15 refrigerant circuit 16 accumulator 16*b* first backflow prevention device 16*d* first backflow prevention device 17 suction pipe

18*a* first connection pipe 18*b* second connection pipe 19 compressor

19*a* first backflow prevention device 19*b* first backflow prevention device 19*c* first backflow prevention device 19*d* first backflow prevention device 20 load side expansion device 20*a* load side expansion device 20*b* load side expansion device 20*c* load side expansion device 21 load side heat exchanger 21*a* load side heat exchanger 21*b* load side heat exchanger 21*c* load side heat exchanger 22 fan 22*a* fan 22*b* fan 22*c* fan 50 gas-liquid separator 51 third expansion device 52 inter-refrigerant heat exchanger 53 first opening and closing device 53*a* first opening and closing device 53*b* first opening and closing device 53*c* first opening and closing device 54*a* second opening and closing device 54*b* second opening and closing device 54*c* second opening and closing device 55*a* second backflow prevention device 55*b* second backflow prevention device 55*c* second backflow prevention device 56*a* third backflow prevention device 56*b* third backflow prevention device 56*c* third backflow prevention device 57 fourth expansion device 60 inter-refrigerant heat exchanger 61 third expansion device 62*a* first flow controller 62*b* second flow controller 63*a* first middle heat exchanger 63*b* second middle heat exchanger 64*a* first flow switching device 64*b* second flow switching device

65*a* first pump 65*b* second pump 66*a* first flow switching device 66*b* first flow switching device 66*c* first flow switching device 67*a* second flow switching device 67*b* second flow switching device 67*c* second flow switching device

68 fourth expansion device 70 first bypass passage 71 auxiliary heat exchanger 72 first flow control device 73 flow controller 74 second bypass passage 75 second flow control device 76 pressure adjustment device

77 middle-pressure sensor 78 bypass path 79 high-pressure sensor discharge temperature sensor 81 refrigerating machine oil temperature sensor 82 low pressure sensor 83 auxiliary heat exchanger outlet temperature sensor 84 outlet side temperature sensor 84*a* outlet side temperature sensor

84*b* outlet side temperature sensor 84*c* outlet side temperature sensor 85 inlet side temperature sensor 85*a* inlet side temperature sensor 85*b* inlet side temperature sensor 85*c* inlet side temperature sensor 86 inlet side pressure sensor 86*a* outlet side temperature sensor 86*b* outlet side temperature sensor

87 outlet side pressure sensor 88 temperature sensor 89 inlet temperature sensor 90 outlet temperature sensor 91*a* inlet temperature sensor 91*b* inlet temperature sensor 92*a* outlet temperature sensor 92*b* outlet temperature sensor 93*a* indoor unit outlet temperature sensor 93*b* indoor unit outlet temperature sensor 94*a* indoor unit inlet temperature sensor 94*b* indoor unit inlet temperature sensor 95*a* indoor unit outlet temperature sensor 95*b* indoor unit outlet temperature sensor 95*c* indoor unit outlet temperature sensor 95*d* indoor unit outlet temperature sensor 96 outside air temperature sensor 97 controller 97-1 acquisition unit 97-2 flow control device control unit 97-3 storage unit 98 outlet pressure sensor 100 air-conditioning apparatus 101 air-conditioning apparatus 102 air-conditioning apparatus 200 air-conditioning apparatus 201 air-conditioning apparatus 202 air-conditioning apparatus 300 air-conditioning apparatus 301 air-conditioning apparatus

302 air-conditioning apparatus ET condensing temperature G1 control constant G2 control constant G3 control constant G4 control constant O1*con* operation amount O1*d* first flow control device current opening degree O1*n* output opening degree O1*nex* output opening degree O1*op* correction opening degree O2*con* operation amount O2*d* second flow control device current opening degree O2*n* output opening degree O2*nex* output opening degree O2*op* correction opening degree OILsh refrigerating machine oil superheat degree threshold Ocon operation amount Od opening degree On output opening degree Onex output opening degree Oop correction opening degree Osh refrigerating machine oil superheat degree Ps discharge side pressure SHoil refrigerating machine oil superheat degree target value T1 auxiliary heat exchanger outlet side temperature Ta outside air temperature Td discharge temperature Tdn target discharge temperature Toil refrigerating machine oil temperature Tth temperature difference threshold ΔOoil refrigerating machine oil correction amount ΔOoil2 refrigerating machine oil correction amount ΔOsh refrigerating machine oil superheat degree difference ΔT temperature difference ΔTd discharge temperature adjustment amount

The invention claimed is:

1. An air-conditioning apparatus comprising:

a refrigerant circuit in which pipes sequentially connect a compressor, a flow switching valve, a heat source side heat exchanger, an expansion valve, and a load side heat exchanger, and configured to perform a cooling operation and a heating operation switched by the flow switching valve, the cooling operation being an operation in which a discharge side of the compressor is connected to the heat source side heat exchanger and a suction side of the compressor is connected to the load side heat exchanger, the heating operation being an operation in which the discharge side of the compressor is connected to the load side heat exchanger and the suction side of the compressor is connected to the heat source side heat exchanger;

an oil separator disposed in a pipe connected to the discharge side of the compressor, and configured to separate refrigerating machine oil from refrigerant discharged from the compressor;

a first bypass passage connected to an oil outflow side of the oil separator and the suction side of the compressor, and in which fluid flowing out of the oil separator flows;

an auxiliary heat exchanger disposed in the first bypass passage including a plurality of heat transfer tubes and a plurality of fins provided on the plurality of heat transfer tubes, and configured to cool the fluid;

a first flow control expansion valve disposed in the first bypass passage, and configured to control passing of the fluid;

a second bypass passage connected to a pipe connecting the heat source side heat exchanger and the expansion valve and to a pipe connecting the suction side of the compressor and the flow switching valve, and in which a liquid refrigerant or a two-phase gas-liquid refrigerant flowing through the pipe connecting the heat source side heat exchanger and the expansion valve flows; and a second flow control expansion valve disposed in the second bypass passage, and configured to control passing of refrigerant;

a discharge temperature sensor configured to measure a temperature of refrigerant discharged from the compressor;

a controller configured to control an opening degree of the first flow control expansion valve or the second flow control expansion valve on a basis of a discharge temperature measured by the discharge temperature sensor;

an auxiliary heat exchanger outlet temperature sensor configured to measure a temperature of fluid subjected to heat exchange at the auxiliary heat exchanger; and an outside air temperature sensor configured to measure a temperature of air to be subjected to heat exchange at the heat source side heat exchanger, the controller being configured to increase the opening degree of the first flow control expansion valve or the second flow control expansion valve when a temperature measured by the discharge temperature sensor is higher than a discharge temperature target value that is a target temperature of refrigerant discharged from the compressor, and to decrease the opening degree of the first flow control expansion valve or the second flow control expansion valve when the temperature measured by the discharge temperature sensor is lower than the discharge temperature target value, in the cooling operation, the controller being configured to determine whether to control the first flow control expansion valve on a basis of a difference between a temperature measured by the auxiliary heat exchanger outlet temperature sensor and a temperature measured by the outside air temperature sensor.

2. The air-conditioning apparatus of claim 1, further comprising a pressure adjustment expansion valve disposed between the heat source side heat exchanger and a connection part connected to the second bypass passage on the one of the pipes connecting the heat source side heat exchanger and the expansion valve, and configured to adjust a pressure of refrigerant.

3. The air-conditioning apparatus of claim 1, further comprising an accumulator disposed between the flow switching valve and the suction side of the compressor.

4. The air-conditioning apparatus of claim 1, wherein the controller is configured to control the first flow control expansion valve when the difference between a temperature measured by the auxiliary heat exchanger outlet temperature sensor and a temperature measured by the outside air temperature sensor is smaller than a threshold, and not to control the first flow control expansion valve when the difference between a temperature measured by the auxiliary heat exchanger outlet temperature sensor and a temperature measured by the outside air temperature sensor is larger than the threshold.

5. The air-conditioning apparatus of claim 1, wherein, in the cooling operation, the controller is configured to control the first flow control expansion valve when the difference between a temperature measured by the auxiliary heat exchanger outlet temperature sensor and a temperature measured by the outside air temperature sensor is smaller than a threshold, and to control the second flow control expansion valve when the difference between a temperature measured by the auxiliary heat exchanger outlet temperature sensor and a temperature measured by the outside air temperature sensor is larger than the threshold.

6. The air-conditioning apparatus of claim 4, further comprising a first pressure sensor configured to measure a discharge pressure of refrigerant discharged from the compressor, wherein the threshold is equal to or smaller than a difference between a temperature measured by the outside air temperature sensor and a condensing temperature calculated on a basis of a discharge pressure measured by the first pressure sensor.

7. The air-conditioning apparatus of claim 2, further comprising a second pressure sensor configured to measure a pressure of refrigerant between the expansion valve and the pressure adjustment expansion valve, wherein, in the heating operation, the controller is configured to control the pressure adjustment expansion valve so that a pressure measured by the second pressure sensor is higher than a pressure at the one of the pipes connecting the suction side of the compressor and the flow switching valve.

8. The air-conditioning apparatus of claim 1, wherein the controller is configured to control the first flow control expansion valve and the second flow control expansion valve in the cooling operation, and to control the second flow control expansion valve in the heating operation.

9. The air-conditioning apparatus of claim 1, further comprising a bypass path connected to the first flow control expansion valve in parallel.

10. The air-conditioning apparatus of claim 9, further comprising a flow controller disposed in the bypass path, and configured to control passing of refrigerant, wherein the flow controller has a smaller passage resistance than a passage resistance of the first flow control expansion valve when the first flow control expansion valve is fully opened.

11. The air-conditioning apparatus of claim 9, further comprising a capillary tube disposed in the bypass path, and configured to control passing of refrigerant, wherein the capillary tube has a smaller passage resistance than a passage resistance of the first flow control expansion valve when the first flow control expansion valve is fully opened.

* * * * *